US009284099B2

(12) United States Patent
Giraud et al.

(10) Patent No.: US 9,284,099 B2
(45) Date of Patent: Mar. 15, 2016

(54) FLAT PACK CONTAINERS

(75) Inventors: Jean-Pierre Giraud, Auburn, AL (US); Michel Zbirka, Jouy-sur-Morin (FR); Herve Pichot, Chenneviere-sur-Marne (FR); Bruce Rabinne, Boissy-le-Chatel (FR); Micheline Zbirka, legal representative, Jouy-sur-Morin (FR)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 14/000,563

(22) PCT Filed: Feb. 20, 2012

(86) PCT No.: PCT/US2012/025813

§ 371 (c)(1), (2), (4) Date: Feb. 27, 2014

(87) PCT Pub. No.: WO2012/115905

PCT Pub. Date: Aug. 30, 2012

(65) Prior Publication Data

US 2015/0021326 A1 Jan. 22, 2015

Related U.S. Application Data

(60) Provisional application No. 61/445,869, filed on Feb. 23, 2011.

(51) Int. Cl.

*B65D 39/00* (2006.01)
*A61J 1/03* (2006.01)
(Continued)

(52) U.S. Cl.

CPC ..... *B65D 39/0076* (2013.01); *A61J 1/03* (2013.01); *B65D 50/046* (2013.01); *B65D 83/0409* (2013.01); *A61J 1/035* (2013.01); *B65D 2215/06* (2013.01); *B65D 2583/0481* (2013.01)

(58) Field of Classification Search

CPC ..... A61J 1/03; B65D 39/0076; B65D 50/046; B65D 83/0409; B65D 83/0463

See application file for complete search history.

(56) References Cited

U.S. PATENT DOCUMENTS 5,553,739 A 9/1996 Plum et al.
7,216,776 B2 * 5/2007 Gelardi ..... 221/256

FOREIGN PATENT DOCUMENTS

EP 0857665 8/1998
EP 0916595 5/1999

(Continued)

OTHER PUBLICATIONS

PCT, Notification Concerning Transmittal of International Preliminary Report on Patentability, in application No. PCT/US2012/025813, dated Sep. 6, 2013.

(Continued)

*Primary Examiner* — Andrew Perreault
(74) *Attorney, Agent, or Firm* — David B. Gornish

(57) ABSTRACT

A child-resistant package includes a seal for sealing a package and a latch for securing the package in a closed position. According to embodiments, the package includes a first shell portion having a first closed lip and a second shell portion having a second closed lip. According to embodiments, the seal may be formed by the engagement of an angled outer wall of the first closed lip with a bent or deformed thin wall of the second closed lip. The package may also incorporate one or more elastomeric ancillary face and/or side seals. The first and second shell portions may be joined by a hinge, such as a double hinge. Additionally, the insert may include a dispenser assembly that controls the dispensing of product from a product containing space to a dispenser receptacle. A spring may bias the latch in a locked or rest position.

5 Claims, 58 Drawing Sheets

(51) Int. Cl.
*B65D 50/04* (2006.01)
*B65D 83/04* (2006.01)

(56) References Cited

FOREIGN PATENT DOCUMENTS

| | | |
|---|---|---|
| JP | 2004-299753 | 10/2004 |
| KR | 1020110002347 | 1/2011 |
| WO | 2004/026728 | 4/2004 |
| WO | 2006/137176 | 12/2006 |

OTHER PUBLICATIONS

Chinese Patent Office, Office action in application No. 201080037601.X, dated Sep. 22, 2013. (partial translation).
International Search Report and Written Opinion for International Patent Application No. PCT/US2012/025813 mailed Feb. 20, 2012.

* cited by examiner

FLAT PACK CONTAINERS

RELATED APPLICATION

This application is a 371 National Phase filing of International Patent Application Serial No. PCT/US2012/025813 filed Feb. 20, 2012, which claims priority to U.S. Patent Application Ser. No. 61/445,869, filed Feb. 23, 2011, which are all incorporated herein by reference in their entirety.

BACKGROUND OF THE INVENTION

The present invention relates to a package, for example a child-resistant, elder friendly package to contain articles such as pharmaceutical dosage forms or tobacco products.

Containers provided with child safety features are well known in the art, particularly in North America, for packaging pharmaceutical products. The child safety feature is also referred to as a Child-Resistant Closure (CRC). In general, a child-resistant closure must be difficult for children under 5 years old to open, yet be generally user friendly for users over 50 years old, particularly for users over 60 years old. The US government has established a CR protocol to evaluate effectiveness of closures. Child-Resistant Protocol testing is defined under CFR Title 16, Part 1700 by the Food and Drug Administration. Ideally these are provided in a way that is easy and convenient for the intended consumer to use the product.

Product packaging enhances a product with many additional features such as environmental protection and protection from being damaged. Many products are packaged in multiple unit packages or bulk for consumer convenience and packaging efficiency. Typically the entire product is exposed when the package is opened. If the product needs to be protected from the environment, for example humidity, then a seal is required.

One way to ensure the product is protected is to provide a seal for the entire contents of the package. This type of approach may impose certain dimensional, shape or other design constraints on the package design. In this approach, all of the product may be exposed to the consumer or child who opens the package. Some means would be needed to restrain the product so that it is held in place so that it is easy to access but does not fall out of the package.

Another way is to protect the product in a protective envelope or wrapper. When this wrapper is opened, the entire product is exposed. Again, the entire product is exposed to the environment and it is no longer protected. In addition, the entire remaining product is exposed to children.

Depending on the requirements of the package, the design may become complicated with several contradictory constraints that would need to be managed in order to meet the requirements. This could lead to added expense and an undesirable package for the consumer.

BRIEF SUMMARY OF THE INVENTION

An aspect of the invention is a package including a first shell portion having an inner region, a second shell portion, and, optionally, a hinge joining the first shell portion and the second shell portion. An insert is secured in the inner region, the insert including a product containing space and a dispenser receptacle. The product containing space has a mouth through which product may be removed from the product containing space. The dispenser receptacle has an opening through which product may enter the dispenser receptacle. The position of the mouth is at least partially offset from the position of the opening.

A slide assembly is operably attached to the insert, the slide assembly including a lever adapted to be displaced by a user to move the slide assembly from a closed position to an open position. The slide assembly also includes a slide opening, the slide opening being in communication with the mouth of the product containing space when the slide assembly is in a closed position so the slide opening receives product from product containing space. The slide opening is in communication with the opening of the dispenser receptacle when the slide assembly is displaced to an open position to deliver product from the product containing space that is in the slide opening to the dispenser receptacle. Additionally, a spring is configured to bias the positioning of the slide assembly.

Additionally, according to another aspect of the invention, a package includes a first shell portion having an inner region, a second shell portion, and, optionally, a hinge joining the first shell portion and the second shell portion. The package also includes an insert secured in the inner region. The insert includes a product containing space and a dispenser receptacle. The product containing space has a mouth through which product may be removed from the product containing space. The dispenser receptacle has an opening through which product may enter the dispenser receptacle. The mouth and the opening are at least partially offset.

The insert also includes a push button assembly that is attached to the insert. The push button assembly includes a button having an aperture and at least one spring. The aperture is positioned within at least a portion of the body of the button. The aperture is in communication with the mouth when the push button assembly is in a closed position so that the aperture may receive product from the product containing space. The aperture is in communication with the opening of the dispenser when the push button assembly is displaced to an open position so that product in the aperture is delivered through the opening to the dispenser receptacle. The at least one spring is configured to bias the position of the slide assembly.

Another aspect of the invention is a package that includes a first shell portion having an inner region, a second shell portion, and, optionally, a hinge joining the first shell portion and the second shell portion. The package also includes an insert secured in the inner region. The insert includes a product containing space and a dispenser receptacle. The product containing space has a mouth through which product may be removed from the product containing space. The dispenser receptacle has an opening through which product may enter the dispenser receptacle. The position of the mouth is at least partially offset from the position of the opening.

The insert also includes a push button assembly that is attached to the insert. The push button assembly includes a button, at least one spring, a tab, and a ramp. The bottom of the button is separated from the ramp by a distance that permits the placement of product from the mouth of the product containing space to between the bottom of the button and the ramp when the push button assembly is in a closed position. The tab extending from the button is configured to displace the ramp as the button assembly is moved from a closed position to an open position. The displaced ramp is moved into communication with the opening of the dispenser receptacle to allow the product beneath the button to be transported to the dispenser receptacle. The at least one spring is configured to bias the positioning of the slide assembly.

According to another exemplary embodiment of the invention, the first a second shell portions of the package are joined together by a double hinge, among other hinges.

According to another exemplary embodiment of the invention, the package may also include a seal, such as a seal formed by the engagement between a first closed lip of the first shell portion and the second closed lip of the second shell portion, among others. According to an embodiment, the first closed lip may have an angled outer wall that engages with, and distorts, deforms, or bends a generally straight and thin wall of the second closed lip to form the seal. Additionally, the packages may include ancillary elastomeric face and side seals.

Further, the package may include an insert that is covered by a cover. The insert may include a product containing space. The cover may cover at least a portion of the product containing space while also providing a dispenser opening that is configured for the removal of product from the insert. The configuration of the dispenser opening may at least partially depend on the shape of the product that is being dispensed.

According to another exemplary embodiment of the invention, the insert may also include downwardly extending tabs that, when the insert is being inserted into the first base portion, may engage springs in the first shell portion or latch springs that assist in guiding the insert into proper position in the first shell portion.

According to another exemplary embodiment of the invention, the at least the second shell portion and insert may be integrally molded to form a first member. The first member may be attached to a second member, such as a first shell portion or the base of the first shell by a snap fit.

Figure 1:
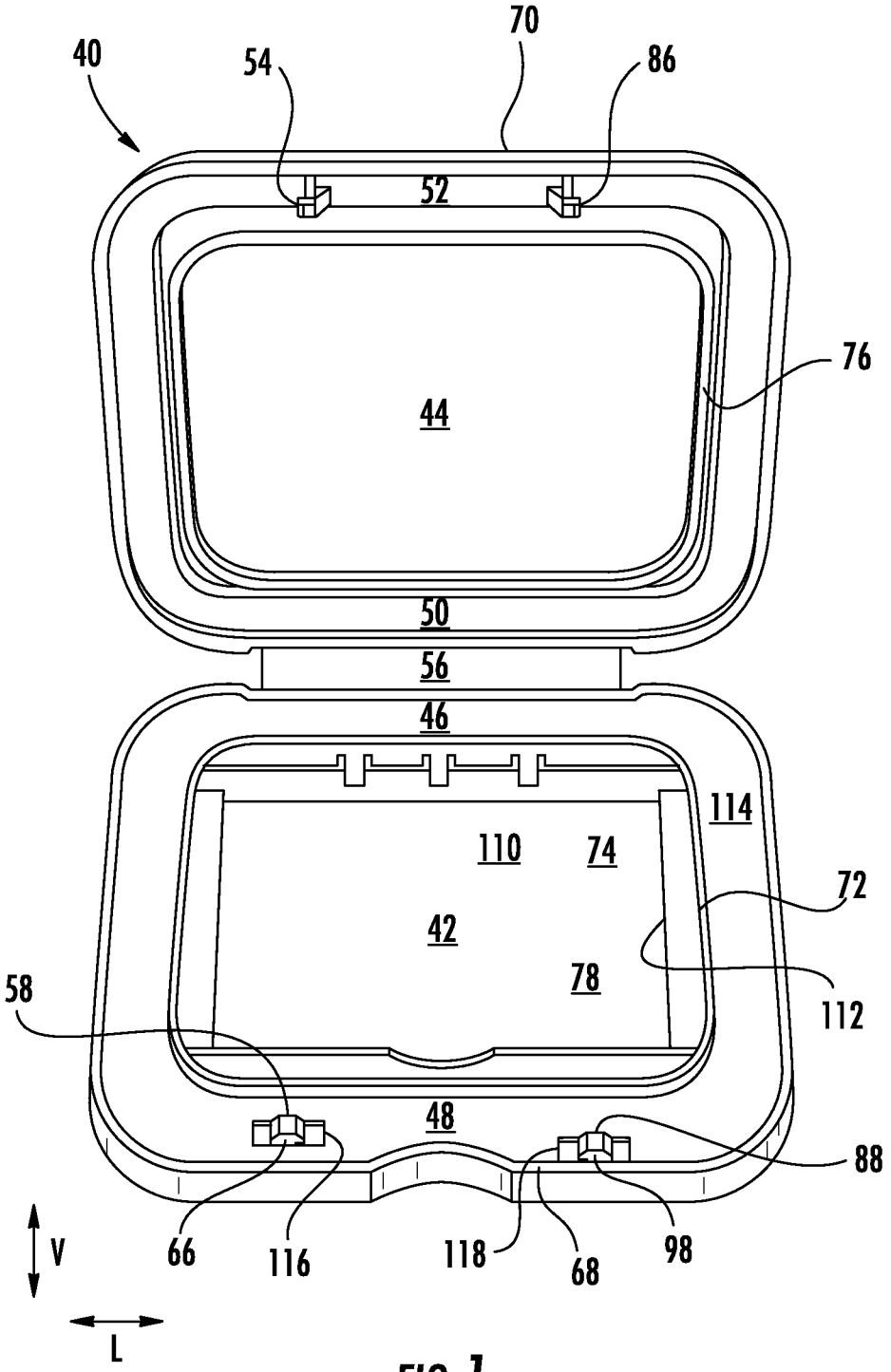
FIG. 1 is a perspective view of an embodiment of the package assembly, showing the lid open to show the interior.

The following reference characters are used in the specification and figures:

| | |
|---|---|
| 40 | package |
| 42 | First shell portion |
| 44 | Second shell portion |
| 46 | First peripheral portion (of 42) |
| 48 | Second peripheral portion (of 42) |
| 50 | First peripheral portion (of 44) |
| 52 | Second peripheral portion (of 44) |
| 54 | First latching abutment |
| 56 | Hinge |
| 58 | Latch |
| 60 | First leg (of 58) |
| 62 | Second leg (of 58) |
| 64 | Actuator portion (of 60) |
| 66 | Second latching abutment |
| 68 | Peripheral edge (of 42) |
| 70 | Peripheral edge (of 44) |
| 72 | First closed lip |
| 74 | Enclosure (defined by 72) |
| 76 | Second closed lip |
| 78 | Insert |
| 80 | First bending ramp (for 62) |
| 82 | First biasing abutment (for 62) |
| 84 | First pivot (of 60) |
| 86 | Third latching abutment |
| 88 | Second latch |
| 90 | Third leg |
| 92 | Fourth leg |
| 94 | Actuator portion (of 90) |
| 96 | Second bending ramp (engaged by 92) |
| 98 | Fourth latching abutment |
| 100 | Second biasing abutment (for 92) |
| 102 | Second pivot (of 90) |

| | |
|---|---|
| 104 | Remainder of 42 (other than insert 78) |
| 106 | Leaf spring (of 60) |
| 108 | Leaf spring (of 90) |
| 110 | Recess |
| 112 | Sidewall (of 110) |
| 114 | Flange |
| 116 | Aperture (in 114) |
| 118 | Aperture (in 114) |
| 420 | Package |
| 422 | First shell portion |
| 424 | Second shell portion |
| 426 | Hinge |
| 428 | Latch |
| 430 | Base peripheral edge |
| 432 | Base sidewall |
| 434 | Inner region |
| 436 | Lid peripheral edge |
| 438 | Lid sidewall |
| 440 | Interior region |
| 442 | Catch |
| 444 | Actuator portion |
| 446 | Lever |
| 447 | Wall segment |
| 448 | Latch engagement portion |
| 450 | First lever leg |
| 452 | Second lever leg |
| 454 | First pivot point |
| 456 | Base plate |
| 458 | Contoured wall segment |
| 460 | First aperture |
| 462 | First opening |
| 464 | Second aperture |
| 466 | Second opening |
| 468 | Catch aperture |
| 470 | Actuator guide |
| 472 | Slot |
| 472 | Latch protrusion |
| 474 | Groove |
| 476 | Double hinge |
| 478 | Body |
| 480 | Space |
| 482 | First pivot |
| 484 | Second pivot |
| 486 | First end |
| 488 | Second end |
| 490 | Insert |
| 494 | Post |
| 496 | Seal |
| 498 | Package |
| 500 | Product containing space |
| 502 | First shell portion |
| 504 | Second shell portion |
| 506 | Insert |
| 508 | First closed lip |
| 510 | Angled outer wall |
| 512 | Second closed lip |
| 514 | Package |
| 516 | First shell portion |
| 518 | Second shell portion |
| 520 | Insert |
| 522 | Ancillary seal |
| 524 | Inner area |
| 526 | Second closed lip |
| 528 | Upper surface (of insert 520) |
| 530 | Inner wall surface (of insert 520) |
| 532 | Inner surface (of second closed lip 530) |
| 534 | Outer wall surface (of insert 520) |
| 536 | Lid guides |
| 538 | Angled outer wall |
| 540 | Package |
| 542 | First shell portion |
| 544 | Second shell portion |
| 546 | Insert |
| 548 | Hinge |
| 550 | Base |
| 552 | Base sidewall |
| 554 | Inner region |
| 556 | Lid sidewall |
| 558 | Top portion |

| | |
|---|---|
| 560 | Interior region |
| 562 | Catch |
| 564 | Catch aperture |
| 566 | Latch |
| 568 | Product containing space |
| 570 | Cover |
| 572 | Dispenser opening |
| 574 | Access opening |
| 576 | Latch leg |
| 578 | Actuator portion |
| 580 | Latch opening |
| 582 | Latch engagement portion |
| 584 | First opening |
| 586 | Second opening |
| 588 | First aperture |
| 590 | Second aperture |
| 704 | Prong |
| 706 | Package |
| 708 | First shell portion |
| 710 | Second shell portion |
| 712 | Insert |
| 714 | Opening |
| 716 | Base Sidewall |
| 718 | Lid latching abutment |
| 720 | Lid sidewall |
| 722 | Interior region |
| 724 | Upper surface |
| 726 | Latch |
| 728 | Aperture |
| 730 | Product containing space |
| 732 | Actuator portion |
| 734 | First leg |
| 736 | Second leg |
| 738 | Base latching abutment |
| 740 | Body |
| 742 | Space |
| 744 | Package |
| 746 | First shell portion |
| 748 | Second shell portion |
| 750 | Insert |
| 752 | Hinge |
| 754 | Latch |
| 756 | Base sidewall |
| 758 | Inner region |
| 760 | Lid latching abutment |
| 762 | Product containing space |
| 764 | Aperture |
| 766 | Second attachment member |
| 768 | Actuator portion |
| 770 | Spring |
| 772 | Leg |
| 774 | Opening |
| 776 | Base latching abutment |
| 778 | Protrusion |
| 780 | Insert |
| 782 | Latch |
| 784 | Bottom |
| 786 | Product containing spaces |
| 788 | Opening |
| 790 | Tab |
| 792 | Guide |
| 794 | Latching abutment |
| 796 | Actuator portion |
| 798 | Spring |
| 800 | Leg opening |
| 802 | Slot |
| 804 | End region |
| 806 | Front portion |
| 808 | First leg |
| 810 | Second leg |
| 812 | Intermediate portion |
| 814 | Package |
| 816 | First shell portion |
| 818 | Second shell portion |
| 820 | Insert |
| 822 | Gasket |
| 824 | Base |
| 826 | Base sidewall |
| 828 | Opening |

-continued

| | |
|---|---|
| 830 | Lid sidewall |
| 832 | Guide post |
| 834 | Lid closed lip |
| 836 | Actuator portion |
| 838 | Central region |
| 840 | Upper surface |
| 842 | Inner wall |
| 844 | Product containing space |
| 846 | Access opening |
| 848 | Cover |
| 850 | Hinge |
| 852 | Upper portion |
| 854 | Lower portion |
| 856 | Space |
| 858 | Groove |
| 860 | Spring |
| 862 | Aperture |
| 864 | Dispenser opening |
| 866 | Package |
| 868 | First shell portion |
| 870 | Second shell portion |
| 872 | Hinge |
| 874 | Insert |
| 876 | Inner wall member |
| 878 | Gasket |
| 880 | Base |
| 882 | Base sidewall |
| 884 | Opening |
| 886 | Lid sidewall |
| 888 | Second closed lip |
| 890 | Catch |
| 892 | Catch aperture |
| 894 | Insert base |
| 896 | Insert wall |
| 898 | Product containing space |
| 900 | Cover |
| 902 | Gasket base |
| 904 | Gasket wall |
| 906 | Inner surface |
| 908 | Outer surface |
| 910 | Gasket lip |
| 912 | First protrusion |
| 914 | Recess (of gasket 878) |
| 916 | Recess (of second closed lip 888) |
| 918 | First surface |
| 920 | Second surface |
| 922 | Latch |
| 924 | Second protrusion |
| 926 | Recess (of inner wall member 876) |
| 928 | Actuator portion |
| 930 | Latching abutment |
| 932 | Leg |
| 934 | First end |
| 936 | Second end |
| 938 | Body |
| 940 | Aperture |
| 942 | Protrusion (of latching abutment 930) |
| 944 | Upper surface |
| 946 | Space |
| 948 | Package |
| 950 | Latch |
| 952 | Insert |
| 954 | First shell portion |
| 956 | Tab |
| 958 | Spring |
| 960 | Rib |
| 962 | Package |
| 964 | First member |
| 966 | Second member |
| 968 | Second shell portion |
| 970 | Insert |
| 972 | First shell portion |
| 974 | Base sidewall |
| 976 | Base |
| 978 | Openings |
| 1054 | Insert |
| 1056 | Product containing space |
| 1058 | Slide assembly |
| 1060 | Dispenser receptacle |

-continued

| | |
|---|---|
| 1062 | Secondary insert |
| 1064 | First sidewall |
| 1066 | Inner opening |
| 1068 | Mouth |
| 1070 | Lever |
| 1072 | Slide opening |
| 1074 | Spring |
| 1076 | Track |
| 1078 | Outer slide wall |
| 1080 | Cover |
| 1082 | Slot |
| 1084 | Insert |
| 1086 | Push button assembly |
| 1088 | Cover |
| 1090 | Product containing space |
| 1092 | Dispenser receptacle |
| 1094 | Secondary insert |
| 1096 | Mouth |
| 1098 | Opening (of dispenser receptacle 1092) |
| 1100 | Button |
| 1102 | Spring |
| 1104 | Orifice |
| 1106 | Dispenser opening |
| 1108 | Sleeve |
| 1110 | Insert |
| 1112 | Push button assembly |
| 1114 | Ramp |
| 1116 | Product containing space |
| 1118 | Dispenser receptacle |
| 1120 | Secondary insert |
| 1122 | Sidewall |
| 1124 | Mouth |
| 1126 | Base |
| 1128 | Spaces |
| 1130 | Opening |
| 1132 | Receptacle sidewall |
| 1134 | Inner wall |
| 1136 | Spring |
| 1138 | Tab |
| 1140 | Cover |
| 1142 | Aperture |
| 1144 | Protrusion |
| 1146 | Extension member |
| 1148 | Button |
| 1150 | Bottom (of button 1148) |
| 1152 | Dispenser opening |

DETAILED DESCRIPTION OF EXEMPLARY EMBODIMENTS

The present invention will now be described more fully with reference to the accompanying drawings, in which several embodiments are shown. This invention may, however, be embodied in many different forms and should not be construed as limited to the embodiments set forth here. Rather, these embodiments are examples of the invention, which has the full scope indicated by the language of the claims. Like numbers refer to like elements throughout.

Referring to FIGS. 1-5, a package 40 is shown having the following common features in the illustrated embodiments: a first shell portion 42, a second shell portion 44, a hinge 56, and a latch 58. A package is broadly defined here to be a package having two portions or leaves that are releasably joined so they can be closed or opened. The two portions or leaves do not need to be congruent, or the same size, or have matching edges to be a package as defined here.

In the illustrated embodiments, the first shell portion 42 has a first peripheral portion 46 and a second peripheral portion 48, and the second shell portion 44 has a first peripheral portion 50 and a second peripheral portion 52. The second peripheral portions 48 and 52 are the entire perimeters of the shell portions 42 and 44, except for the first peripheral portions 46 and 50.

In the illustrated embodiments, the second peripheral portion 52 of the shell portion 44 includes a first latching abutment 54 that is engaged or disengaged by the latch 58 as described below. In the illustrated embodiments, a hinge 56 joins the first shell portion 42 and second shell portion 44 at their first portions 46 and 50, defining a clamshell package. Hinges and hinged portions, however, are not essential and not necessary to carry out any embodiment of any invention disclosed in this specification. For example, in place of the hinge 56, the first and second shell portions 42 and 44 may have two or more hooks or another latch between their respective first peripheral portions 46 or 50 to releasably engage the first and second shell portions 42 and 44.

In the illustrated embodiments, a latch 58 can be provided for latching the second portions 48 and 52 of the first shell portion 42 and second shell portion 44 together. The illustrated latch 58 includes a first leg 60 and a second leg 62, an actuator portion 64, and a second latching abutment 66. The first and second legs 60 and 62 are joined at an angle (which is for example 90 degrees and/or corresponds to the respective angle between a side edge of the second shell portion 44 and the front edge of the second shell portion), and the first leg 60 is secured to the first shell portion 42.

Figure 2:
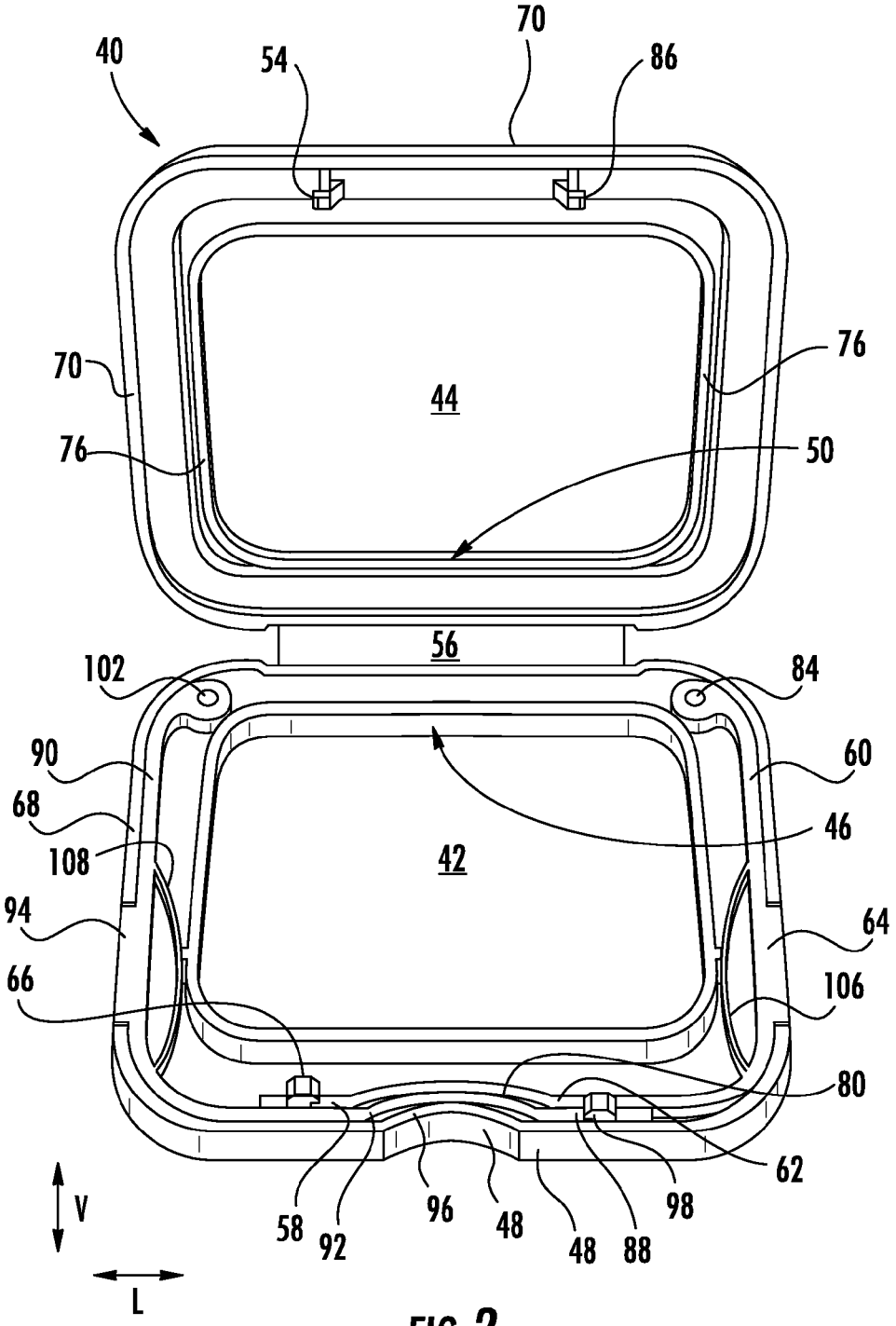
FIG. 2 is a view similar to FIG. 1, but having portions of the insert tray cut away to show underlying details.
Figure 2A:
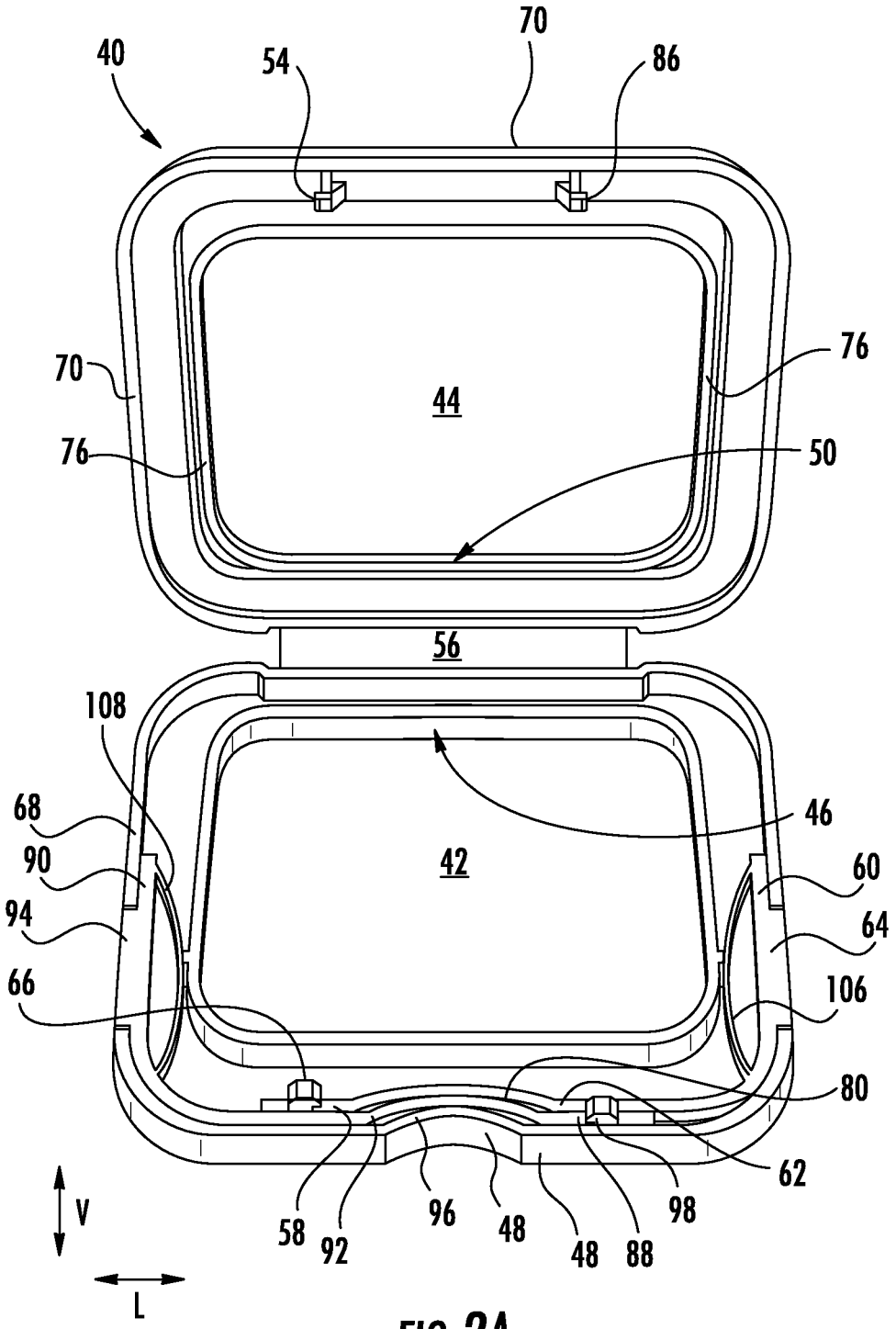
FIG. 2A is a view similar to FIG. 2, showing an alternative embodiment having modified first and third legs 60 and 90 and no pivots 84 and 102.
Figure 3:
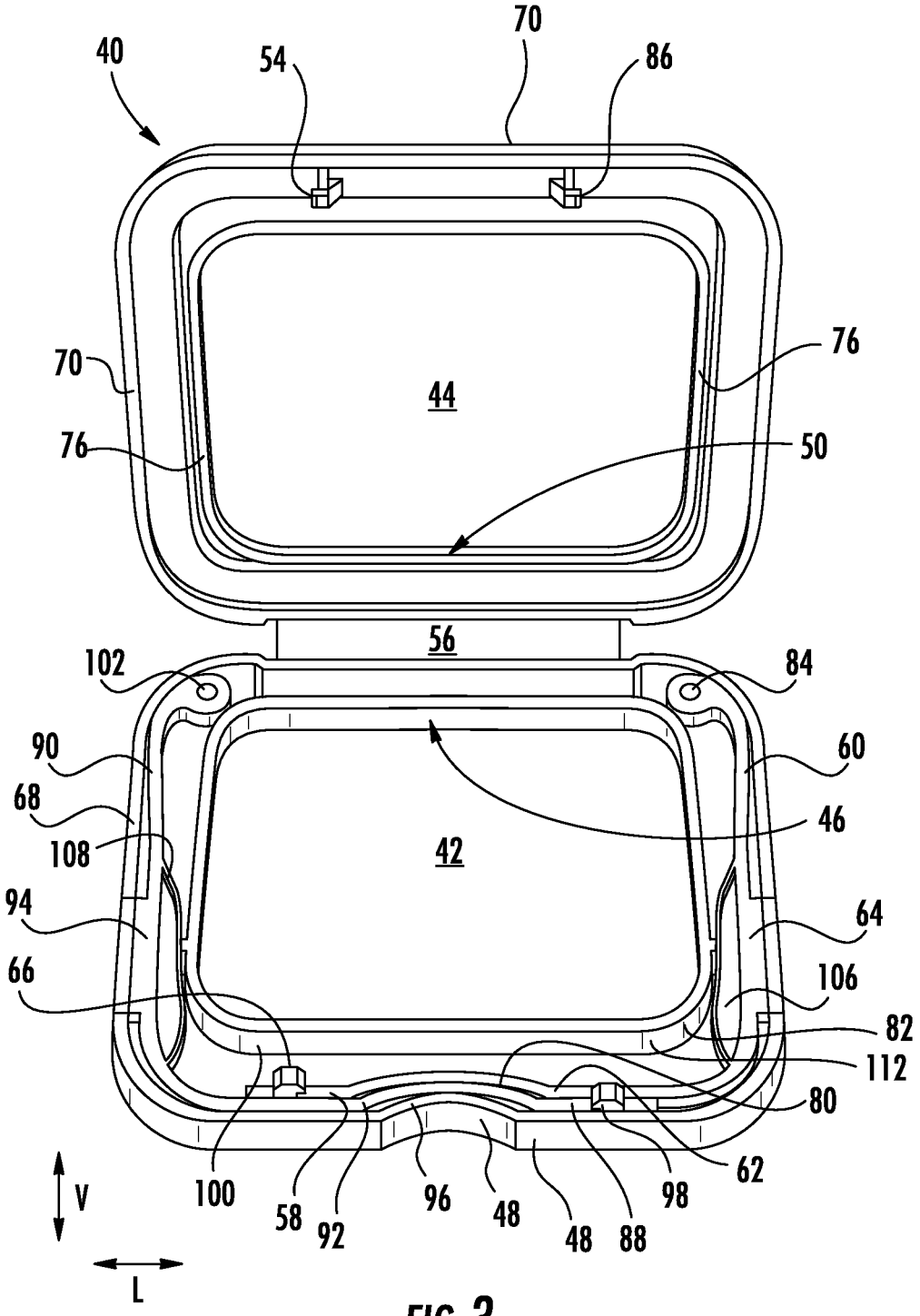
FIG. 3 is a view similar to FIG. 2, showing the latches advanced to their releasing positions.
Figure 3A:
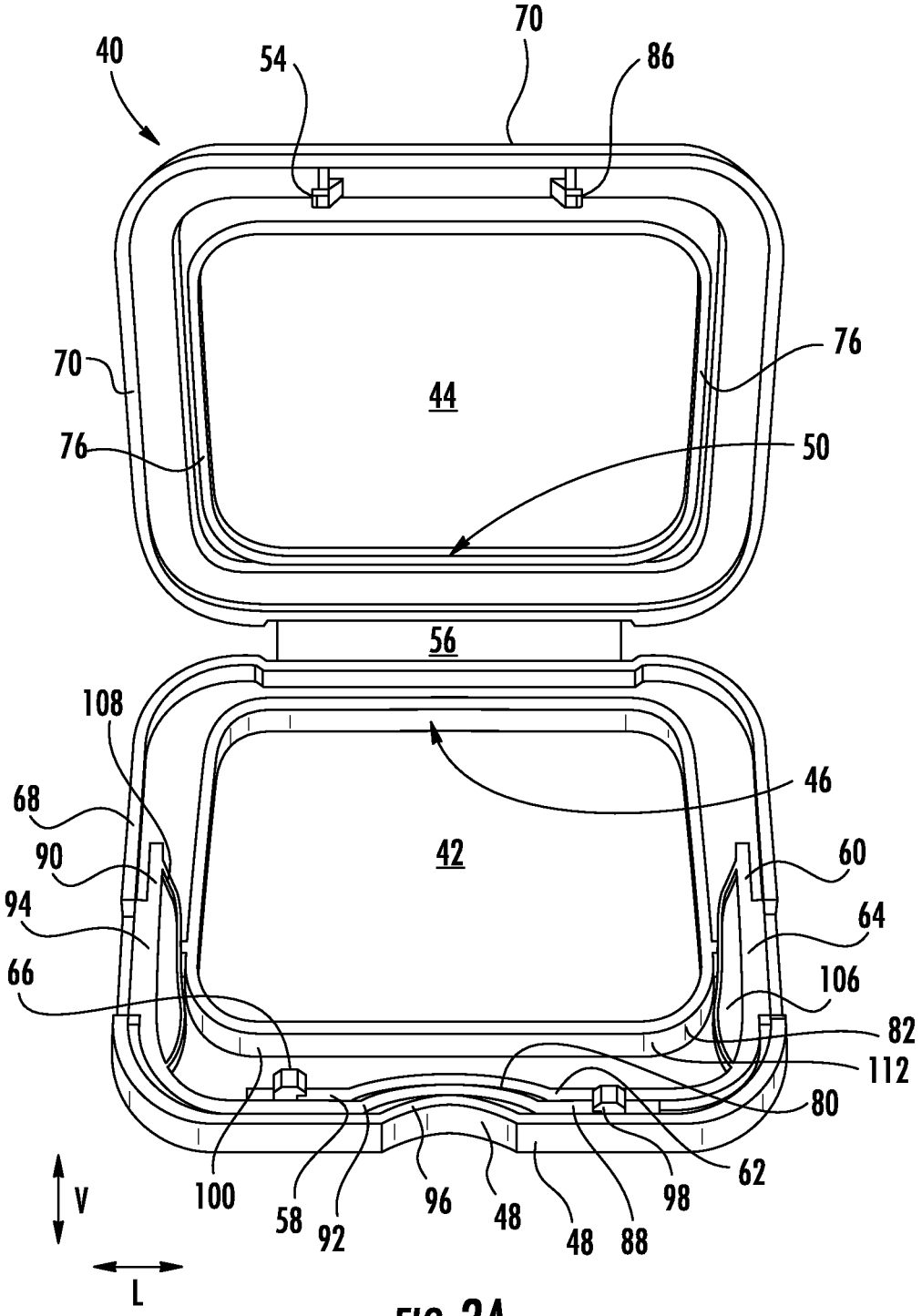
FIG. 3A is a view similar to FIG. 3, showing the alternative embodiment of FIG. 2A.
Figure 4:
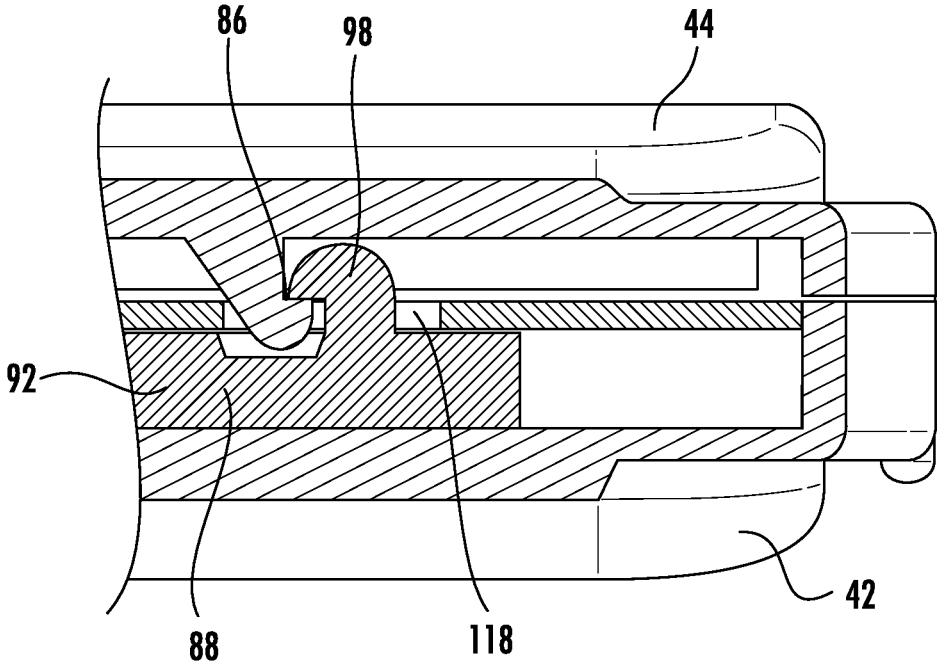
FIG. 4 is a detail side elevation view showing one of the latches engaged.
Figure 5:
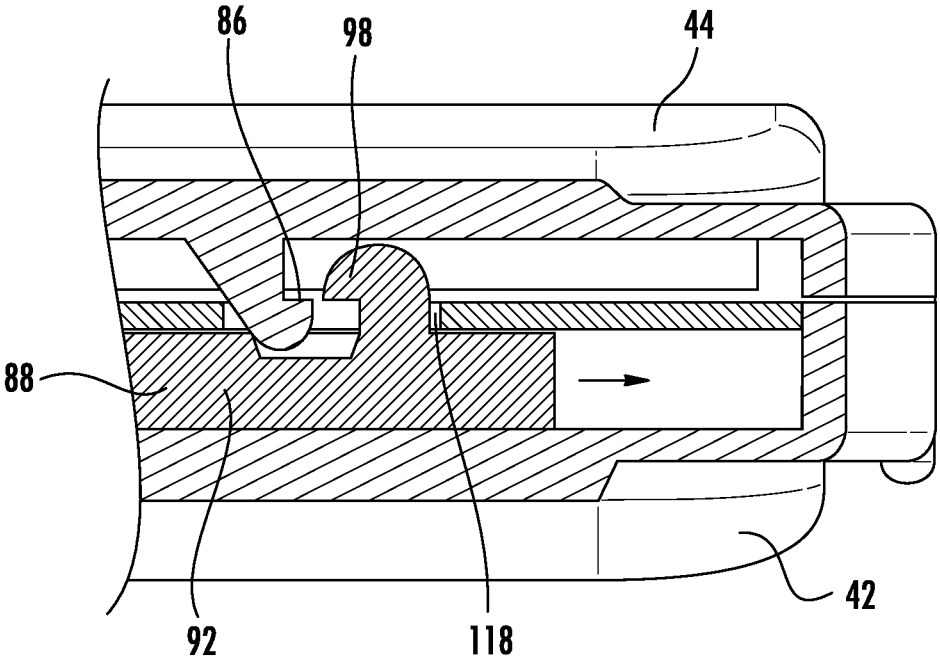
FIG. 5 is a view similar to FIG. 4, showing the latch disengaged.

In the illustrated embodiments, an actuator portion 64 of the first leg 60 is positioned to be displaced generally laterally (in the direction indicated as "L" in FIGS. 1 through 3A) by a user's finger to displace the second leg 62 generally longitudinally from a latched position, illustrated in FIGS. 2 and 4, to a released position, illustrated in FIGS. 3 and 5. In the illustrated embodiments, the actuator portion 64 can be displaced laterally by pushing it inward with one's finger. In this embodiment the lateral displacement of the actuator portion is perpendicular to the first leg 60 (the first leg 60 extends in the direction indicated as "V" in FIGS. 1 though 3A), and thus also perpendicular to the side edge of the second shell portion 44, and parallel to the front edge of the second shell portion 44, since the second leg is arranged parallel to the front edge of the second shell portion 44 and since the angle between the two legs is 90 degrees. Optionally, as shown in FIGS. 2, 2A, 3, and 3A, a resilient element, such as the leaf spring 106, can be provided that resists this displacement and biases the actuator portion 64 toward its latched position. In the illustrated embodiments, the leaf spring 106 optionally bears against a portion of the insert 78 (a side wall defining recess 110, described below, in the illustrated embodiments), resiliently resisting the advance of the actuator portion 64.

In the illustrated embodiments, a second latching abutment 66 is secured to the second leg 62. The second latching abutment 66 in the illustrated embodiments is configured to engage the first latching abutment 54 when the second leg 62 is in its latched position, illustrated in FIGS. 1, 2, and 4, and to release the first latching abutment 54 when the second leg 62 is in its released position, illustrated in FIGS. 3 and 5. Optionally, as shown in FIGS. 2 and 3, a leaf spring 108, can be provided that functions like the leaf spring 106.

In addition to the common and optional features in the illustrated embodiments, the package 40 illustrated in the Figures can have any one or more of numerous additional optional features. Zero, one, or more than one of these optional features can be employed, whether individually or in any combination.

A first optional feature of the embodiments of FIGS. 1-5 is that the first and second shell portions 42 and 44 can have mating peripheral edges 68 and 70. Mating peripheral edges are defined as peripheral edges that are generally congruent and registered when the package 40 is closed.

A second optional feature of the embodiments of FIGS. 1-5 is that a lip seal arrangement can be provided to isolate the interior of the package 40 from the exterior environment when the package 40 is closed. For example, the package 40 can include a first closed lip 72 on the first shell portion 42 defining an enclosure 74, and a mating second closed lip 76 on the second shell portion 44. The second closed lip 76 can be positioned to engage the first closed lip 72 and seal the enclosure 74 from the ambient air outside the enclosure 74 when the first shell portion 42 and second shell portion 44 are latched. "Closed loop" means that a lip is endless or continuous, like a ring. The loop can be round, oval, rectangular with rounded corners, irregular, or have some other shape.

A third optional feature of the embodiments of FIGS. 1-5 is that an insert 78 can be provided as part of the first shell portion, defining the first closed lip 72 and joined to the remainder 104 of the first shell portion 42. The insert 78 illustrated in FIG. 1 can take the form of a tray 78 having a recess 110 located within the closed lip 72 and defined by a sidewall 112. The recess can define a sealed portion of the container. The tray 78 also can include a peripheral flange 114 located outside the closed lip 72. In the illustrated embodiments, the peripheral flange 114 conceals most of the latches 58 and 88 but includes apertures 116 and 118 to allow engagement between the first and second latching abutments 54 and 66, and between the third and fourth latching abutments 86 and 98.

A fourth optional feature of the embodiments of FIGS. 1-5 is that at least a portion of the latch 58 and at least a portion of the latch 88 can be positioned between the flange 114 of the insert 78 and the first shell portion 42. This conceals the latches 58 and 88, while providing the sidewall 112 that acts as a bearing surface against which the second and fourth legs 62 and 92 or the leaf springs 106 and 108 can bear to bias the latches 58 and 88 toward their latched positions. It should be understood that the second latch 88 and the structure it engages are not essential or necessary, as a single latch can alternatively be provided to adequately latch the container closed. For example, the single latch 88 can be modified to carry both the second and fourth abutments 66 and 98, which can be modified so both latch in the same direction.

A fifth optional feature of the embodiments of FIGS. 1-5 is that a bending ramp 80 can be positioned to be engaged by the second leg 62 for bending the second leg 62 into contact with a biasing abutment 82 when the second leg 62 is displaced generally longitudinally from the latched position (shown for example in FIGS. 1, 2, and 4) toward the released position (shown for example in FIGS. 3 and 5). In the illustrated embodiments, the bending ramp 80 is a bent portion of the fourth leg 92, which has the advantage that the bending ramp 80 moves to the right while the second leg 62 moves to the left as the latches 58 and 88 move in opposite directions toward their respective unlatched positions. The relative movement of the two latches doubles their passing rate, compared to the rate of travel of either latch relative to fixed structure, doubling the bending rate of the second leg 62.

A sixth optional feature of the embodiments of FIGS. 1-5 is that the first leg 60 can be secured to the first shell portion 42 by a pivot 84. The provision of a pivot 84 allows a user to displace the actuator portion 64 to pivot the first leg 60 relative to the first shell portion 42. Alternatively, the pivot 84 can be replaced by a fixed attachment point or a bearing point, either of which would provide another, or an alternative, biasing force to bias the latch 58 toward its latched position, assuming the first leg 60 is resilient.

An seventh optional feature of the embodiments of FIGS. 1-5 is that the container latching arrangement can further include a third latching abutment 86 and a second latch 88. The third latching abutment 86 can be provided on either one of the first and second shell portions 42 and 44. The second latch 88 can be provided for releasably latching the second portions 48 and 52 of the first shell portion 42 and second shell portion 44 together.

An eighth optional feature of the embodiments of FIGS. 1-5 is that the second latch 88 can include third and fourth legs 90 and 92, an actuator portion 94, and a fourth latching abutment 88. The third and fourth legs 90 and 92 can be joined at an angle, as illustrated here. The third leg 90 can be secured to the other of the first and second shell portions 42 and 44 relative to the third latching abutment 86. The actuator portion 94 of the third leg 90 can be positioned to be displaced generally laterally by a user's finger. Displacing the actuator portion 94 of the third leg 90 in the illustrated embodiments displaces the fourth leg 92 generally longitudinally from a latched position to a released position.

The fourth latching abutment 88 can be secured to the fourth leg 92. The fourth latching abutment 88 can be configured, as shown in the illustrated embodiments, to engage the third latching abutment 86 when the fourth leg 92 is in its latched position. The fourth latching abutment 88 can be configured, as shown in the illustrated embodiments, to release the third latching abutment 86 when the fourth leg 92 is in its released position.

A ninth optional feature of the embodiments of FIGS. 1-5 is that the actuator portions 64 and 94 of the first and third legs 60 and 90 can be spaced at least five cm apart, optionally at least six cm apart, optionally at least seven cm apart, optionally at least 8 cm apart, optionally at least 9 cm apart, optionally at least 10 cm apart.

A tenth optional feature of the embodiments of FIGS. 1-5 is that the actuator portions 64 and 94 of the first and third legs 60 and 90 optionally can be arranged so they must be actuated simultaneously to unlatch the second portions 48 and 52 of the first shell portion 42 and second shell portion 44.

The ninth and tenth optional features, or either one of them, can be employed to provide a child resistant but elder friendly package 40. Desirably for this purpose, the actuator portions 64 and 94 are far enough apart that a small child who should not have access to the contents of the package 40 will find it difficult or impossible to operate both simultaneously with one hand. Desirably, the actuator portions 64 and 94 are close enough together that an adult who should have access to the contents of the package 40, including an elderly person, will find it possible, preferably easy to operate both actuator portions 64 and 94 simultaneously with one hand to open the package.

As an eleventh optional child-resistant feature, the embodiments of FIGS. 1-5 does not have an opening spring, strut, or the like to open the package automatically when it is unlatched. When the latches 58 and 88 are disengaged, the second shell portion 44, which in this case is the lid, does not spring open automatically; the second shell portion 44 must be lifted manually to open the package. For this purpose, the first shell portion 42 has an indentation coinciding with the bending ramp 96, and the second peripheral portion 52 of the second shell portion 44 bridges the indentation.

The user can lift the section of the second peripheral portion 52 bridging the indentation of the closed package 40, when the latches 58 and 88 are released, to open the package 40 and have access to its contents. This is a child-resistant feature because, in normal operation, both actuator portions 64 and 94 are engaged with one hand and the second shell portion 44 is lifted with the other. The user's hand must be large enough to engage the two actuator portions 64 and 94 at the same time to open the package. Yet, opening the package 40 does not require complex movement, such as grasping and twisting one part relative to another, and can easily be designed by controlling the necessary biasing force so it does not require great strength to open.

A twelfth optional feature of the embodiments of FIGS. 1-5 is that the second and fourth legs 62 and 92 optionally can be positioned generally parallel while in their latched positions. "Generally parallel" means that a majority of the length of the respective legs runs side by side at approximately the same distance apart along their mutual lengths when the package is latched. As will be understood from this specification, the legs need not remain parallel when the package 40 is unlatched, as part of their respective motion is lateral.

A thirteenth optional feature of the embodiments of FIGS. 1-5 is that the second and fourth legs 62 and 92 optionally can be positioned to be displaced generally longitudinally in opposite directions from their latched positions to their released positions.

A fourteenth optional feature of the embodiments of FIGS. 1-5 is that bending ramps 80 and optionally 96 can be positioned to be engaged by one or optionally both of the second and fourth legs 62 and 92 for bending the engaged leg 62 or 92 into contact with a biasing abutment 98 or 100 when the engaged leg 62 or 92 is displaced generally longitudinally from the latched position toward the released position.

In the illustrated embodiments, both of the second and fourth legs 62 and 92 engage a bending ramp, respectively the bending ramp 80 defined by the fourth leg 92 and the bending ramp 96 defined by an indentation of the wall defining the second portion 48 of the first shell portion 42. This juxtaposition of two bending ramps increases the lateral displacement of the second leg 62 when the package 40 is unlatched, which can be explained as follows. Engaging the bending ramp 96 with the fourth leg 92 displaces the fourth leg 92, and thus the bending ramp 80, laterally inward with respect to the package, also displacing the second leg 62 laterally inward. Engaging the bending ramp 80 with the second leg 62 further displaces the second leg 62 further laterally inward. This provides a movement comparable to a compound lever. Optionally, just the second leg 62 will bear against the sidewall 112, or optionally or additionally against the wall of the aperture 116, to produce a biasing force tending to resist unlatching.

A fifteenth optional feature of the embodiments of FIGS. 1-5 is one way for biasing the actuator portion toward its latched position. A first bending ramp 80 can be provided that is positioned to be engaged by the second leg 62 for bending the second leg 62 into contact with a first biasing abutment 82 when the second leg 62 is displaced generally longitudinally from its latched position toward its released position.

In a sixteenth, optional elaboration of this mechanism, a second bending ramp 96 can be provided and positioned to be engaged by the fourth leg 92 for bending the fourth leg 92 into contact with a second biasing abutment 100 when the fourth leg 92 is displaced generally longitudinally from its latched position toward its released position.

A seventeenth optional feature of the embodiments of FIGS. 1-5 is that the first leg 60 can be secured to the first shell portion 42 by a first pivot 84, and the third leg 90 also can be secured to the first shell portion 42 by a second pivot 102.

Referring to FIGS. 6 to 9, a package 420 in an open position is shown having a first shell portion 422, a second shell portion 424, a hinge 426, and at least one latch 428. The first shell portion 422 includes a base peripheral edge 430, a base sidewall 432, and an inner region 434. The second shell portion 424 includes a lid peripheral edge 436, a lid sidewall 438, an interior region 440, and at least one catch 442. According to an embodiment, the first shell portion 422, second shell portion 424, and hinge 426 may be integrally molded or non-integral. The latch 428 includes an actuator portion 444, a lever 446, and a latch engagement portion 448. According to certain embodiments, the actuator portion 444 may be a button. The lever 446 includes a first lever leg 450 and a second lever leg 452. According, to an embodiment, the first lever leg 450 and the second lever leg 452 are joined at an angle. The second lever leg 452 may be pivotally secured to a first pivot point 454, such as, for example a pin that extends from the first shell portion 422. According to another embodiment, the first shell portion 422 may include a base plate 456 that is secured or integrally molded to the first shell portion 422, with the first pivot point 454 extending from the base plate 456. According to another embodiment, the pivot point 454 may extend from an insert or tray similar to the insert 78 previously discussed that is secured to the first shell portion 422.

Figure 6:
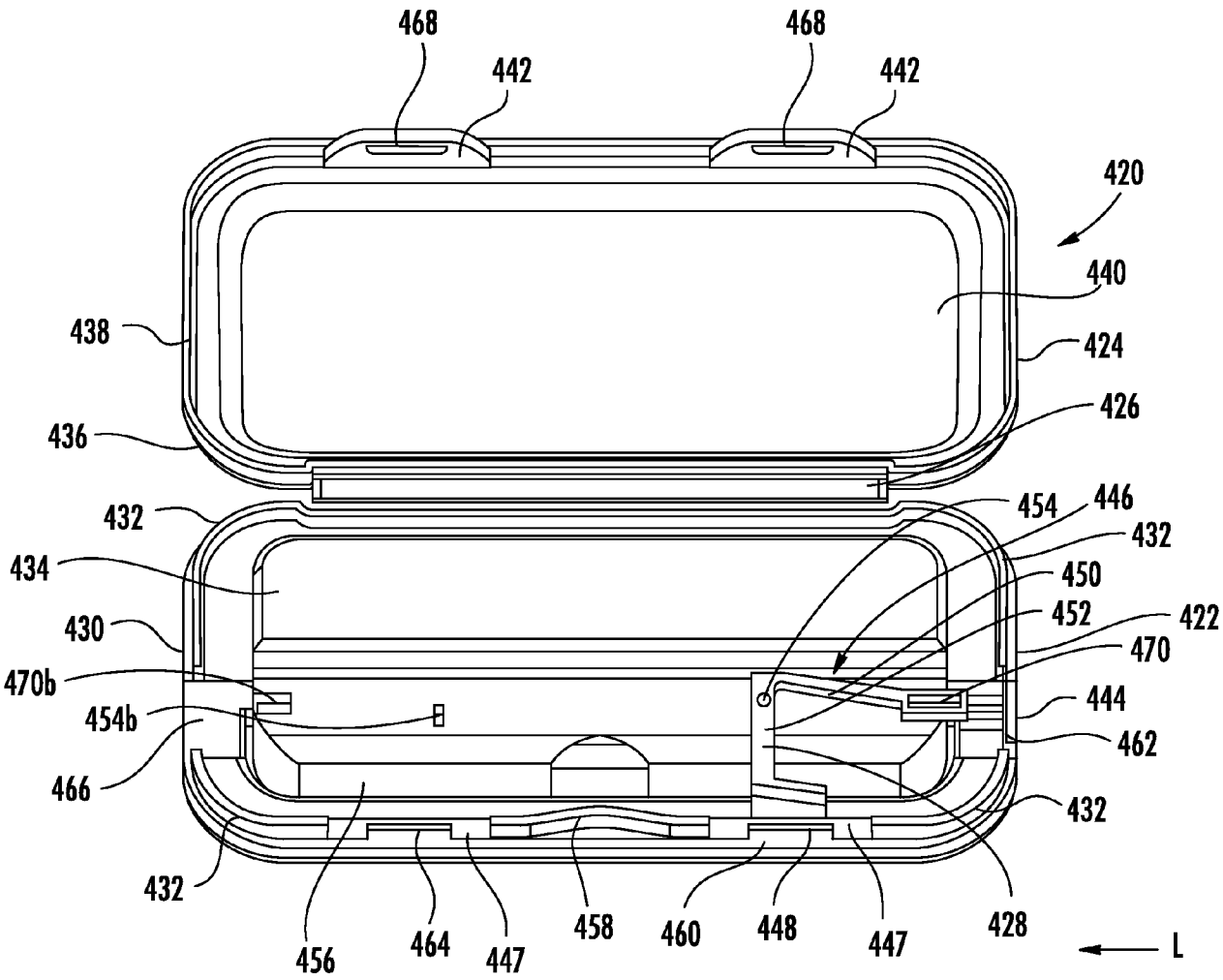
FIG. 6 is perspective view of an embodiment of the package assembly shown in an open position, without an insert, and with a pivotable latch in a rest or locked position.
Figure 7:
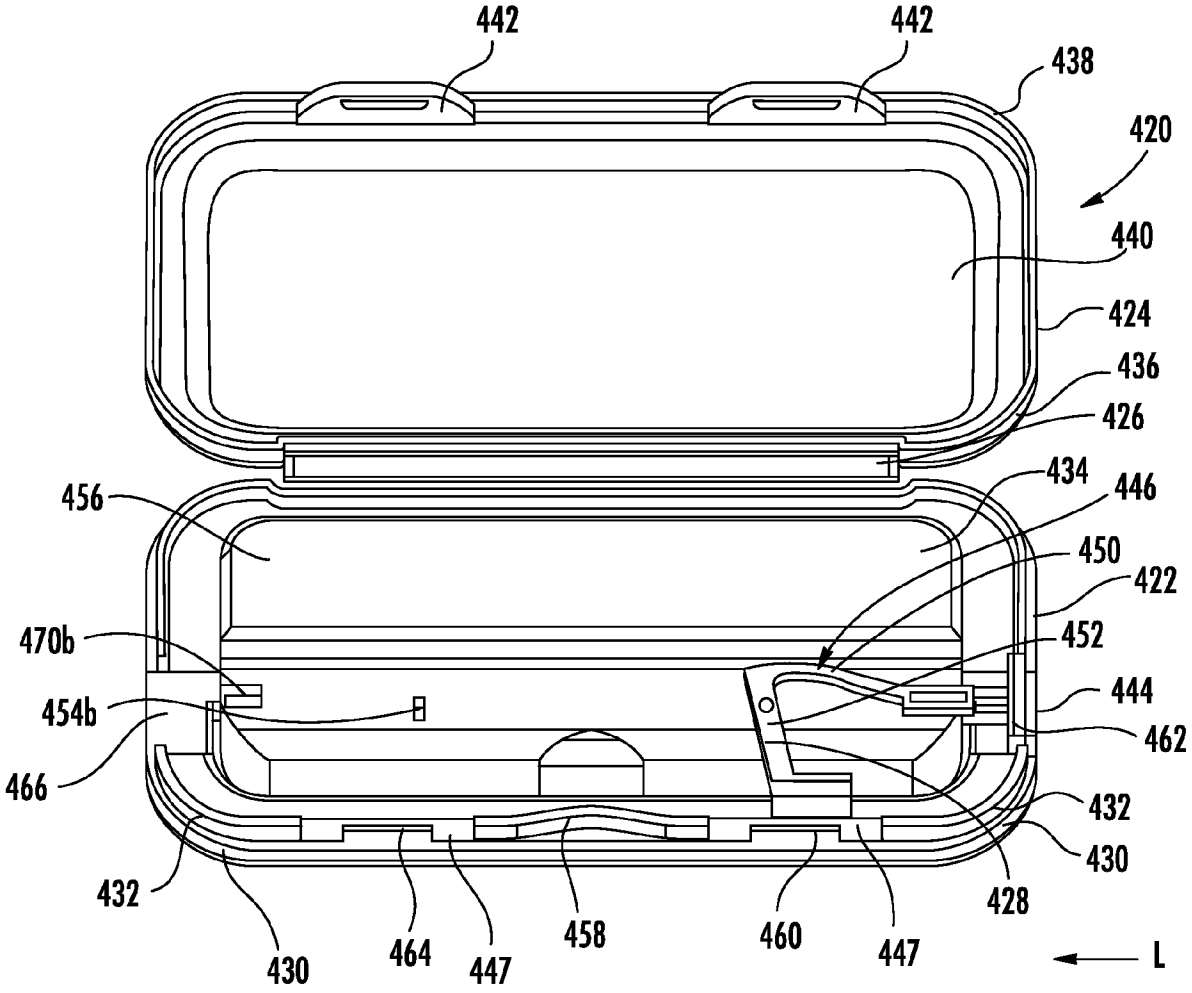
FIG. 7 is a view similar to the embodiment of FIG. 6, but shows the pivotable latch in an open position.
Figure 8:
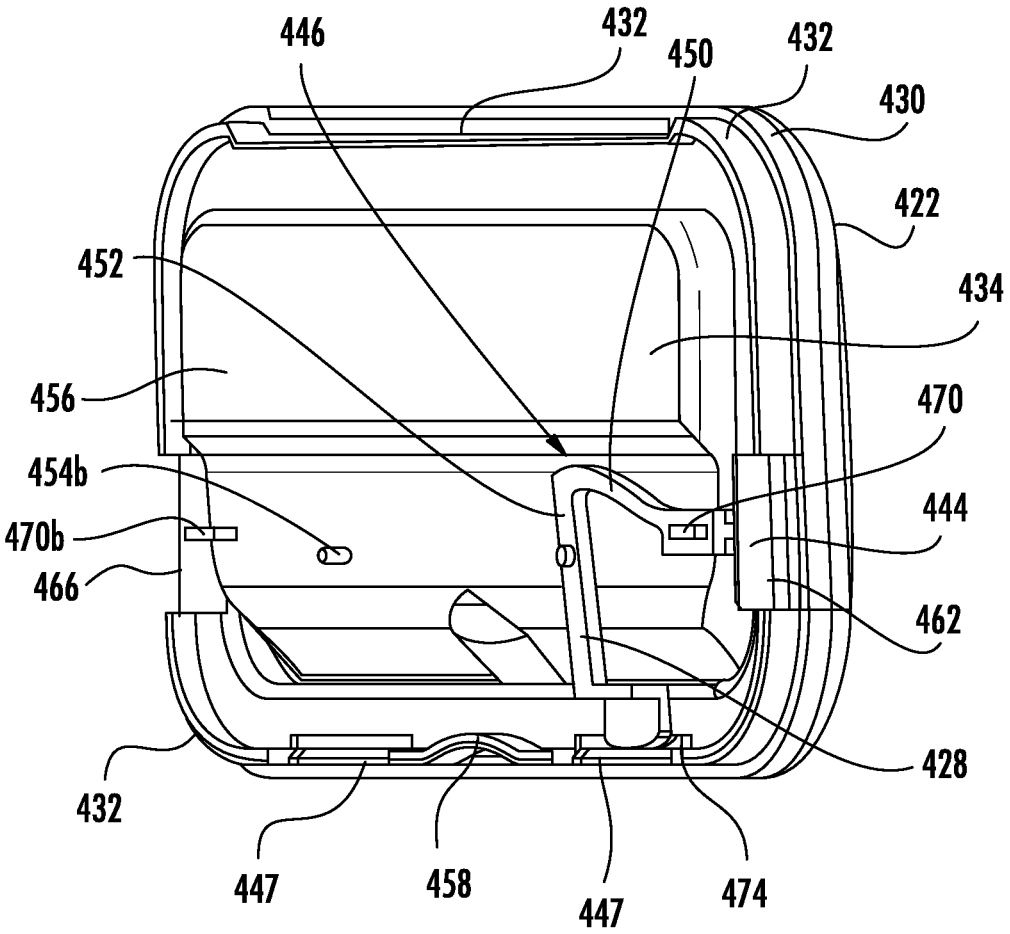
FIG. 8 is a perspective view of an embodiment of the package assembly (shown without the second shell portion) with the pivotable latch in a rest position.

The inner region 434 of the first shell portion 422 may be configured to provide at least a portion of one or more product containing spaces for the placement of product, as discussed above. As discussed, the first shell portion 422 may include an insert, having a similar configuration to insert 78 discussed above with respect to FIG. 1, which may be configured to provide at least a portion of a product containing space. According to such an embodiment, the insert 490 may be operably attached to the first shell portion 422, such as, for example, the insert being adhered to the first shell portion 422, wet welded, through the use of a snap or friction fit, and/or attached by a mechanical fastener, including, for example, a clip or pin, among others. In the embodiment of FIGS. 6-8, the insert 490 sits below the lever 446, a pin protrudes upward from the insert creating pivot point 454. In another embodiment, the insert 490 sits above and covers the lever 446. For example, the first shell portion 422 may include at least one upward projection, rib, or slot that is configured to receive at least one downwardly extending projection or tab from the insert for attaching the insert to, or aligning the insert for attachment to, the first shell portion 422.

The base sidewall 432 may upwardly extend from, or alternatively, be offset from, the base peripheral edge 430. For example, as illustrated in FIGS. 6 to 8, the base sidewall 432 is inwardly offset from the base peripheral edge 430. According to an embodiment, the base sidewall 432 may be offset from the base peripheral edge 430 by a distance that is approximately equal to the thickness of the lid sidewall 438. When the package 420 is closed and the first and second shell portions 422, 424 are properly aligned, such an offset may allow for at least a portion of an outer surface of the lid sidewall 438 to be generally aligned with the adjacent portion of the base peripheral edge 430, while at least a portion of an outer surface of the base sidewall 432 may be adjacent to, or abut, a portion of an inner surface of the lid sidewall 438. Such an offset may also allow for at least one latch 428 to engage at least one catch 442 of the second shell portion 424 so as to lock the package 420 in a closed position, as discussed below in more detail.

According to an embodiment, the base and lid sidewalls 432, 438 may be comprised of wall segments having similar or different configurations or contours. For example, the base sidewall 432 may include a contoured or recessed wall segment 458 that, when the package 420 is in a closed position, provides a space that may allow a user to generally upwardly press on a portion of a bottom surface of the second shell portion 424 so as to move the package 420 from a closed position to an open position when the latch 428 is in an unlocked position.

Figure 10:
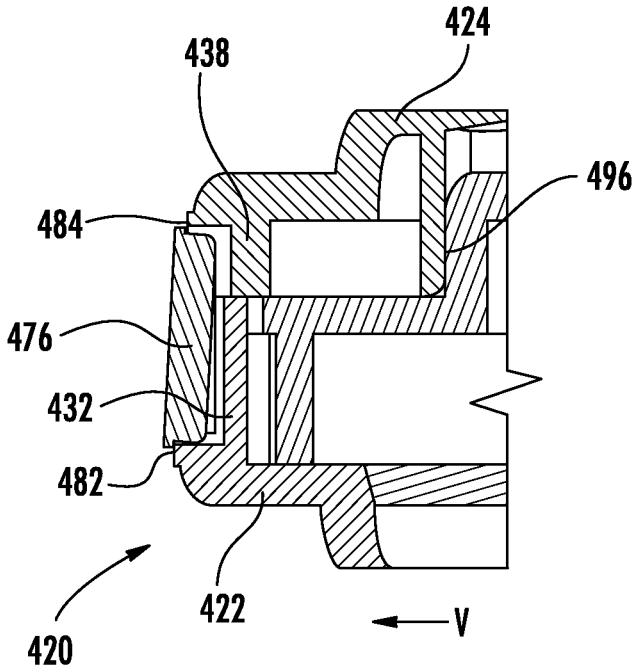
FIG. 10 is a side cross sectional view of portion of an embodiment of a package assembly having a double hinge.
Figure 11:
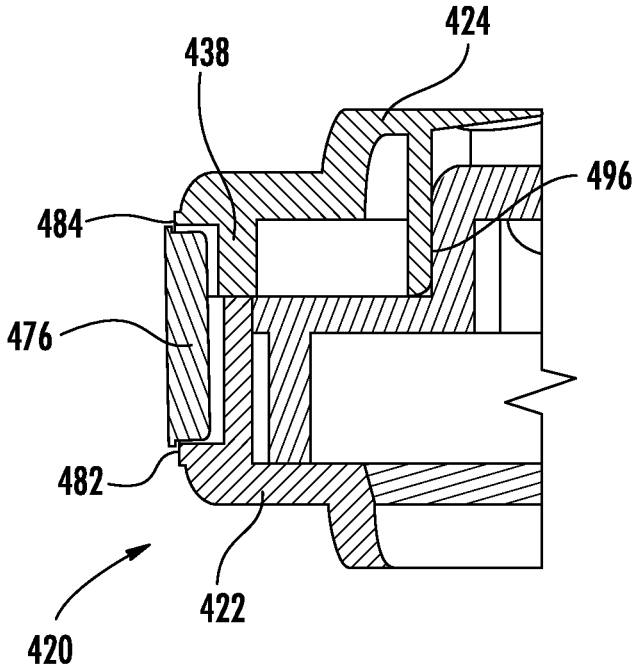
FIG. 11 is a cross sectional view of a portion of a package assembly having a double hinge.

The wall segments of the base sidewall 432, lid sidewall 438, and/or the peripheral edges 430, 436 may be contoured to provide a space for the placement of at least a portion of the hinge 426 within, or generally aligned with, the peripheral edges 430, 436 of the first and second shell portions 422, 424 when the package 420 is in a closed position, as further shown for example in FIGS. 10 and 11 (with the hinge 426 being shown as a double hinge 476). Additionally, the base sidewall 432 may include at least one wall segment having a first aperture 460 configured for the placement of a latch engagement portion 448. Further, the base sidewall 432 may be configured to provide a first opening 462 for the slideable placement of at least a portion of the actuator portion 444 of the latch 428. According to certain embodiments, the base peripheral edge 430 may also provide an opening for the moveable placement of at least a portion of the actuator portion 444.

Additionally, although the actuator portion 444 and the first and second openings 462, 466 are illustrated in FIGS. 6 to 8 as being on the sides of the package 420, the openings 462, 466, latch 428, and catches 442 can be moved to other areas of the package 420, such as for example, having the actuator portion 444 about a front portion of the first shell portion 422 with the corresponding catch 442 extending from a side portion of the second shell portion 424. Additionally, according to certain embodiments, the latches 428 may be placed within the second shell portion 424, and configured to engage a catch that is attached to, extends from, or located on the first shell portion 422.

According to an embodiment, the catch 442 may be part of, extend from, or be adjacent to the lid sidewall 440. Additionally, the catch 442 includes a catch aperture 468 that is configured to engage with a portion of the latch engagement portion 448 when the package 420 is closed and the latch 428 is in a locked or rest position.

When the package 420 is closed and the latch 428 is in a locked or rest position, the latch engagement portion 448 may protrude through the first aperture 460 in a wall segment 447 of the base sidewall 432 and into a catch aperture 468, thereby locking the package 420 in the closed position. The latch 428 may be moved from a rest or locked position (as shown in FIG. 6) to an unlocked position (as shown in FIGS. 7 and 8) by the displacement of the actuator portion 444 in a generally inwardly lateral direction, as indicated by "L" in FIG. 7. Moreover, a user may inwardly displace the actuator portion 444 by pressing on the actuator portion 444 with the user's thumb or finger.

Figure 9:
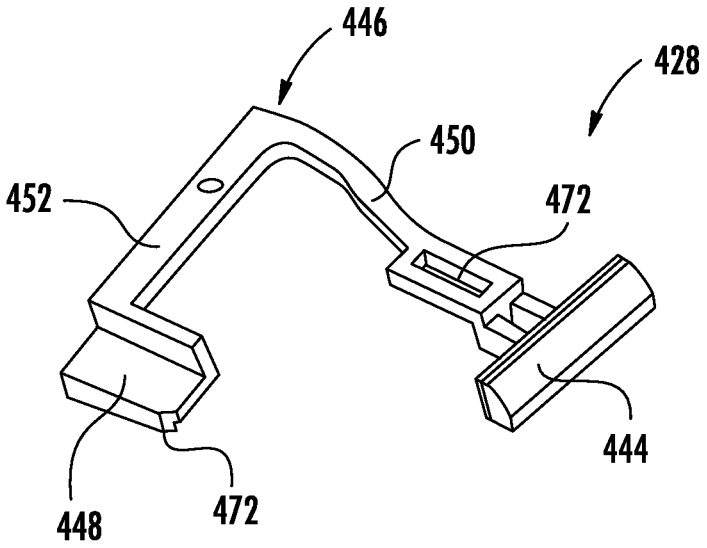
FIG. 9 is a perspective view of the pivotable latch shown in the embodiments in FIGS. 6 to 8.

As shown in FIGS. 7 to 9, an actuator guide 470 in the first shell portion 422 or base plate 456 engages a slot 472 in the lever 446 to assist in guiding the generally lateral displacement of the actuator portion 444.

While FIGS. 6 to 8 illustrate only one latch 428, multiple latches 428 may be utilized. For example, for purposes of illustration, the first shell portion 422 illustrated in FIGS. 6 to 8 is configured to accommodate two latches 428, as evidenced at least in part by the inclusion in the base plate 456 and/or first shell portion 422 of a second pivot, point 454*b*, second actuator guide 470*b*, second aperture 464, and second opening 466. However, in use, the first shell portion 422 may be configured to match the number of latches 428 that are being used by the package 420.

As the actuator portion 444 is inwardly laterally displaced, the second lever leg 452 rotates about the first pivot point 454. As the second lever leg 452 rotates about the first pivot point 454, the latch engagement portion 448 is rotated away from, and out of, the catch aperture 468, thereby unlocking the package 420. According to an embodiment, the latch engagement portion 448 may also include a latch protrusion 472 that fits inside a groove 474 in the first shell portion 422 or base plate 456. The engagement of the latch protrusion 472 and groove 477 may assist in maintaining the lever 446 in a proper position and/or limit the distance that the latch engagement portion 448 and second lever leg 452 may be rotated.

The first lever leg 450 may be configured and/or oriented to act as a spring that biases the latch 428 in a rest or locked position. Accordingly, the first lever leg 450 may at least assist in returning the latch 428 to a rest position after the inwardly directed lateral force has been removed from the actuator portion 444. For example, as shown in FIG. 6, when in a rest or locked position, the first lever leg 450 may have a generally straight configuration that is angled away from lateral direction "L". However, as the actuator portion 444 is inwardly displaced in the lateral direction and the second lever leg 452 is pivoted, the first lever leg 450 may be deflected, bent, and/or deformed, as shown in FIGS. 7 and 8. Additionally, according to an embodiment, while the degree to which the second lever leg 452 may be rotated may be limited, such as, for example, through the engagement between the latch protrusion 472 and groove 474, or a post or other obstruction that limits the rotational movement of the second lever leg 452 or latch engagement portion 448, the first lever leg 450 may continue to be deflected, bent, and/or deformed as the actuator portion 444 continues to be laterally displaced. However, according to an embodiment, the configuration of the first lever leg 450 and placement of the first pivot point 454 in the second lever leg 452 may result in the first lever leg 450 being deformed, deflected, and/or bent without the need for protrusions or other obstructions that limit the rotational movement of the second lever leg 452.

When the inwardly lateral force is removed from the actuator portion 444, the first lever leg 450 may begin to generally return to its original, at rest or locked shape and/or position. As the first lever leg 450 begins to return to shape, the latch 428 may be biased back to its rest or locked position, during which time the engagement of the slot 472 of the lever 428 with the actuator guide 470 may assist in guiding the outwardly lateral movement of the actuator portion 444 back to the general position the actuator portion 444 held before the assertion of the inwardly lateral force. As the first lever leg 450 returns to its rest shape or position, the second lever leg 452 may also pivot the latch engagement portion 448 back into the first aperture 460.

As the latch 428 may be in a rest or locked position in the absence of lateral force inwardly displacing the actuator portion 444, in some circumstances a user may attempt to close the package with the latch engagement portion 448 extending through the first aperture 460. Therefore, so that the latch engagement portion 448 does not create an interference that prevents the closing of the package 420, the catch 442 may have a wall thickness that allows the catch 442 to deform or be deflected around the latch engagement portion 448 until the catch aperture 468 and latch engagement portion 448 are generally aligned, whereupon the latch engagement portion 448 may lockingly engage the catch aperture 468. The catch 442 and/or latch engagement portion 448 may also include chamfers or other geometrical surface characteristics that assist with the catch 442 sliding over the latch engagement portion 448 until the latch engagement portion 448 is able to enter the catch aperture 468 and lock the package 420 in a closed position. Additionally, the latch 428 and/or catch 442 may be configured so that the closing of the second shell portion 424 relative to the first shell portion 422 forces the latch engagement portion 448 to be displaced until the catch aperture 468 is in position to engage the latch engagement portion 448 so as to the lock the package 420 in a closed position.

The hinge 426 may assist in controlling the movement of the unlocked second shell portion 424 relative to the first shell portion 422. For example, referencing FIG. 7, the hinge 426 may assist in limiting movement of the second shell portion 424 relative to the first shell portion 422 in at least the lateral ("L"), direction, particularly when the second shell portion 424 is being moved to open the package 420 so that the inner region 434 is accessible to a user and/or to close the package 420. The hinge 426 may be oriented so that, when the second shell portion 424 is being moved to an open position, the second shell portion 424 may be pivoted away from the first shell portion 422 so as to provide access to one or more product containing spaces of the first shell portion 422 or of an insert 78. For example, according to an embodiment of the invention, relative to the first shell portion 422, the second shell portion 424 may be moved from a closed position to an open position where the second shell portion 424 is generally in the same plane as the first shell portion 422. However, the hinge 426 may be configured to allow the second shell portion 424 to be pivoted from the first shell portion 422 by any number of degrees. Further, a variety of hinges 426 may be used, including integral and non-integral hinges, such as, for example, a double-fold, flat-top, butterfly, or pinned hinge, among others.

FIGS. 10 and 11 illustrate side cross sectional views of a double hinge 476 that is suitable for a number of embodiments of the packages described herein. According to such an embodiment, the hinge 476 may be configured to allow for displacement of the second shell portion 424 relative to the first shell portion 422 in the "V" direction (as indicated in FIG. 10). For example, the hinge 426 referenced in FIGS. 6 to 8 may be a double hinge 476 that has a first pivot 482 connecting, the first shell portion 422 and the double hinge 476, and a second pivot 484 joining the hinge 476 and the second shell portion 424. As shown in FIG. 10, a double hinge 476 may allow for a degree of misalignment between the first and second shell portions 422, 424 while still allowing for the formation of the seal within the package 420. More specifically, as shown in FIG. 10, the double hinge 476 may allow the base sidewall 432 and lid sidewall 438 to be at least partially misaligned while permitting a seal 496 to form about at least a product containing space in the package 420.

Referring again to FIGS. 6 to 9, a lip seal arrangement can also be provided to isolate at least the product containing space of the package 420 from the exterior environment when the package 420 is closed, as discussed with respect to FIGS. 1 to 5. For example, the package 420 can include a first closed lip extending from the first shell portion 422 or the insert and a mating second closed lip extending from the second shell portion 424. The first closed lip may define a closed loop enclosure about the product containing space. The second closed lip can be positioned to engage the first closed lip and seal the area enclosed therein from ambient air outside of the seal. Additionally, an elastomeric or non-elastomeric material may be employed to assist in creating one or more seals that seal at least the product containing space from ambient air that is outside of the seal, as discussed in more detail below.

Figure 12:
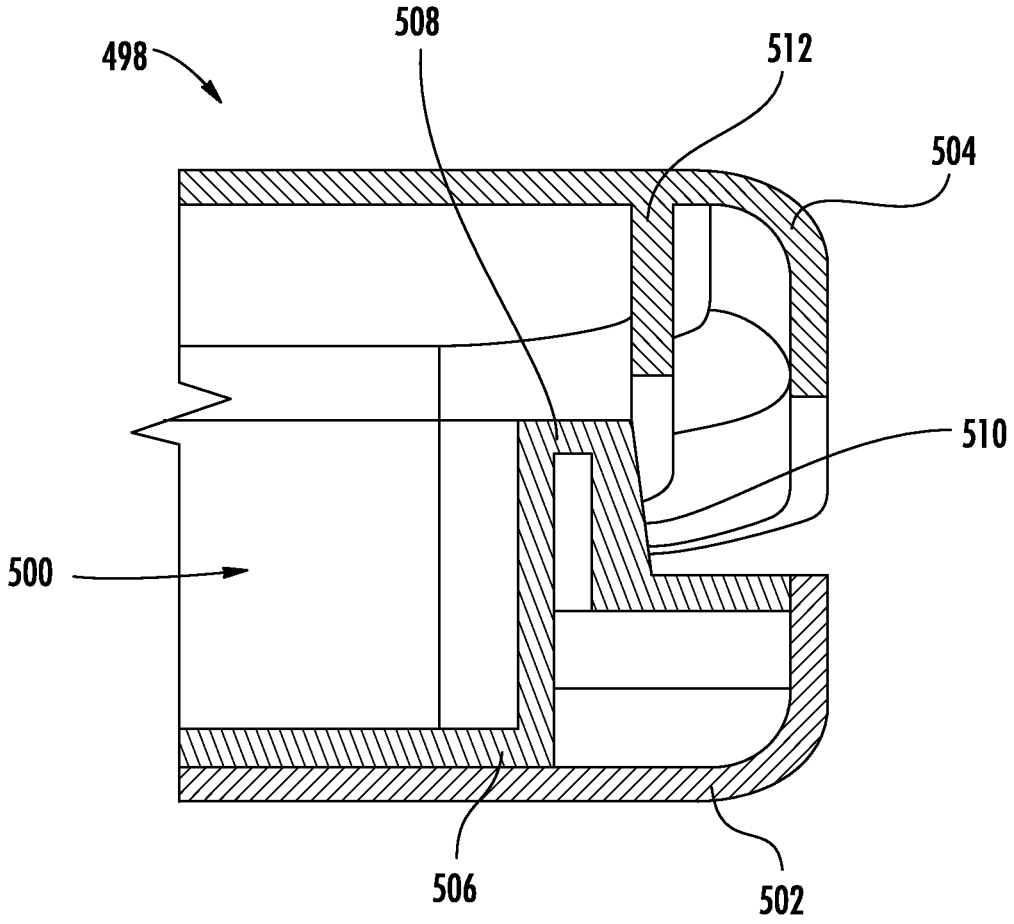
FIG. 12 is a cross sectional view of a portion of an embodiment of a package assembly in an open position, the package assembly having a flexible second closed lip and a first closed lip with an angled outer wall.
Figure 13:
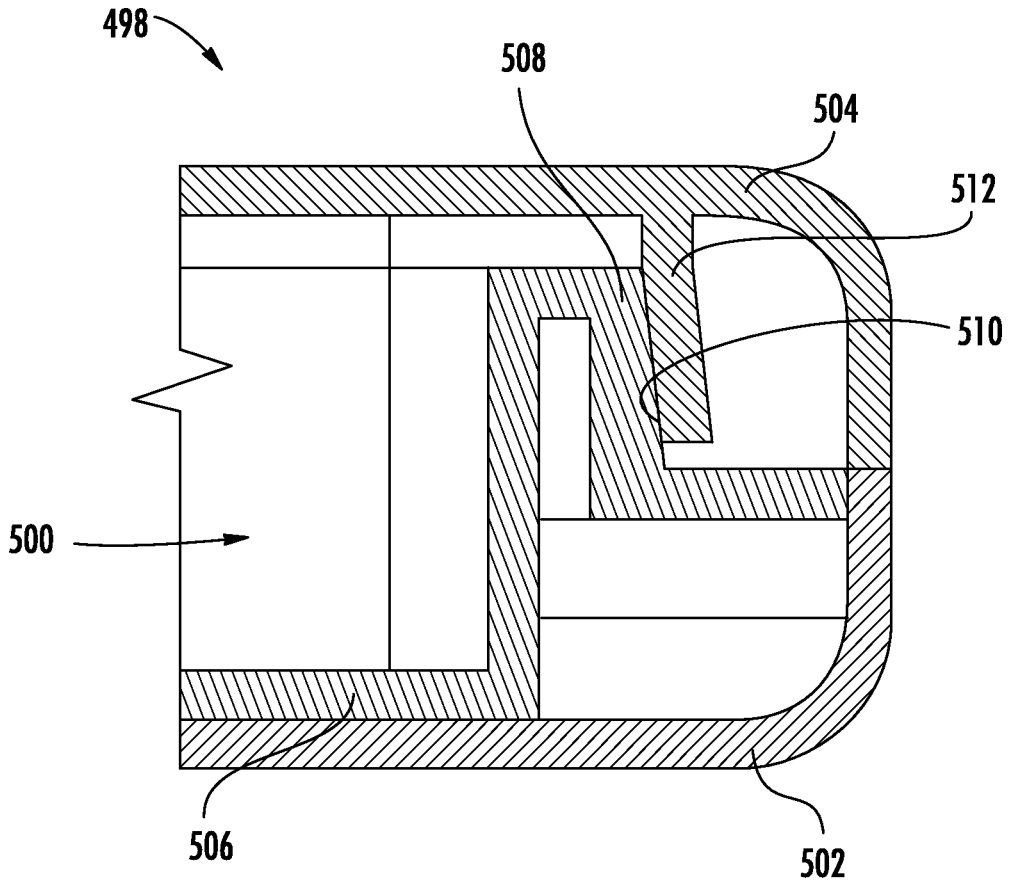
FIG. 13 is a cross sectional view of a section of the package shown in FIG. with the package assembly in a closed position.

FIGS. 12 and 13 are cross sectional views of a portion package 498 having a seal that is suitable for use with embodiments of the packages described herein. The package 498 illustrated in FIGS. 12 and 13 includes a first shell portion 502 and a second shell portion 504. According to an embodiment, the first shell portion 502 includes an insert 506, the insert 506 having a product containing space 550 and a first closed lip 508, the first closed lip 508 including an angled outer wall 510. Alternatively, rather than extending from the insert 506, the first closed lip 510 may extend from the first shell portion 502. The second shell portion 504 has a second closed lip 512, at least a portion of the second closed lip 512 being configured to engage at least a portion of the angled outer wall 510 of the first closed lip 508 when the package 498 is in a closed position.

As shown in FIG. 12, the second closed lip 512 may have a generally straight configuration when the package 498 is in an open position and the second closed lip 498 is not in contact with the first closed lip 508. The second closed lip 512 has a generally thin wall thickness, which, when second closed lip 512 engages the angled outer wall 510 as the package 498, allows the second closed lip 512 to be deformed, bent, or distorted so that at least a portion of the second closed lip 512 generally mates with or conforms to the angled orientation of the angled outer wall 510. The engagement between the second closed lip 512 and angled outer wall 510 forms a seal that seals the area enclosed therein from ambient air that is outside of the seal.

For example, according to an embodiment, the second closed lip 512 may have a thickness of approximately 0.4-0.8 cm, preferably approximately 0.4 to 0.6 cm, and more preferably approximately 0.6 cm. Additionally, the angled outer wall 510 of the first closed lip 508 may be angled at a variety of different angles suitable for distorting the second closed lip 512 so as to create the seal between the first and second closed lips 508, 512. However, if the angle of the angled outer wall 510 is too low, too much of the second closed lip 512 may be in contact with the first closed lip 508, which may increase the friction between the first and second closed lips 508, 512, and thereby result in difficulty in opening and/or closing the package 498. Yet, if the angle of the angled outer wall 510 is too steep, then too little of the second closed lip 512 may be in contact with the first closed lip 508, which may cause the seal to be more sensitive to improper alignment. According to certain embodiments, the angle of the angled outer wall 510 of the first closed lip 508 may be between approximately 3 to 10 degrees, and preferably between approximately 5 to 8 degrees. For example, according to one embodiment, the angled outer wall 510 may have an angle of approximately 6.5 degrees.

Referencing FIGS. 14 to 28, at least one ancillary seal 522 and/or at least one second closed lip 526 may be used in forming a seal inside the package 514 when the package is closed. The ancillary seal 522 or second closed lip 526 may be used to create side and/or face seals, among others, and may be constructed from resilient materials, such as, for example, an elastomeric or non-elastomeric material. For example, a sealing engagement may be formed by pressing a first closed lip from a first shell portion 516 or insert 520, or a second shell portion 518 into or against the ancillary seal 522, causing the ancillary seal 522 to deform about a least a portion of the adjacent first closed lip or second closed lip 526 so as to form a seal. Similarly, a seal may also be formed by the second closed lip 526 being distorted, bent, or deformed by a pressing engagement with a surface of the first shell portion 516 or insert 520, such as a first closed lip, among others. The ancillary seal 522 may affixed to, or integrally or non integrally molded to, the first shell portion 516, insert 520, or to the second shell portion 518. For purposes of illustration, the embodiments below are shown using a second closed lip 526 in connection with forming the seal. However, according to certain embodiments, a first closed lip extending, from the first shell portion 516 or insert 520 may also be used to create the seal in a similar manner as discussed below with respect to the second closed lip 526.

Although referred to as a "second" seal 522, according to certain embodiments, the ancillary seal 522 may be used to create the primary, and possibly the only, seal within the closed package 514, or in combination with other seals, including the lip seal discussed with respect to FIGS. 1 to 5, among others. Exemplary configurations of sealing arrangements showing ancillary seals 522 and the use of the second closed lip 526, are shown in cross sectional FIGS. 14-28, which are discussed in the below.

Figure 14:
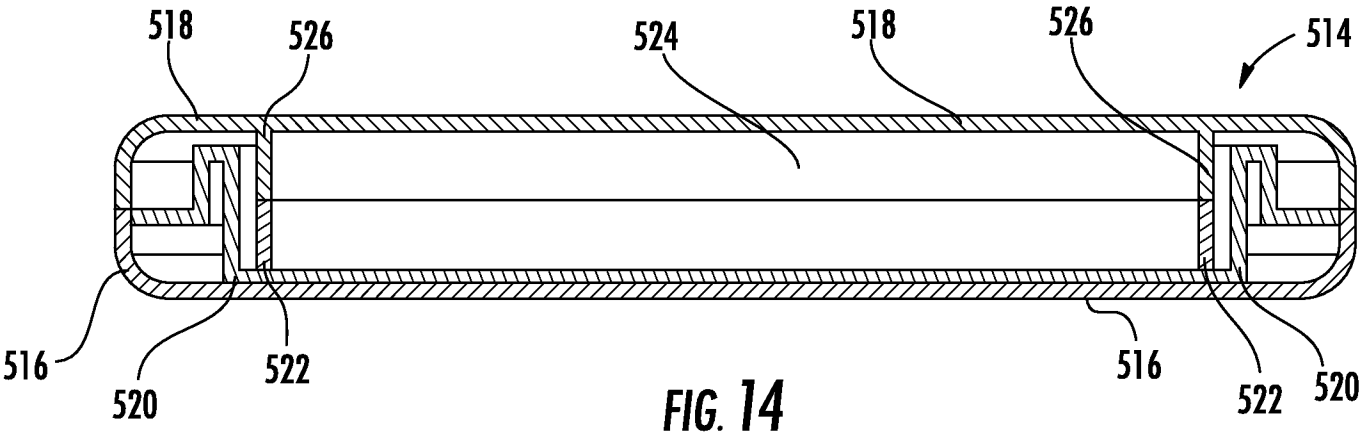
FIG. 14 is a cross sectional view of an embodiment of a package assembly in a closed position having an ancillary seal that is configured to assist in creating either a face seal or a side seal within the package.

FIG. 14 illustrates a package 514 having a first shell portion 516, a second shell portion 518, an insert 520, and an ancillary seal 522. The ancillary seal 522 in FIG. 14 is used to create a face seal and may be made from a variety of materials, including a thermoplastic elastomeric material, among others. According to an embodiment, the ancillary seal 522 is affixed or molded to an inner region 524 of an insert 520. The insert 520 may be affixed to, or alternatively, part of a first shell portion 516. The second shell portion 518 includes a second closed lip 526 that abuts the ancillary seal 522 when the package 514 is in a closed position to form a seal between the second closed lip 526 and the ancillary seal 522. Moreover, the second closed lip 526 may have a length that causes the second closed lip 526 to depress the abutting resilient surface of the ancillary seal 522 to form the seal. According to another embodiment, the ancillary seal 522 may be affixed or molded to the second shell portion 518, and the first shell portion 516 may include a first closed lip that engages and depresses the ancillary seal 522 when the package 514 is in a closed position.

According to another embodiment, the ancillary seal 522 shown in FIG. 14 is affixed or molded to the second closed lip 526. According to such an embodiment, the seal is created when the package 514 is closed by the ancillary seal 522 being pressed against the insert 520 or first shell portion 516.

Figure 15:
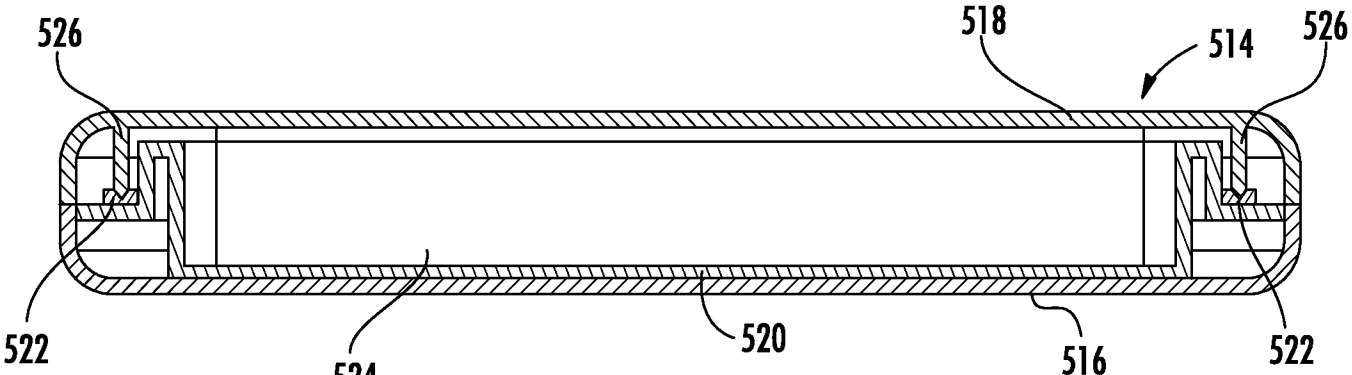
FIG. 15 is a cross sectional view of an embodiment of a package assembly in a closed position having an ancillary seal that is configured to assist in creating a face seal within the package.

FIG. 15 illustrates a face seal where the ancillary seal 522 is outside of an inner area 524 of the insert 520. According to such an embodiment, the ancillary seal 522 may be attached or molded to the insert 520 or the first shell portion 516 and may be made from a variety of different materials, including polypropylene, among others. Additionally, as shown, the second closed lip 526 of the second shell portion 518 terminates in a "V" shape that is depressed into the ancillary seal 522 when the package 514 is in a closed position. According to an embodiment, the ancillary seal 522 may also have a mating "V" shape indentation that is configured to mate with the "V" shaped protrusion of the second closed lip 526. Additionally, as with FIG. 14, according, to another embodiment, the ancillary seal 522 may be attached or molded to the second shell portion 518, with the first shell portion 516 or insert 522 having a first closed lip with an inverted "V" shape that is pressed into the ancillary seal 522 when the package 614 is in a closed position.

According to another embodiment, the ancillary seal 522 shown in FIG. 15 is affixed or molded to the bottom of the second closed lip 526. According to such an embodiment, the seal is created when the package 514 is closed by the ancillary seal 522 being pressed against the insert 520 or first shell portion 516.

Figure 16:
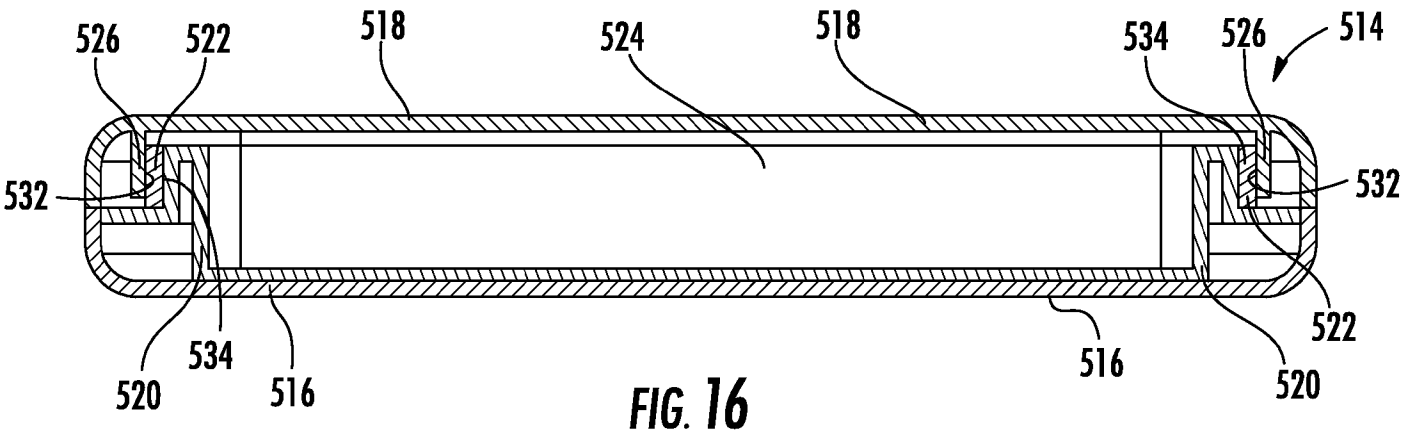
FIG. 16 is a cross sectional view of an embodiment of a package assembly in a closed position having an ancillary seal that is configured to assist in creating a side seal within the package.

FIG. 16 illustrates the use of the ancillary seal 522 to create a side seal. As shown, when the package 514 is in a closed position, the ancillary seal 522 is pressed between an inner surface 532 of the second closed lip 526 and an outer wall surface 534 of the insert 520, such as a first closed lip. According to an embodiment, the ancillary seal 522 may be attached or molded to either the second closed lip 526 or the insert 520, and may be made from a variety of materials, including thermoplastic elastomeric materials, among, others. As shown, according to such an embodiment, the second closed lip 522 does not necessarily touch the insert or the first shell portion 516. However, according to another embodiment, a face seal may also be formed at the bottom of the second closed lip 526, such as, for example, by extending the ancillary seal 522 shown in FIG. 16, the inclusion at least one other ancillary seal 522, or by the interaction between the bottom of the second closed lip 526 and the insert 520 and/or first shell portion 516. According to another embodiment, the ancillary seal 522 may be between a wall of the first shell portion 516, such as the first closed lip (not shown), and the second closed lip 526 of the second shell portion 518.

Figure 17:
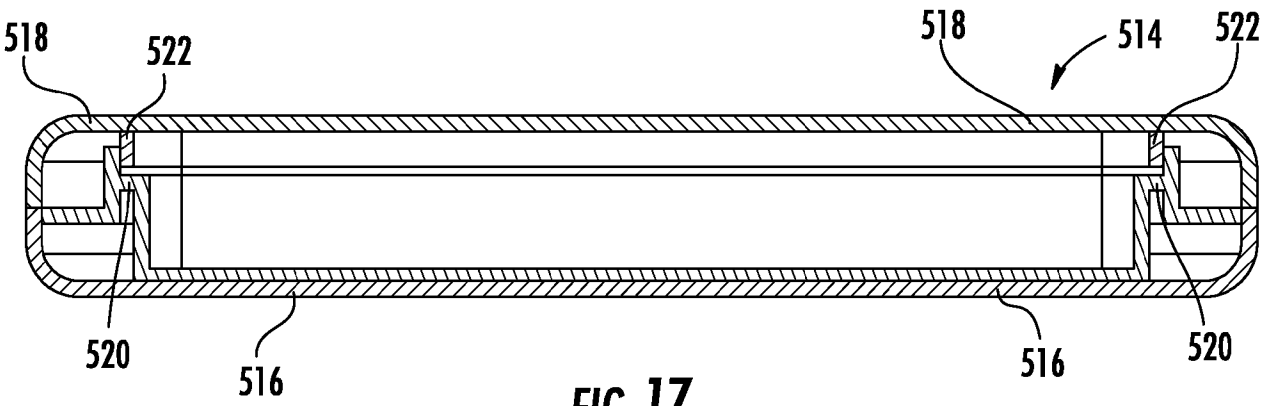
FIG. 17 is a cross sectional view of an embodiment of a package assembly having an ancillary seal that is configured to assist in creating either a face seal or a side seal within the package.

FIG. 17 illustrates an ancillary seal 522 that is attached or molded to the second shell portion 518 to form a side seal. The ancillary seal 522 shown in FIG. 17 may be made for a variety of different materials, including thermoplastic elastomeric materials, among others. More specifically, as shown when the package 514 is in a closed position, the ancillary seal 522 is pressed by an inner wall surface 530 of the insert 520, such as a first closed lip, to form a seal. According to another embodiment, the first shell portion 516 may include a wall, such as the first closed lip (not shown) that may interact with a ancillary seal 522 that is attached or molded to the second shell portion 518 to form a face seal. Alternatively, the ancillary seal 522 in FIG. 17 may be extended or positioned to interact with an upper surface of the insert 520 or of a wall of the first shell portion 516 to form a face seal in addition to, or in lieu of, the face seal.

According to another embodiment, the ancillary seal 522 shown in FIG. 17 is affixed or molded to the insert. 520 or first shell portion 516. According to such an embodiment, a seal is created when the package is closed by the ancillary seal 522 being pressed against the insert 520 or first shell portion 516. According to such an embodiment, when the package is closed, the ancillary seal 522 engages the first shell portion 518 to form a face seal inside the package.

Figure 18:
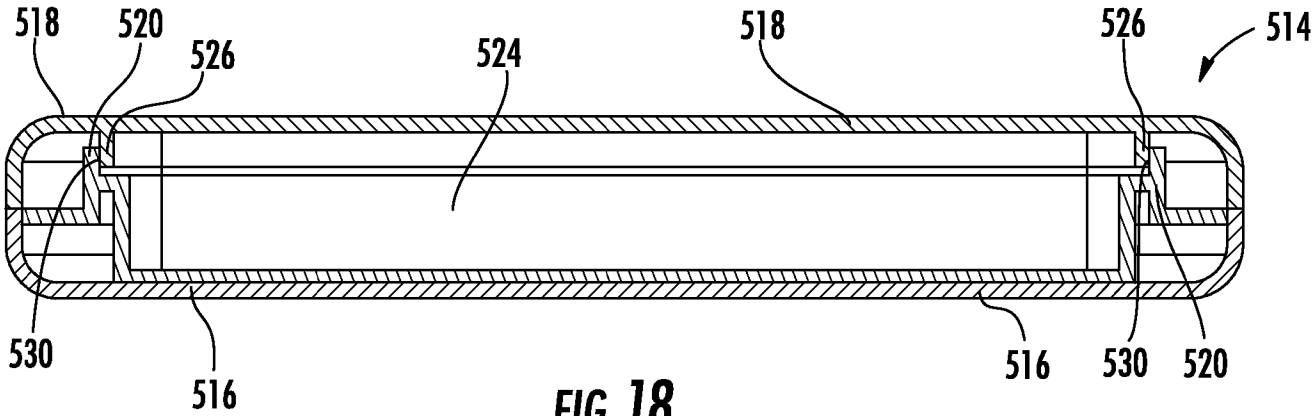
FIG. 18 is a cross sectional view of an embodiment of a package assembly having a second closed lip that is configured to assist in creating a seal within the package.

FIG. 18 is similar to FIG. 17, except the ancillary seal 522 is replaced with a second closed lip 526 that is molded in the second shell portion 518. According to such an embodiment, at least the second shell portion 518 may be molded from a polypropylene that allows the second closed lip 526 to be deformed. Moreover, similar to the second closed lip 512 in FIGS. 12 and 13, the second closed lip 526 in FIG. 18 is relatively thin so as to allow the second closed lip 526 to be deflected, bent, or deformed by engagement with an inner wall surface 530 of the insert 520 or first shell portion 516, such as a first closed lip, to form a seal. In the embodiment, illustrated in FIG. 18, when the package 514 is in a closed position, the second closed lip 526 is deformed, bent, or distorted inwardly. According to other embodiments, the insert 520 and/or first shell portion 516 may include walls, such as the first closed lip of the first shell portion 516 that may be deflected, bent, or deformed by engagement with the second shell portion 518 to form a seal.

Figure 19:
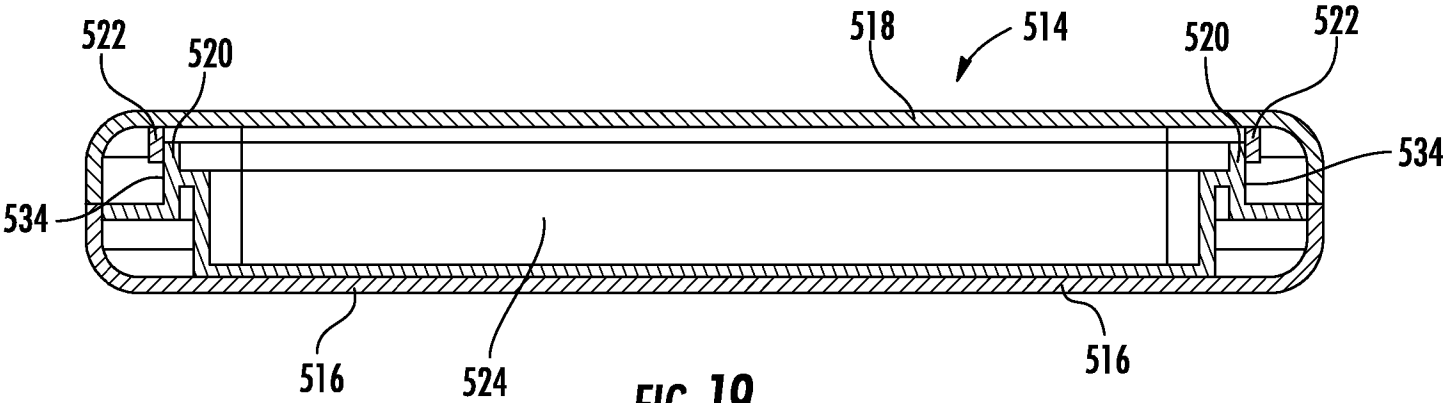
FIG. 19 is as cross sectional view of an embodiment of a package assembly having an ancillary seal that is configured to assist in creating either a face seal or a side seal within the package.

FIG. 19 illustrates a package 514 having an ancillary seal 522 that is used to form a side seal. According to such an embodiment, the ancillary seal 522 is attached or molded to the second shell portion 518, and engages a portion of an outer wall surface 534 of the insert 520 or first shell portion 516, such as a first closed lip. Such an engagement outwardly presses on the ancillary seal 522, thereby forcing the ancillary seal 522 to deform, distort, or bend to conform to the pressing outer wall surface 534, and thereby form a seal. According to such an embodiment, the ancillary seal 522 is affixed or molded to the second shell portion 518 and may made from a variety of materials, including thermoplastic elastomers, among others.

However, according to another embodiment, the ancillary seal 522 shown in FIG. 19 may be affixed or molded to the outer wall surface 534 of the insert 520 or the first shell portion 516, such as for example along the outer surface of the previously discussed first closed lip (not shown). According to such an embodiment, when the package 514 is closed, the ancillary seal 522 engages the second shell portion 518 to form a face seal.

Figure 20:
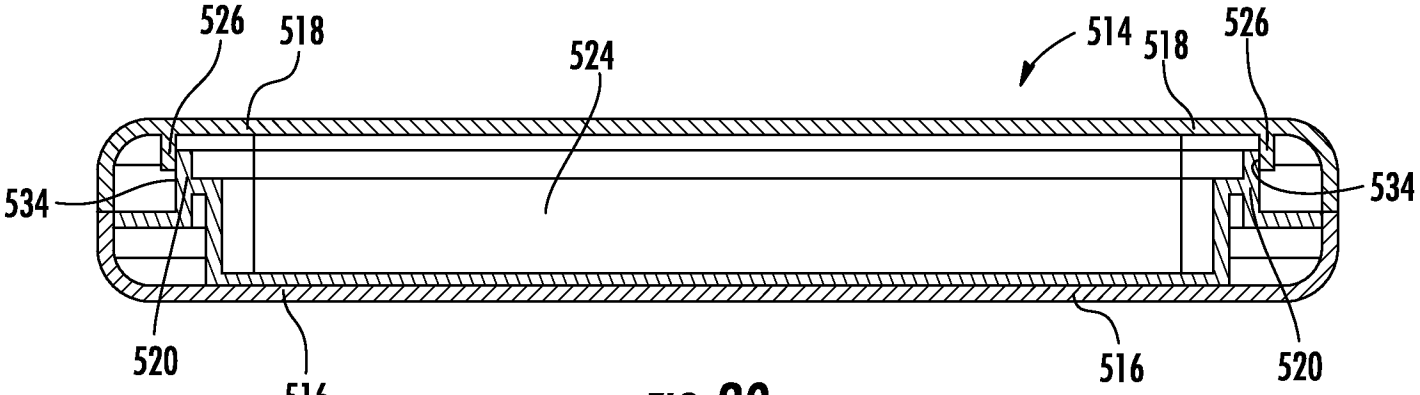
FIG. 20 is a cross sectional view of an embodiment of a package assembly having a second closed lip that is configured to assist in creating a seal within the package.

FIG. 20 is similar to FIG. 19 except the ancillary seal 522 is replaced with a second closed lip 526 that is molded in the second shell portion 518. According to such an embodiment, at least the second shell portion 518 may be molded from a material such as polypropylene that allows the second closed lip 526 to be deformed. Moreover, similar to the second closed lip 512 in FIGS. 12 and 13, the second lip 526 in FIG. 18 is relatively thin so as to allow the second closed lip 526 to be deflected, bent, or deformed by engagement with a outer wall surface 534 of the insert 520 or first shell portion 516, such as a first closed lip, to form a seal. In the embodiment, illustrated in FIG. 20, when the package 514 is in a closed position, the second closed lip 526 is deformed, bent, or distorted outwardly. According to other embodiments, the insert 520 and/or first shell portion 516 may include walls, such as the first closed lip of the first shell portion 516 that may be deflected, bent, or deformed by engagement with the second shell portion 518 to form a seal.

Figure 21:
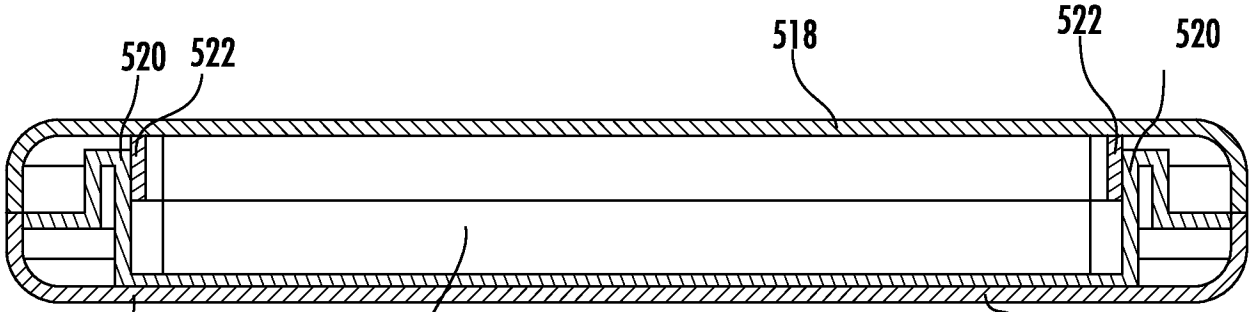
FIG. 21 is a cross sectional view of an embodiment of a package assembly having an ancillary seal that is configured to assist in creating either a face seal or a side seal within the package.

FIG. 21 illustrates an ancillary seal 522 creating a side seal if the ancillary seal 522 is affixed or molded to the second shell portion 518, or a face seal if the ancillary seal 522 is molded or affixed to the insert 520 or first shell portion 516. The ancillary seal 522 shown in FIG. 21 is similar to that shown in FIG. 17, except the ancillary seal 522 in FIG. 21 is a longer seal that extends further into the insert 520. The ancillary seal 522 shown in FIG. 21 may be made from a variety of different materials, including thermoplastic elastomers, among others.

Figure 22:
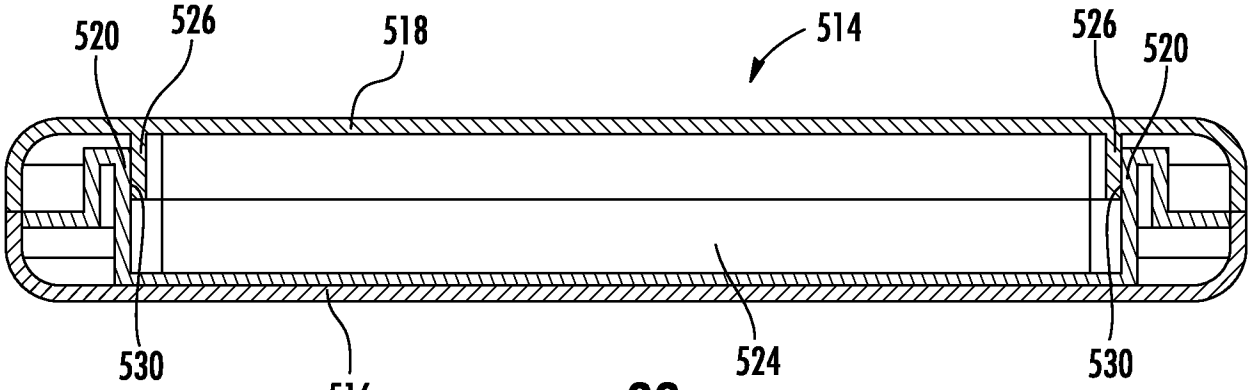
FIG. 22 is a cross sectional view of an embodiment of a package assembly having a second closed lip that is configured to assist in creating a seal within the package.

FIG. 22 is similar to FIG. 21 except the ancillary seal 522 in the package 514 is replaced with a second closed lip 526 that is molded in the second shell portion 518. According to such an embodiment, at least the second shell portion 518 may be molded from a polypropylene, among other materials. Similar to the second closed lip 512 in FIGS. 12 and 13, the second closed lip 526 in FIG. 18 is relatively thin so as to allow the second closed lip 526 to be deflected, bent, or deformed by engagement with an inner wall surface 530 of the insert 520 or first shell portion 516, such as a first closed lip, to form a seal. In the embodiment, illustrated in FIG. 22, when the package 514 is in a closed position, the second closed lip 526 is deformed, bent, or distorted inwardly. According to other embodiments, the insert 520 and/or first shell portion 516 may include walls, such as the first closed lip of the first shell portion 516, that may be deflected, bent, or deformed by engagement with the second shell portion 518 to form a seal.

Figure 23:
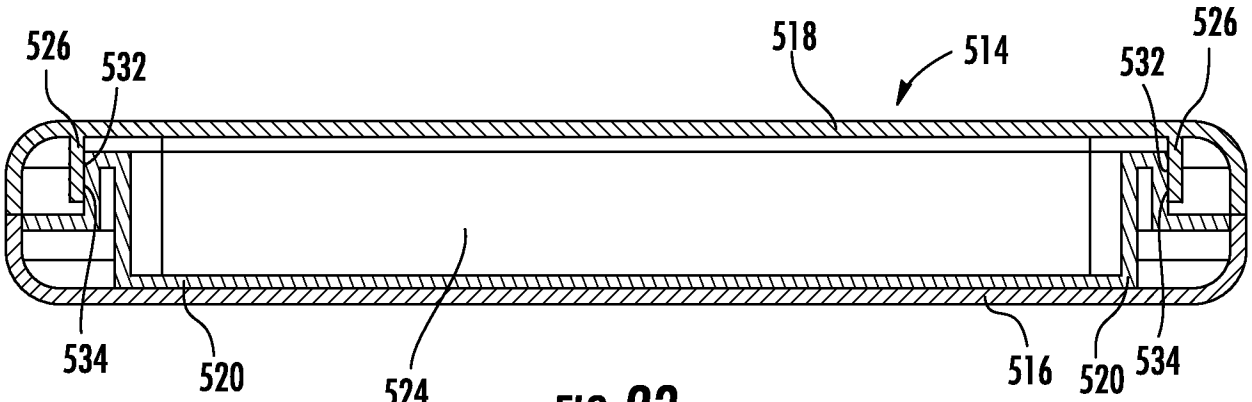
FIG. 23 is a cross sectional view of an embodiment of a package assembly having a second closed lip that is configured to assist in creating a seal within the package.

FIG. 23 illustrates a package 514 in which an inner surface 532 of a second closed lip 526 engages with an outer wall surface 534 of an insert 520 or first shell portion, such as a first closed lip, to form a side seal. According to such an embodiment, the second closed lip 526 may be bent, deformed, or distorted when engaged with the outer wall surface 534 of the insert 520 to form a seal. According to certain embodiments, at least the second closed lip 526 is molded from a polypropylene, among other materials.

Figure 24:
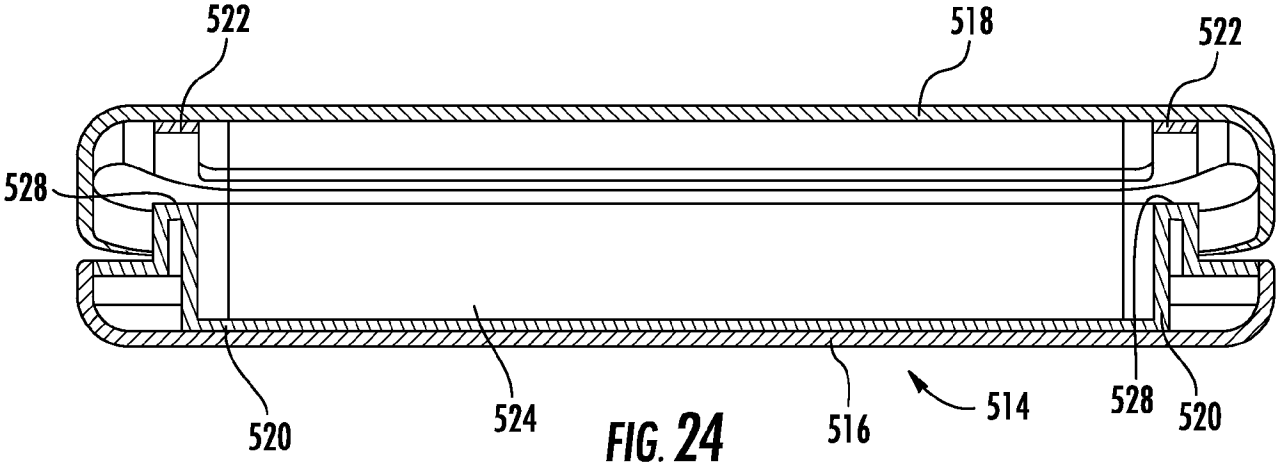
FIG. 24 is a cross sectional view of an embodiment of a package assembly having an ancillary seal that is configured to assist in creating a face seal within the package.

FIG. 24 illustrates an ancillary seal 522 that is affixed or molded to a second shell portion 518. The ancillary seal 522 is configured and positioned to assist in providing a face seal when the package 514 is in a closed position. Moreover, when the package 514 is in a closed position, the ancillary seal 522 engages an upper surface 528 of the insert 520 or of the first shell portion 516. The engagement between the ancillary seal 522 and the upper surface 528 creates a face seal. According to such an embodiment, the ancillary seal 522 may be made from a variety of materials, including thermoplastic elastomers, among others.

Figure 25:
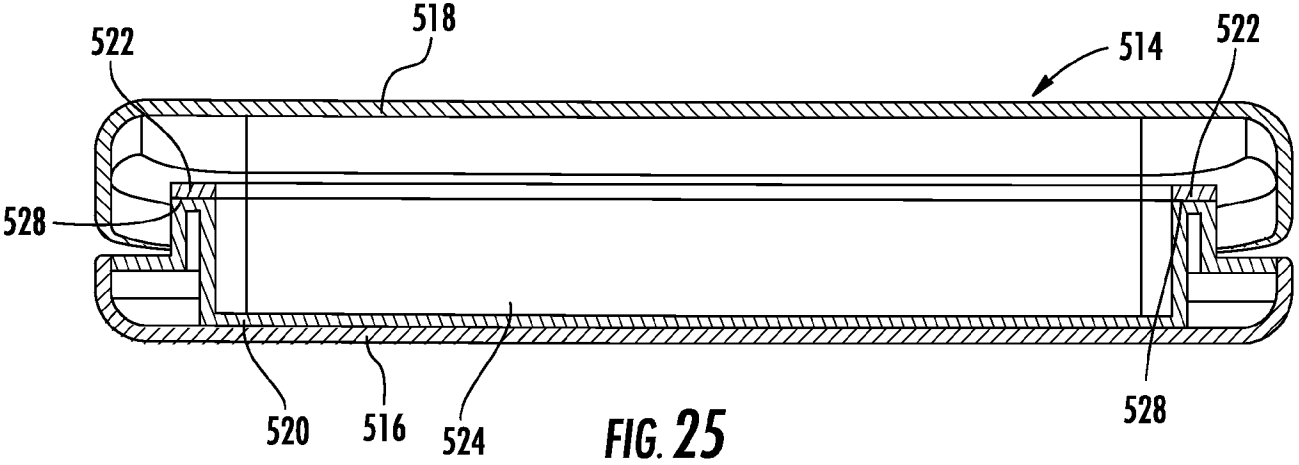
FIG. 25 is a cross sectional view of an embodiment of a package assembly having an ancillary seal that is configured to assist in creating a face seal within the package.

FIG. 25 is similar to FIG. 24 with the exception that the ancillary seal 522 is molded or affixed to the upper surface 528 of the insert 520 rather than the second shell portion 518. Therefore, when the package 514 is closed, a portion of the second shell portion 518 engages the ancillary seal 522 in FIG. 25 to form a face seal that seals the area enclosed therein from ambient air that is outside of the ancillary seal 522.

Figure 26:
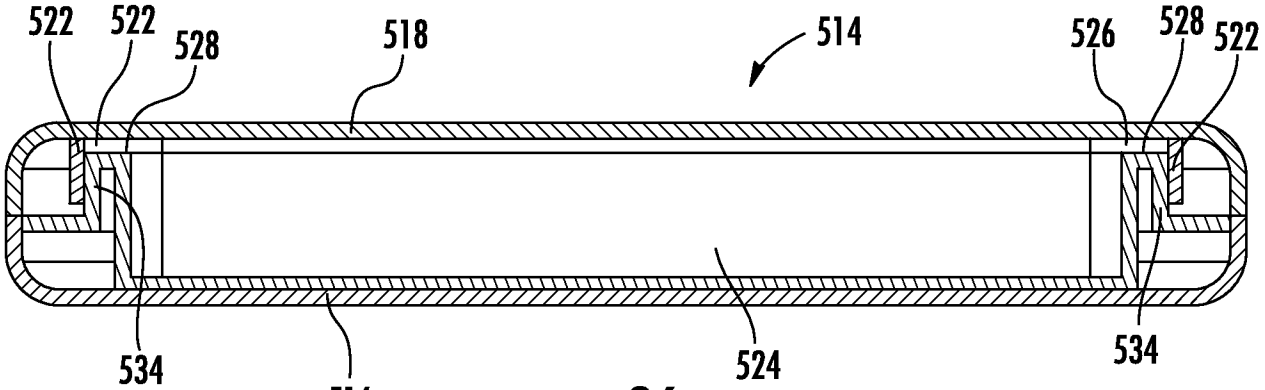
FIG. 26 is a cross sectional view of an embodiment of a package assembly having an ancillary seal that is configured to assist in creating, a face seal and a side seal within the package.

FIG. 26 is similar to FIG. 24 with the exception that in addition to a face seal, the same or an additional ancillary seal 522 is used to provide a side seal inside the package 514. According to an embodiment, at least a portion of the ancillary seal 522 is affixed or molded along a portion of the second shell portion 518. When the package 514 is in a closed position, an upper surface 528 of the insert 520 engages the ancillary seal 522, thereby deforming, bending, or distorting the ancillary seal 522 to mate with at least a portion of the upper surface 528, and thereby assist in creating a seal. Additionally, the same or an additional ancillary seal 522 may extend downwardly so that, when the package 514 is in a closed position, a side seal is formed along an outer wall surface 534 of the insert 520 or of the first shell portion 516, such as a first closed lip.

Figure 27:
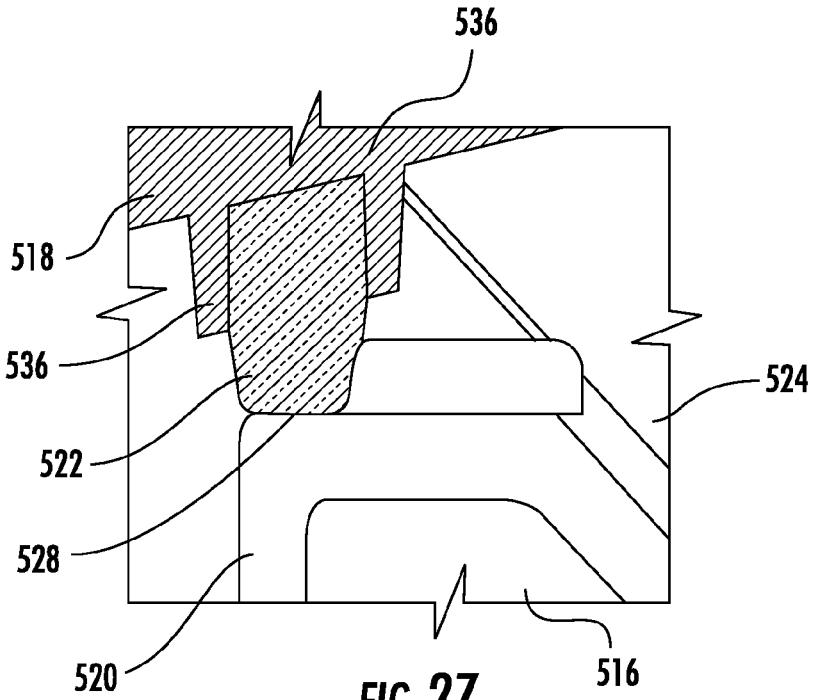
FIG. 27 is a cross sectional view of an embodiment of a package assembly having an ancillary seal that is configured to assist in creating a face seal within the package.

FIG. 27 illustrates an ancillary seal 522 that is affixed or molded to the second shell portion 518 and positioned between lid guides 536. According to such an embodiment, the engagement of the ancillary seal 522 and an upper surface 528 of the insert 520, such as a first closed lip, that forms a face seal that seals the area enclosed therein from ambient air outside of the seal.

Figure 28:
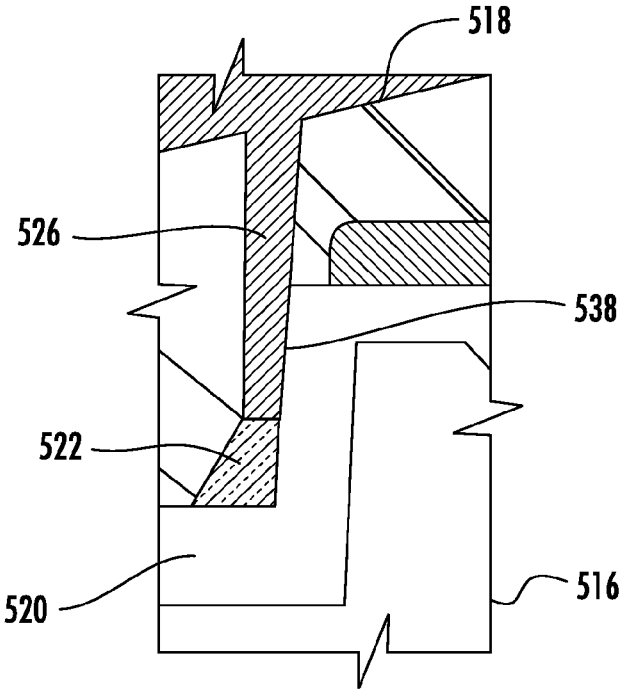
FIG. 28 is a cross sectional view of a portion of an embodiment of a package assembly in a closed position and baying a second closed lip and angled outer wall configured to provide a side seal, and an ancillary seal that is configured to assist in creating a face seal within the package.

FIG. 28 illustrates a seal similar to that previously described with FIGS. 12 and 13, in which a generally straight second closed lip 512, 526 is bent, deformed, or distorted when engaged with an angled outer wall 510, 538 of the insert 506, 520 or first shell portion. However, the embodiment illustrated in FIG. 28 also includes an ancillary seal 522 similar to that previously discussed with respect to FIG. 15. Similar to the discussion regarding FIG. 15, the ancillary seal 522 shown in FIG. 28 may be attached or molded to either the second closed lip 526, the insert 520, or the first shell portion 516, and is used to form a face seal when the package 514 is closed.

Examples of non-elastomeric materials that may be used for the ancillary seal 522 include, but are not limited to, Polypropylene (PP), Polyethylene (PE) (high or low density), Polyvinyl Chloride (PVC), Cyclic Olefin Co-polymer (CoC), Polyethylene Vinyl Acetate (EVA), Polystyrene (PS), Polycarbonate (PC), Polyester terephthalate (PET), Polyamide (nylon), Acetal Copolymer or Homopolymer Resin, and Liquid Crystal Polymer, among others. Examples of elastomeric materials that may be used for the ancillary seal 522 include, but are not limited to, Santoprene® Thermoplastic Vulcanizate (TPV), Polyoxymethylene Copolymer (POM), Ethylene Propylene Diene Monomer (EPDM), Silicones (CG, PG, TR, FDA), Styrenet Butadiene Rubber (SBR), Polychloroprene (CR), Nitrile Rubber (NBR), and Neoprene®, among others.

Referring to FIGS. 29 to 34, a package 540 is shown in an open position that includes a first shell portion 542, a second shell portion 544, an insert 546, a hinge 548, and at least one latch 566. The first shell portion 544 includes a base 550, a base sidewall 552, and an inner region 554. The base sidewall 552 generally extends upwardly from the base 550 and generally defines the inner region 554. The second shell portion 544 includes a lid sidewall 556, a top portion 558, an interior region 560, and at least one catch 562. The lid sidewall 556 generally extends from the top portion 558 and generally defines the interior region 560.

According to an embodiment, the base sidewall 552 and the lid sidewall 556 may be configured to abut each other along at least one surface when the package 540 is in a closed position. Additionally, the package 540 illustrated in FIGS. 29 to 34 may include a sealing arrangement as previously discussed, including, but not limited to, the sealing arrangements discussed with respect to FIGS. 1 to 5 and FIGS. 6 to 28.

Further, as previously discussed, a variety of hinges 548 may be used with the package 540, including integral and non-integral hinges, such as, for example, the double hinge 476 discussed above with respect to FIGS. 10 to 11, a double-fold hinge, flat-top hinge, butterfly hinge, or pinned hinge, among others.

The catch 562*a*, 562*b* may be part of, extend from, or be adjacent to the lid sidewall 556. For example, as shown on FIG. 30, the package 540 includes a first and second catch 562*a*, 562*b* that extend downwardly from the second shell portion 544 and are adjacent to an inner surface of the lid sidewall 556. Additionally, the first and second catch 562*a*, 562*b* include a catch aperture 564 that is configured to engage with it portion of a latch engagement portion 582, discussed below, when the package 540 is in a closed position and the latch 566 is in a locked or rest position, as discussed below.

The insert 546 is configured to be placed and/or secured in the inner region 554 of the first shell portion 542, as previously discussed with respect to at least the package shown in FIGS. 6 to 9. For example, the insert 546 may include a slot or orifice that is placed over a pin or post 494 in the first shell portion 542 to assist in securing the insert 546 to the first shell portion 542. Additionally, as also previously discussed, the insert 546 may include a product containing space 568 that is at least partially accessible to a user when the package 540 is in an open position. At least a portion of the product containing space 568 of the insert 546 may be covered by a cover 570. The cover 570 may include at least one dispenser opening 572 that may be configured for the dispensing of product contained in the production containing space 568. The shape and size of the dispenser opening 572 may be configured based on the size and shape of the product that is to be dispensed from the dispenser opening 572. For example, at least a portion of the dispenser opening 572 may be configured for dispensing relatively long and narrow stick-shaped products, circular products, or thin sheet products from a stack of similar products. Further, the dispenser opening 572 may also include an access opening 574 for the user to place a finger or thumb to assist with the dispensing of product from the dispenser opening 572. Such covers 570 can be used with the inserts for each of the package embodiments discussed herein.

The insert 546 includes at least one latch 566. For example, according to an embodiment, the package 540 has a first latch 566*a* and a second latch 566*b* that are integrally molded with the insert 546. Each latch 566*a*, 566*b* includes a latch leg 576, an actuator portion 578, a latch opening 580, and a latch engagement portion 582. According to an embodiment, the latch leg 576 may extend along the side of the insert 546 and be separated from the body 478 of the insert 546 by a space 480. The space 480 may be configured to provide a space for the displacement of the actuator portion 578 and/or the bending, deformation, distortion, or pivotable movement of the latch leg 576. Additionally, the latch leg 576 may have a first end 486 and a second end 488, the first end 486 including or being attached to the actuator portion 578, and the second end 488 being attached to the body 478 of the insert 546.

The latch opening 580 is configured to receive at least a portion of the corresponding catch 562 when the package 540 is in a closed position. Additionally, the latch engagement portion 582 is configured so that at least a portion of the latch engagement portion 582 extends into the catch aperture 564 when the package 540 is in a closed position so as to lock the package 540 closed. Although FIGS. 29 to 34 illustrate the first and second catches 562*a*, 562*b* and the first and second latches 566*a*, 566*b* on the sides of the package 540, according to other embodiments, the latches 566*a*, 566*b* and catches 562*a*, 562*b* may be located at a variety of locations, including at the front of the package 540, among other locations.

As shown, the actuator portions 578*a*, 578*b* extend through first and second openings 584, 586, respectively, in the base sidewall 552 so that the actuator portions 578*a*, 578*b* are accessible to the user. Additionally, the base sidewall 552 includes a first and second aperture 588, 590 so as to provide the first and second catch 562*a*, 562*b*, respectively, access to the latch openings 580 and latch engagement portions 582.

Figure 29:
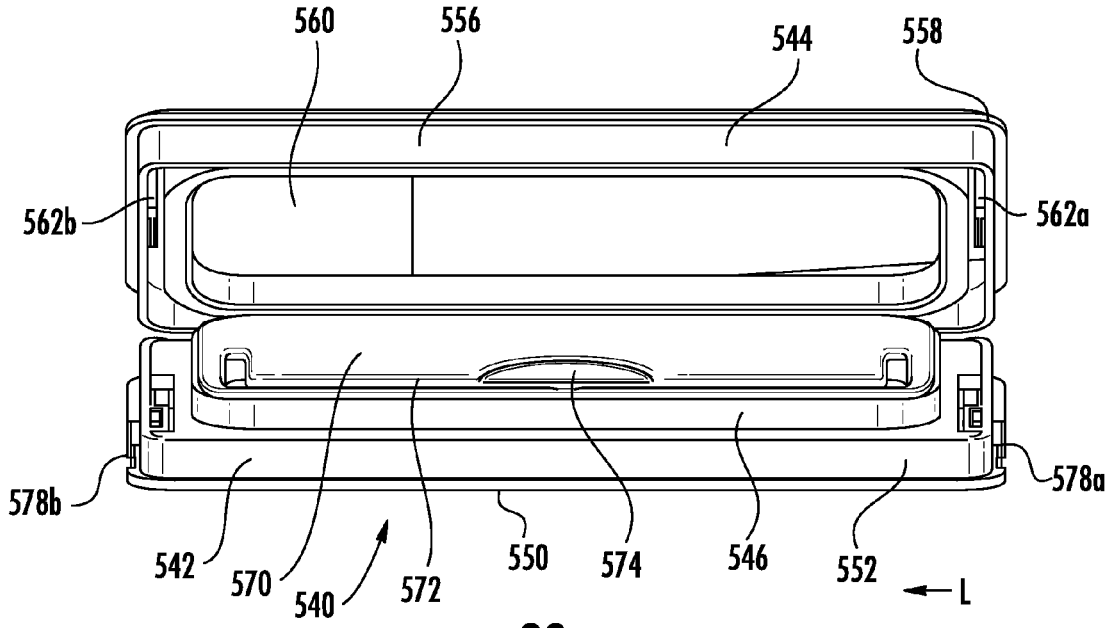
FIG. 29 is a perspective view of an embodiment of the package assembly with the lid open and showing the interior.

To open a package 540 that is closed and locked, the user presses on the actuator portions 578*a*, 578*b* of the latch 56 so that the actuator portions 578*a*, 579*b* are generally inwardly displaced in a lateral direction (as indicated by "L" in FIG. 29). The inward displacement of the actuator portions 578*a*, 578*b* causes the associated latch leg 576*a*, 576*b* to bend, deflect, and/or deform. Such inward displacement of the actuator portions 578*a*, 578*b* causes the inward displacement of the latch engagement portion 582 corresponding to each actuator portion 576*a*, 576*b* so that the latch engagement portion 582 is removed from the corresponding catch aperture 564. The catches 562*a*, 562*b* may then be able to be removed from the latch openings 580*a*, 580*b* and the first and second apertures 588*a*, 588*b*, respectively, as the second shell portion 544 is at least partially separated from the first shell portion 542 as the package 540 is moved from a closed to an open position. When the inward force is removed from an actuator portion(s) 578*a*, 578*b*, the corresponding latch leg 576*a*, 576*b* may generally return to the original shape, orientation, or position the latch leg 376*a*, 576*b* had before the corresponding actuation portion(s) 578*a*, 578*b* was pressed so that the actuator portion(s) 578*a*, 578*b* is generally returned to it's rest or locked position.

Figure 30:
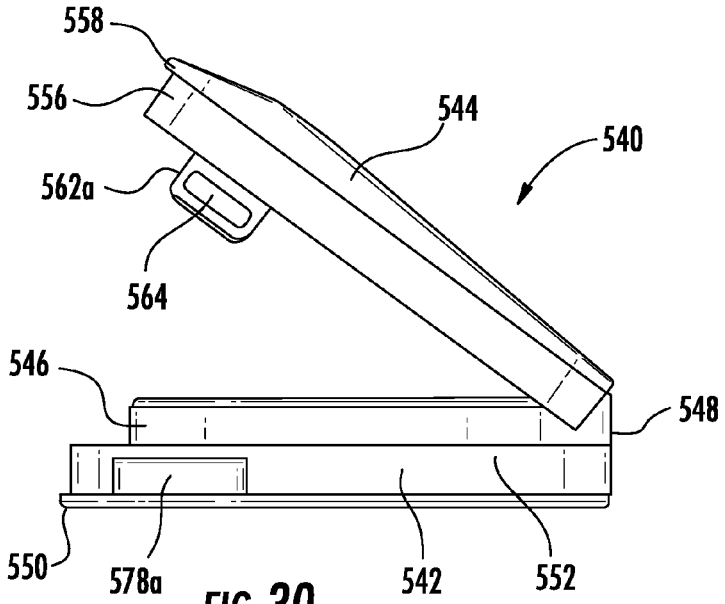
FIG. 30 is a side view of the package assembly shown in FIG. 29.
Figure 31:
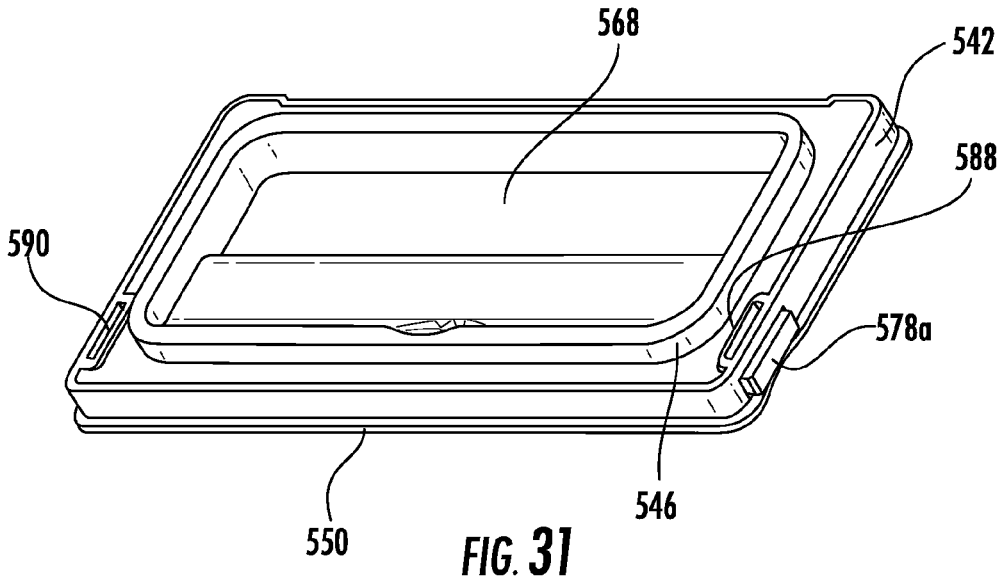
FIG. 31 is a perspective view of the first shell portion and insert of the package shown in FIG. 29.
Figure 32:
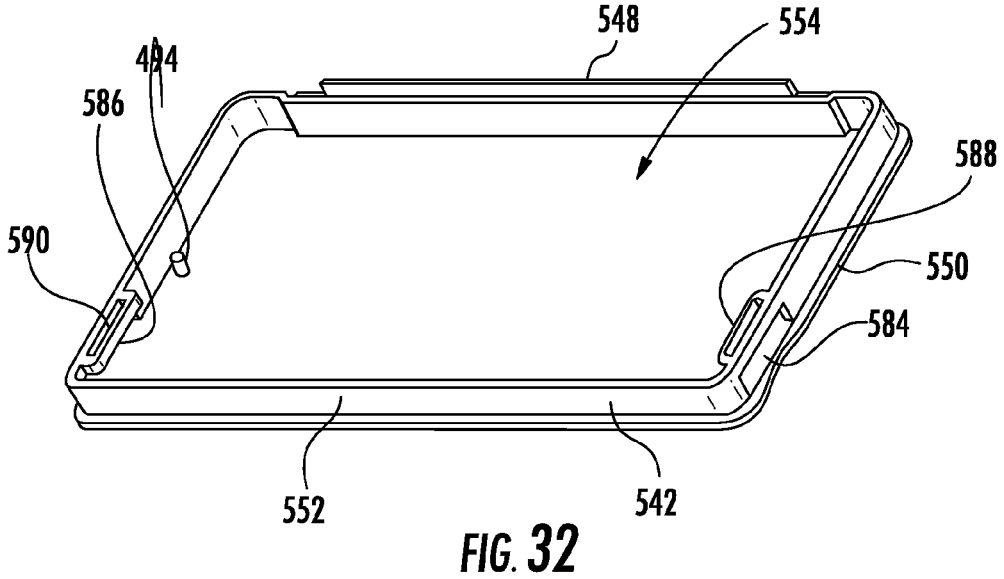
FIG. 32 is a perspective view of a first shell portion of the package shown in FIG. 29.
Figure 33:
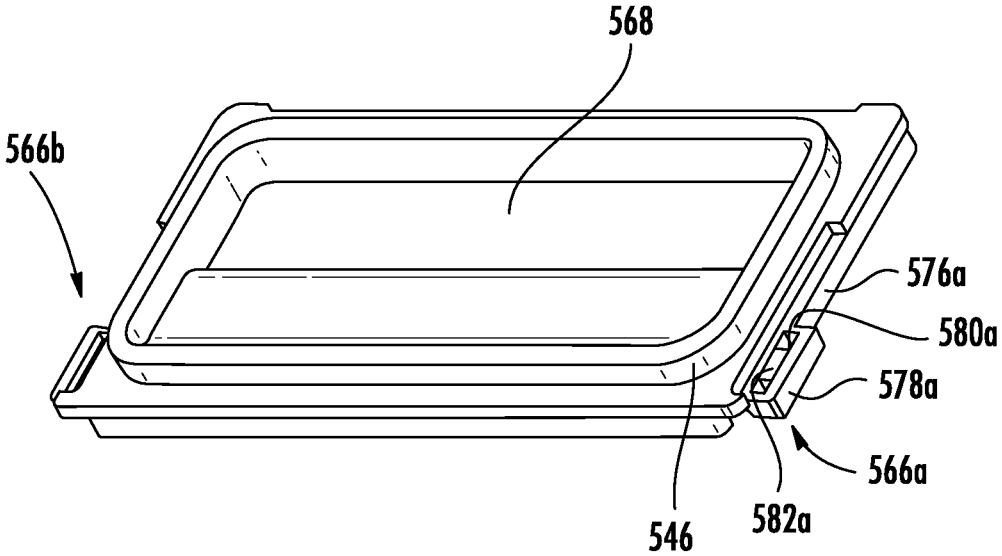
FIG. 33 is a perspective view of the insert of the package shown in FIG. 29, with the insert having an integrally molded latch.
Figure 34:
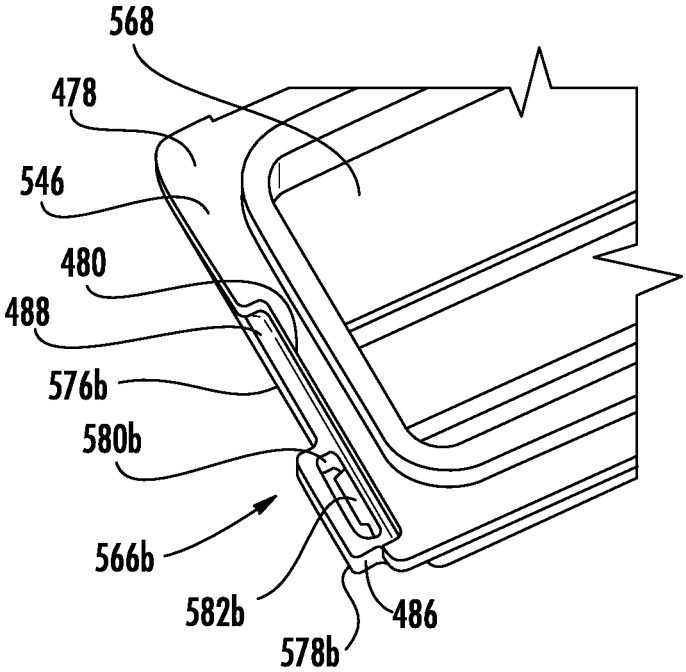
FIG. 34 is a perspective view of a portion of the integrally molded latch shown in FIG. 33 in a rest or locked position.
Figure 35:
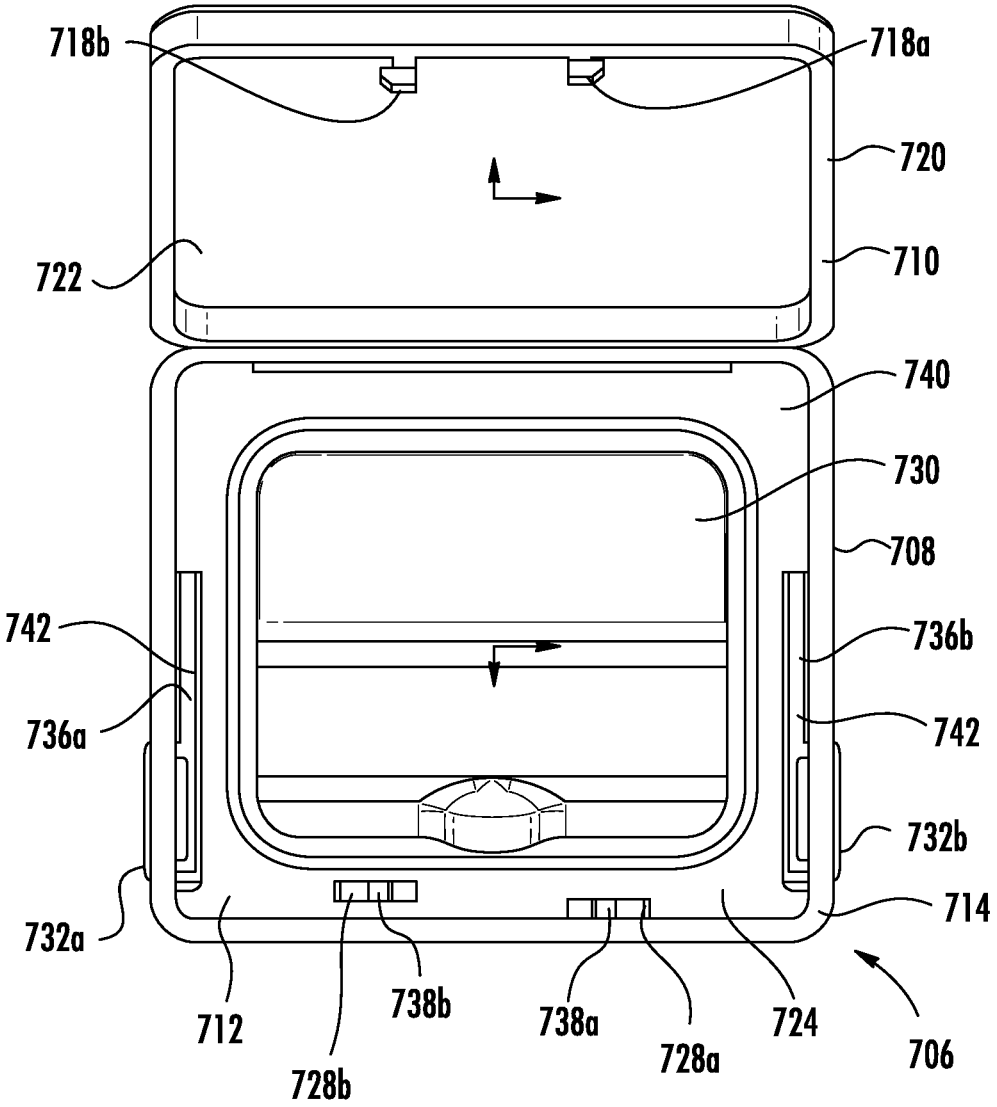
FIGS. 35 and 36 are perspective views of an embodiment of the package assembly, showing the lid open to show the interior and with the latches in a rest or locked position.
Figure 36:
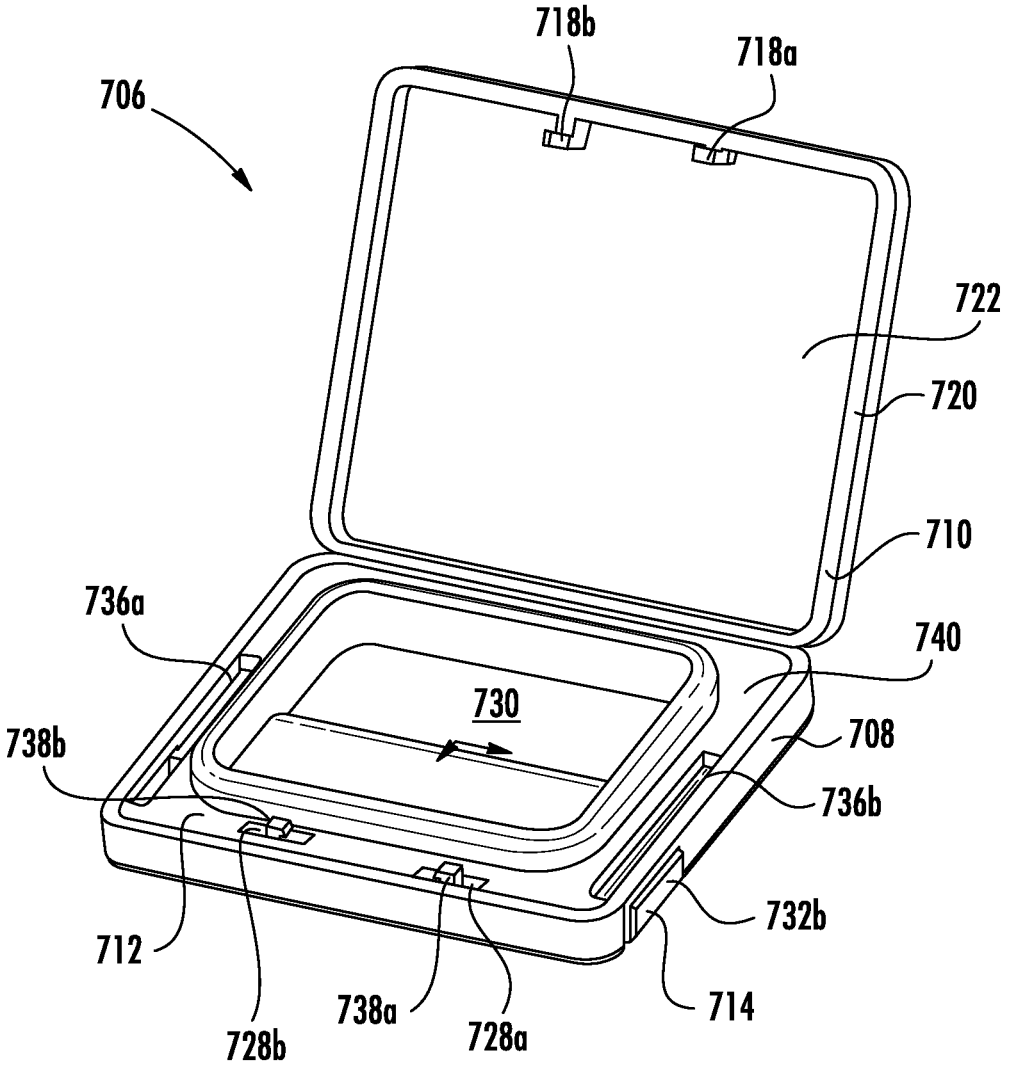

As with the catch 442 discussed above with respect to the package 420 shown in FIGS. 6-9, the catch 562 shown in FIGS. 29 and 30 may be configured to bend, deflect, or deform when the package 540 is being closed so that the latch engagement portion 582 lockingly engage the catch 562 without actuation of the latch 566. Additionally, the latch 566 and/or catch 562 may be configured to so that the closing of the second shell portion 544 relative to the first shell portion 542 forces the latch engagement portion 582 to be displaced until the catch aperture 564 is in position to lockingly engage the latch engagement portion 582 so as to the lock the package 540 in a closed position.

Referencing FIGS. 35 to 38, a package 706 is shown in an open position, the package 706 having a first shell portion 708, a second shell portion 710, and an insert 712. The first shell portion 708 includes a base sidewall 716, the base sidewall 716 having at least one opening 714. The second shell portion 710 may include a lid sidewall 720 that generally defines an interior area 722. According to an embodiment, the second shell portion 710 may have a configuration similar to the second shell portion 44 discussed above with respect to FIGS. 1 to 5. At least one lid latching abutment 718 extends from the second shell portion 710. Moreover, in the embodiment illustrated in FIGS. 35 and 36, a first and a second lid latching abutment 718*a*, 718*b* extend from the second shell portion 710. The first and second shell portions 708, 710 may be integrally or non-integrally molded, and may be joined by a integral or non-integral hinge, including, for example, the double hinge 476 discussed above with respect to FIGS. 10 to 11, a double-fold hinge, flat-top hinge, butterfly hinge, or pinned hinge, among others. Additionally, the package 706 may include a sealing arrangement as previously discussed, including, but not limited to, the sealing arrangements discussed with respect to FIGS. 1 to 5 and FIG. to 28.

Figure 37:
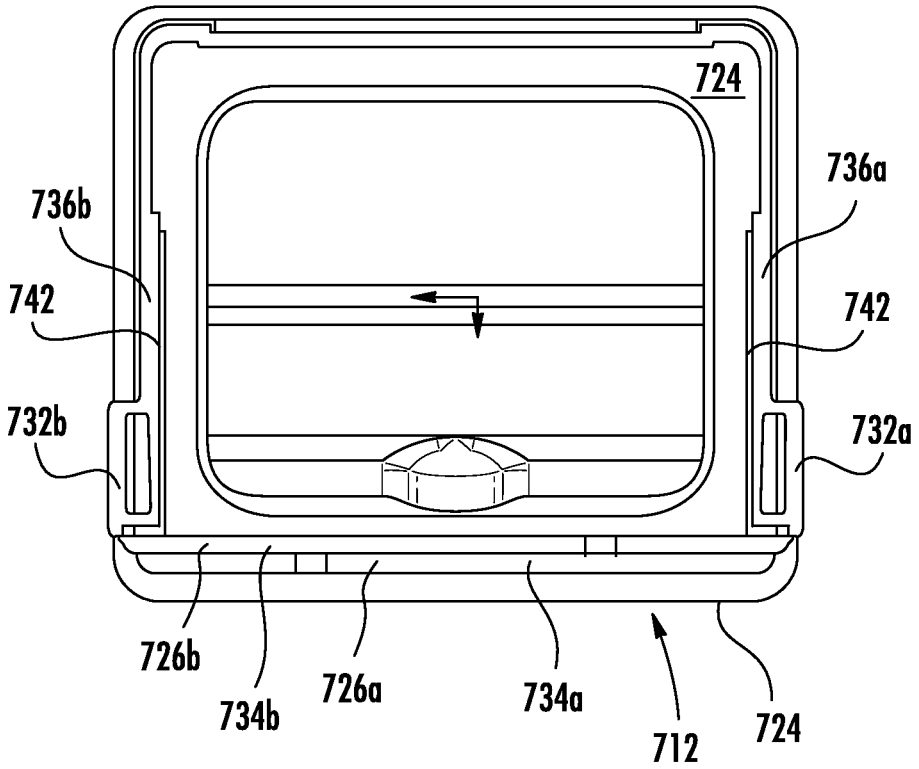
FIG. 37 is a bottom view of an embodiment of an insert for the package assembly shown in FIGS. 35 and 36.
Figure 38:
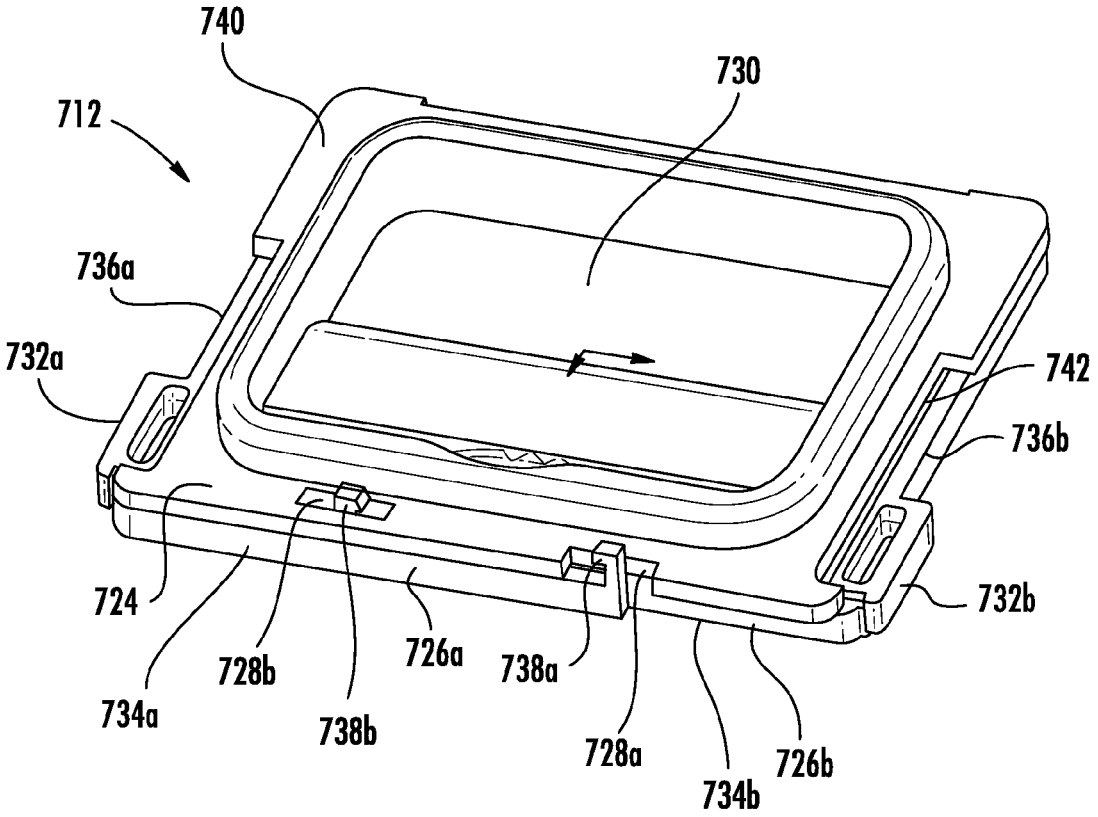
FIG. 38 is a perspective view of the insert shown in FIG. 37.

The insert 712 includes an upper surface 724 and least one latch 726. The upper surface 724 includes at least one aperture 728. Additionally, the upper surface 724 may be configured to provide a product containing space 730 that may be covered by a cover 570, as previously discussed. As shown in FIGS. 37 and 38, the latch 726 is integrally molded to the insert 712. The illustrated embodiment shows a first latch 726*a* and second latch 726*b*. However, according to other embodiments, the insert 712 may include only one latch 726, or more include more than two latches 726.

The first and second latches 726*a*, 726*b* each include an actuator portion 732, a first leg 734, a second leg 736, and a base latching abutment 738. The base latching abutment 738 may be positioned on the first leg 734, while the second leg 736 may be connected to the body 740 of the insert 712. At least a portion of the first leg 734 may be positioned beneath the upper surface 724 of the insert 712. When assembled with the first shell portion 708, at least a portion of the actuator portion 732 protrudes into the opening 714 in the first shell portion 708 so that a user may inwardly depress and displace the latch 726 when unlocking the package 706. The first and second base latching abutments 738*a*, 738*b* are configured to be positioned in, or protrude out of, a first and second aperture 728*a*, 728*b*, respectively, in the insert 712. Additionally, the first and second base latching abutments 738*a*, 738*b* are configured to engage with the first and second lid latching abutments 718*a*, 718*b*, respectively, so as to lock the package 706 in the closed position.

According to an embodiment, at least a portion of the first leg 734 of the second latch 726*b* may be positioned over at least a portion of the first leg 734 of the first latch 726*a*, or vice versa. According to such an embodiment, the first leg 734*b* or base latching abutment 738*b* of the second latch 726*b* is configured or positioned so that the second latch 726*b* does not interfere with the ability of the base latching abutment 738*a* of the first latch 726*a* to slidingly engage and disengage with/from the first lid latching abutment 718*a*. According to an embodiment, at least a portion of the first legs 734*a*, 734*b* of the first and second latches 726*a*, 726*b* may be positioned next to each other, as shown in FIGS. 37 and 38.

In use, the lid latching abutments 718*a*, 718*b* may engage the base latching abutments 738*a*, 738*b* in a manner similar to that described above with respect to FIGS. 4 and 5 to lock the package 706 in a closed position. To unlock the package 706, the user may inwardly press on the actuator portions 732*a*, 732*b*, causing the lateral displacement of the first and second base latching abutments 738*a*, 738*b* away from, and thereby disengage, their adjacent lid latching abutments 718*a*, 718*b*, and thus unlock the package 706.

According to an embodiment, at least a portion of each of the second legs 736*a*, 736*b* of the latches 726*a*, 726*b* are separated from the adjacent body 740 of the insert 712 by a space 742, with an end portion of the second leg 736 being connected to the body 740. When the first and second actuator portions 732*a*, 732*b* are inwardly displaced from their rest or locked position, the thickness and material selection for the second legs 736*a*, 736*b* and/or the configuration of the attachment of the second legs 736*a*, 736*b* to the body 740 of the insert 712 allows the second leg 736 to be bent, deformed, distorted, and/or pivoted. When the force that inwardly displaced the actuator portions 732*a*, 732*b* is removed, the second leg 736*a*, 736*b* may act as a spring that returns the latch 736*a*, 736*b* to its rest or locked position, as shown in FIGS. 35 to 38, as the second leg 736*a*, 736*b* returns to its rest or locked position, shape, and/or orientation.

The second leg 736 of the latches 726*a*, 726*b* may also be deformed, bent, or displaced while the package 706 is being moved for an open to a closed position. More specifically, when the package 706 is being closed, and the user is not inwardly displacing the actuator portions 732*a*, 732*b*, a lower area of the first and second base latching abutments 738*a*, 738*b* may be generally aligned, and come into contact, with an upper area of the corresponding first and second lid latching abutments 718*a*, 718*b*. The force exerted by the first and second lid latching abutments 718*a*, 718*b* on the base latching abutment 738*a*, 738*b* may cause the second leg 736*a*, 736*b* of the latches 726*a*, 726*b* to be deformed, bent, distorted, and/or pivoted so that the first and second base latching abutments 738*a*, 738*b* are displaced in a generally outwardly direction until the base and lid latching abutments 718*a*, 718*b*, 738*a*, 738*b* are properly aligned for locking the package 706. Once the base and lid latching abutments 718*a*, 718*b*, 738*a*, 738*b* are properly aligned, the second leg 736*a*, 736*b* may return to its rest or locked position or orientation, which moves the first and second base latching abutments 738*a*, 738*b* in a generally inwardly direction until the latches 726*a*, 726*b* are at their rest or locked position. According to an embodiment, the outer surfaces of the base and/or lid latching abutments 718*a*, 718*b*, 738*a*, 738*b* may have surface characteristics, such as chamfers or contours, that may assist in the outwardly moving the base latching abutments 738*a*, 738*b* when the package 706 is being closed.

Figure 39:
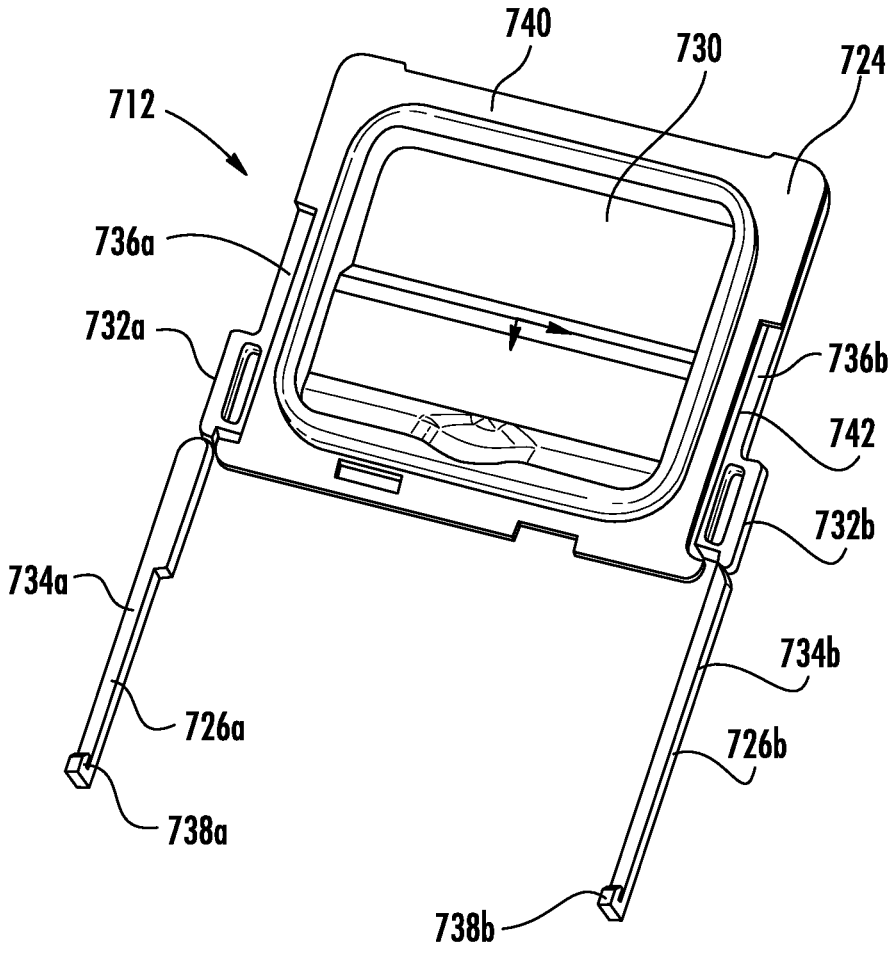
FIG. 39 is a perspective view of the insert shown in FIG. 37 after molding and before the first and second legs of the latches are folded into position for assembly of the insert with the package assembly.

FIG. 39 illustrates the insert 712 after molding. As shown, according to an embodiment, the latches 726*a*, 726*b* may be integrally molded with the insert 712 by having the first legs 734*a*, 734*b* extend away from the body 740 of the insert 712. According to such an embodiment, prior to assembly in the first shell portion 708, the first legs 734*a*, 734*b* may be rotated into position beneath the body 740 of the insert 712.

Figure 40:
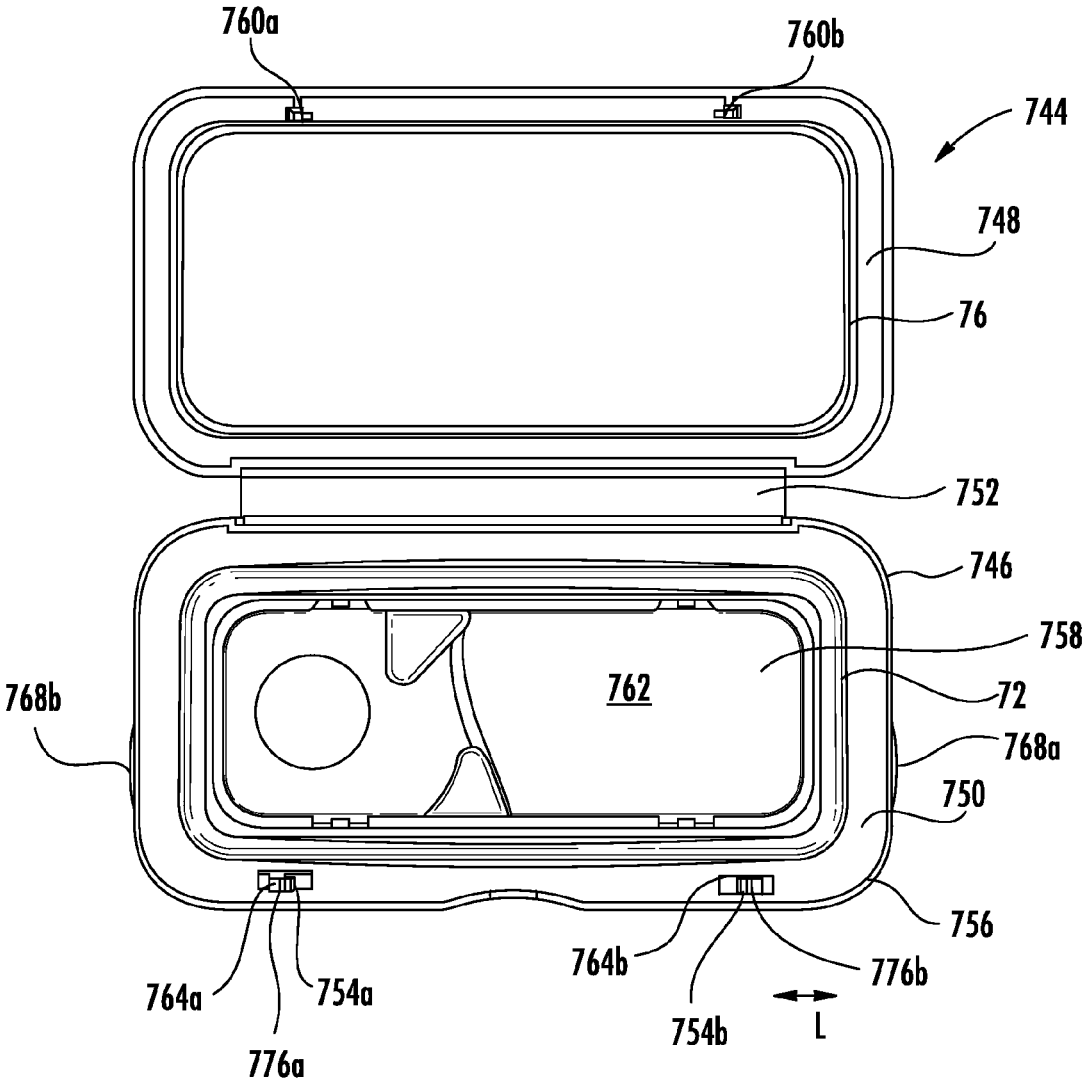
FIG. 40 is a perspective view of an embodiment of the package assembly, having the lid open and showing the interior with the latches in a locked or rest position.

Referring to FIGS. 40 to 43, a package 744 is shown having a first shell portion 746, second shell portion 748, an insert 750, a hinge 752, and at least one latch 754. According to an embodiment, the first and second shell portions 746, 748 and the insert 750 may generally have the same or similar construction as the previously discussed first and second shell portions 42, 44 and insert 78, respectively, that are illustrated in FIGS. 1 to 5. As also previously discussed, the first and second shell portions 746, 748 may be joined by a variety of integral or non-integral hinges, such as, for example, the double hinge 476 discussed above with respect to FIGS. 10 to 11, a double-fold hinge, flat-top hinge, butterfly hinge, or pinned hinge, among others. Additionally, the package 744 illustrated in FIGS. 40 to 43 may include a sealing arrangement as previously discussed, including, but not limited to, the sealing arrangements discussed with respect to FIGS. 1 to 5 and FIGS. 6 to 28. For example, the first and second shell portions shown in FIG. 40 are both illustrated as having a first and second closed lip 72, 76, respectively, as previously discussed.

Figure 41:
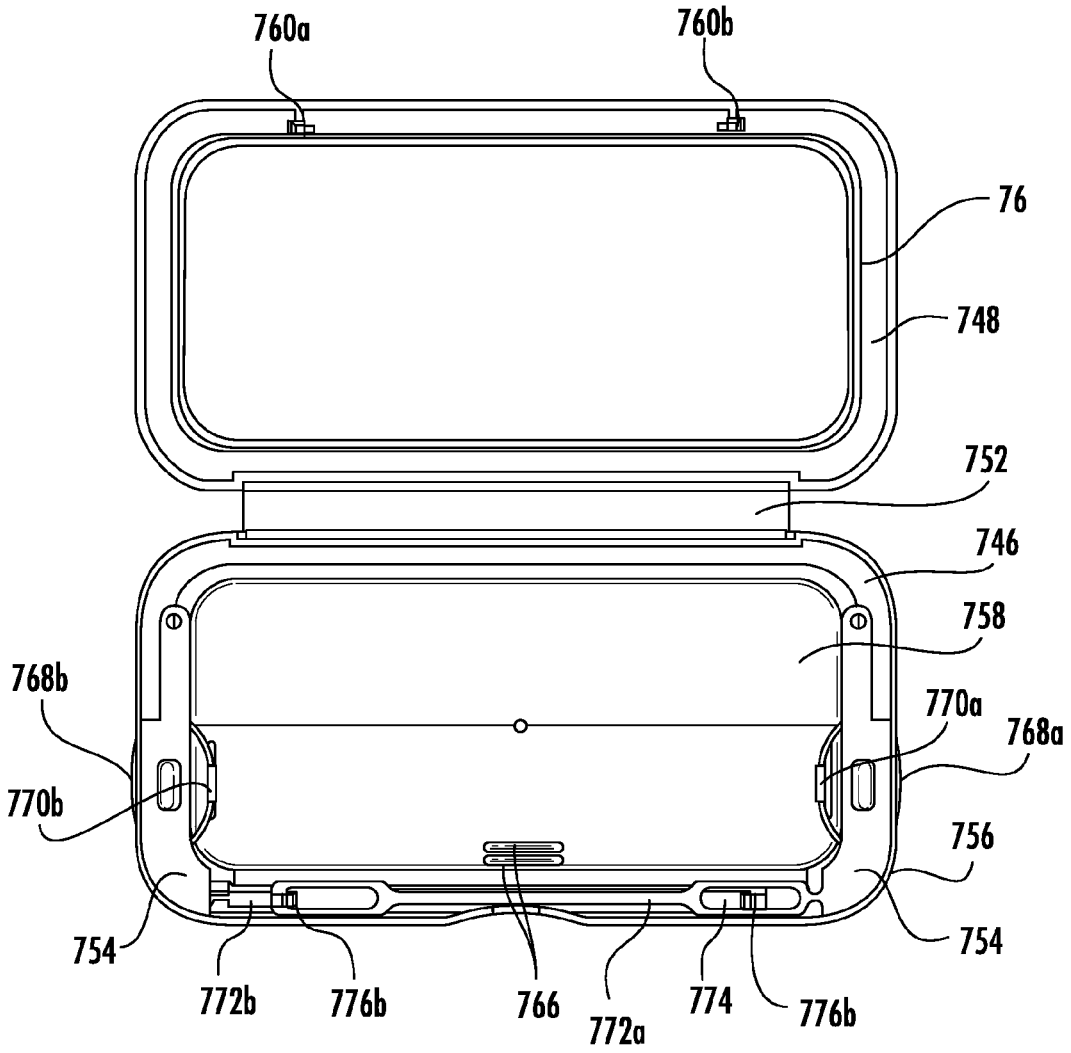
FIG. 41 is a perspective view of the package shown in FIG. 40 but without the insert.
Figure 42:
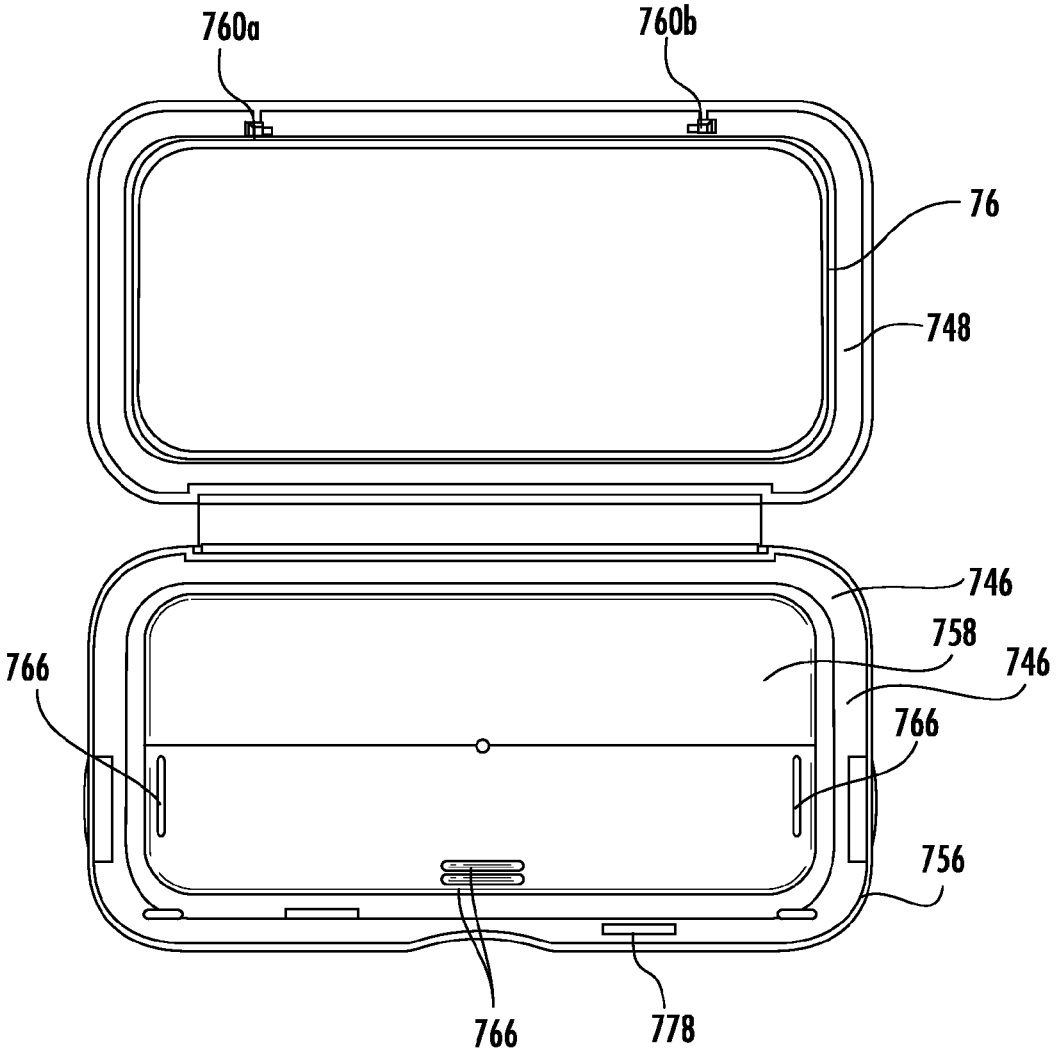
FIG. 42 is a perspective view of the package shown in FIG. 40 but without the insert and the first and second latch.

As shown in FIGS. 40 to 42, the first shell portion 746 may include a base sidewall 756 and an inner region 758, while the second shell portion 748 may include at least one lid latching abutment 760. The insert 750 may include a product containing space 762, and at least one aperture 764. According to an embodiment, the insert 750 may include a first attachment member, such as a tab, that is to be mated or fitted with a second attachment member 766, such as rib protrusions, in the first shell portion 746 to attach or secure the insert 750 to the first shell portion 746. Additionally, at least a portion of the insert 750, such as a portion of the product containing space 762, may be covered by a cover 570, as previously discussed.

As previously mentioned, the package 744 includes at least one latch 754. According to the embodiment illustrated in FIGS. 40 to 43, the package 744 has an upper latch 754*a* and a lower latch 754*b*. The upper latch 754*a* includes an actuator portion 768*a*, a spring 770*a*, a leg 772*a*, an opening 774, and a first base latching abutment 776*a*. The lower latch includes an actuator portion 768*b*, a spring 770*b*, a leg 772*b*, and a second base latching abutment 776*b*. The springs 770*a*, 770*b* may be integrally molded or non-integral to the upper and lower latches 754*a*, 754*b*. The first and second base latching abutments 776*a*, 776*b* are configured to lockingly engage a first and second lid latching abutment 760*a*, 760*b*, respectively, when the package 744 is in closed position. According to an embodiment, the base and lid latching abutments 776*a*, 776*b*, 760*a*, 760*b* have a configuration similar to the latching abutments 98, 66, 86, 54 previously discussed with respect to FIGS. 1 to 5. The springs 770*a*, 770*b* may be configured to engage a wall in the first shell portion 746 or insert 750, such as a first closed lip, so as to bias the latches 754*a*, 754*b* in a locked or rest protrusion, wherein the actuator portions 768*a*, 768*b* may protrude from openings in the base sidewall 756.

Figure 43:
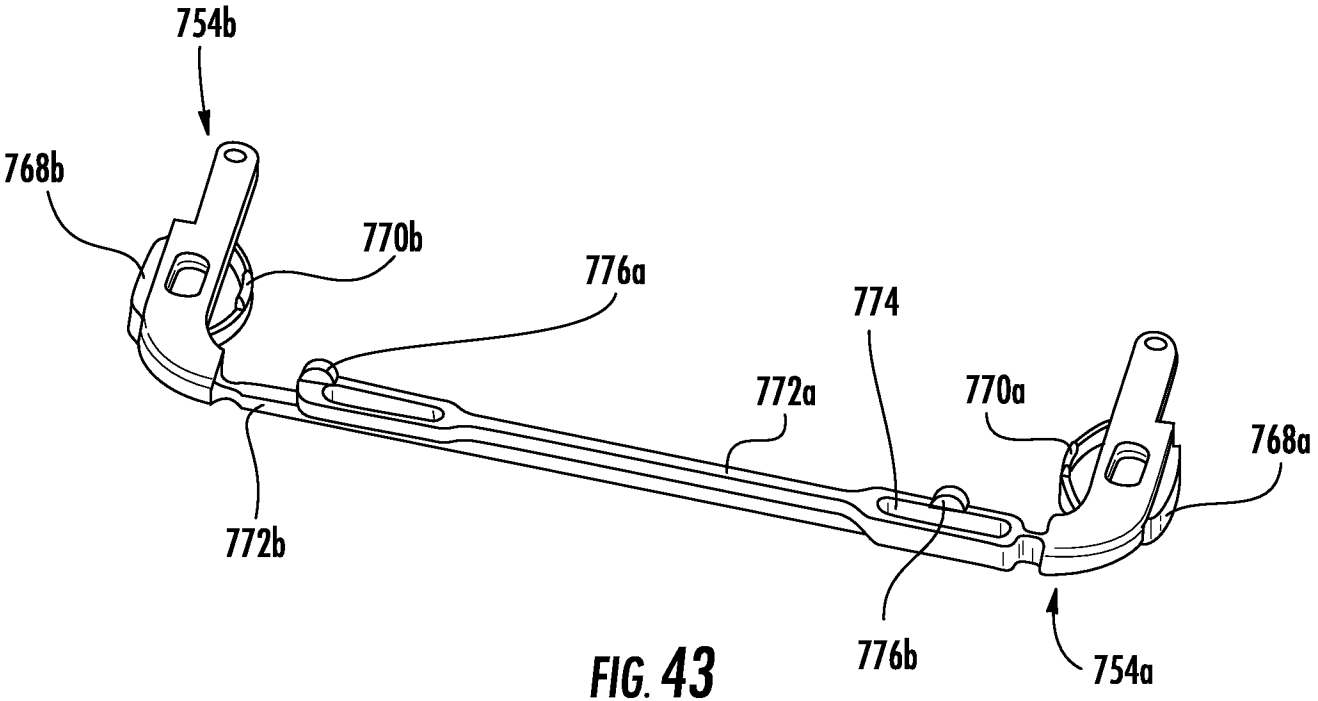
FIG. 43 is a perspective view of overlapping first and second latches.

When assembled, at least a portion of the leg 772*a* of the upper latch 754*a* overlaps at least a portion of the leg 772*b* of the lower latch 754*b*, as shown in FIG. 43. Additionally, the opening 774 of the upper latch 754*a* is configured to receive the insertion of the second base latching abutment 776*b*, and is sized to not interfere with the ability of the second latching abutment 776*b* to be laterally displaced (as indicated by "L" in FIG. 40) when the second latching abutment 776 is engaging and disengaging the second lid latching abutment 760*b*. When the package 744 is assembled with the insert 750, at least a portion of the first and second base latching abutments 776*a*, 776*b* may extend through an aperture 764*a*, 764*b* in the insert 750 and/or at least a portion of a lid latching abutment 760*a*, 760*b* may extend into the aperture 764*a*, 764*b* when the package 744 is in a dosed position.

A latch 754 may move from a rest or locked position to an unlocked position when an actuator portion 768 is inwardly depressed with sufficient force to at least partially deform, deflect, or bend the spring 770*a*, 770*b*. As an actuator portion 768*a*, 764*b* is inwardly displaced, the associated spring 770*a*, 770*b*, which, according to an embodiment may be a leaf spring that is located on the backside of the actuator portion 768*a*, 768*b*, is pressed against a wall or surface of the first shell portion 746 or insert 750, such as a first closed lip. The displacement of the actuator portion 768*a*, 768*b* causes the associated leg 772*a*, 772*b* and base latching abutment 776*a*, 776*b* to move in the same general direction as the actuator portion 768*a*, 768*b*. When both the upper and lower actuator portions 768*a*, 768*b* are being inwardly displaced, the legs 772*a*, 772*b* of the upper and lower latches 754*a*, 754*b* may generally slide opposite directions, thereby increasing the distance between the first and second base latching abutments 776*a*, 776*b*. Moreover, the sliding displacement of a base latching abutment(s) 776*a*, 776*b* may disengage the base latching abutment(s) 754*a*, 754*b* from a locking, engagement with the corresponding lid latching abutment 760*a*, 760*b*.

When the user releases an actuator portion 768*a*, 768*b*, the associated spring 770*a*, 770*b* forces the actuator portion 768*a*, 768*b* to generally return to its locked or rest position, bringing the base latching abutments 776*a*, 776*b* back into closer proximity with each other. Additionally, when an opened package 744 is being closed, the lid latching abutment 760*a*, 760*b* may exert a force on the corresponding base latching abutment 776*a*, 776*b* that is sufficient to at least partially deflect, deform, or bend the spring 770*a*, 770*b* so that the base latching abutments 776*a*, 776*b* may be outwardly displaced until the base and lid latching abutments 776*a*, 776*b*, 760*a*, 760*b* are aligned, after which the springs 770*a*, 770*b* return the base latching abutments 776*a*, 776*b* to a locked or rest position, thereby locking the package 744 dosed.

Additionally, the leg 772*a* of the upper latch 754*a* may include a protrusion that mates with an aperture in the leg 772*b* of the lower latch 754*b*, and/or vice versa, that may assist in guiding the sliding movement of the legs 772*a*, 772*b* as the latches 754*a*, 754*b* are moved between open and locked or rest positions. Additionally, according to an embodiment, the insert 750 or first shell portion 746 may include at least one protrusion 778 that may assist in guiding the displacement of the actuator portion 768*a*, 768*b* or sliding movement of the upper and/or lower legs 772*a*, 772*b*.

Figure 44:
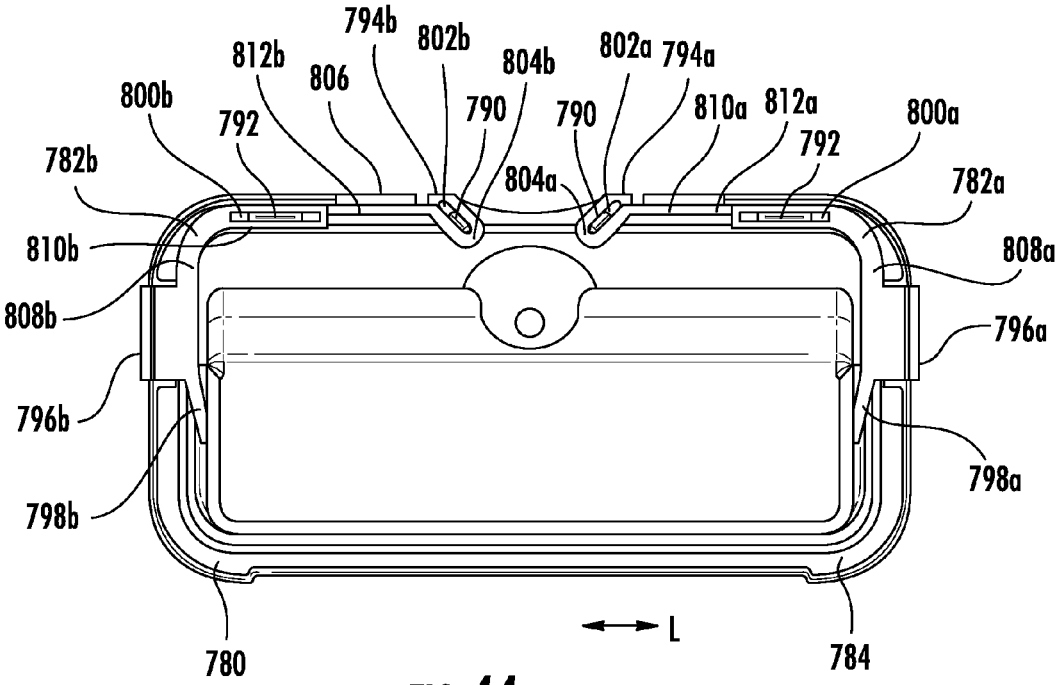
FIG. 44 is a bottom view of an embodiment of an insert having two latches shown in the rest or locked position.
Figure 45:
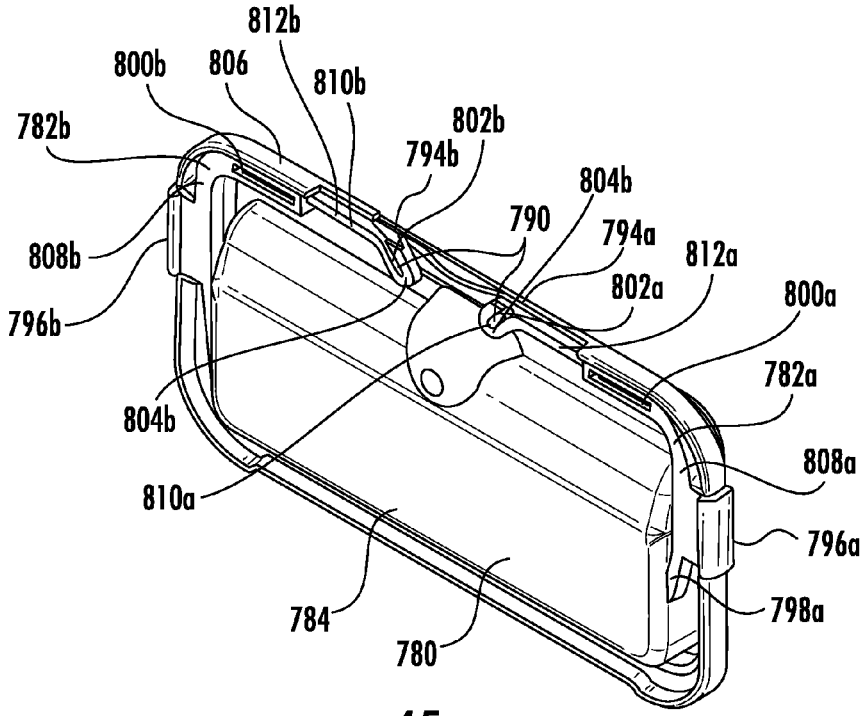
FIG. 45 is a perspective view of the insert shown in FIG. 44 with the latches in the rest or locked position.
Figure 46:
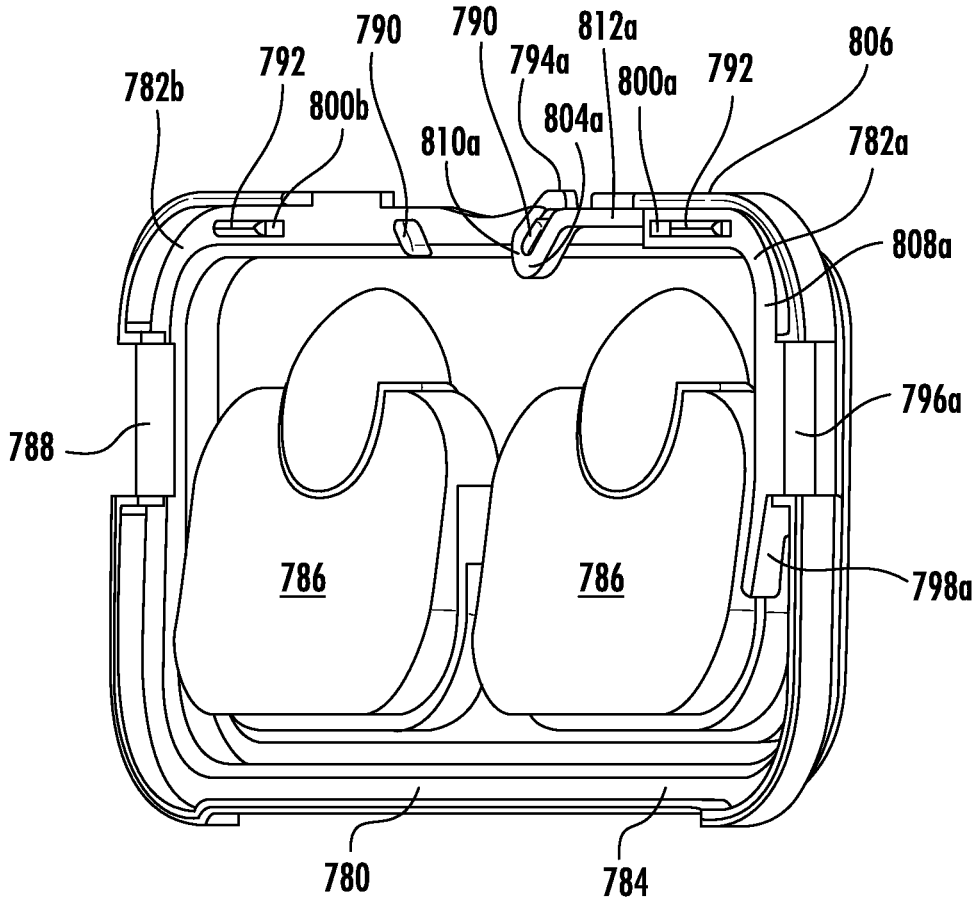
FIG. 46 is a perspective view of a portion of the insert shown in FIG. 44 having a first latch in a rest or locked position and a second latch removed from the insert.

FIGS. 44 to 48 illustrate an embodiment of an insert 780 having first and second latches 782*a*, 782*b* that are attached to the bottom 764 of the insert 780. Although FIGS. 44 to 48 illustrate the use of two latches 782*a*, 782*b*, the insert 780 may be configured for use with one or more than two latches. Additionally, the insert 780 shown in FIGS. 44 to 48 may be used with a variety of the packages and sealing arrangements previously described. Further, although the insert 780 shown in FIG. 46 illustrates the backside of two product containing spaces 786, as with the inserts previously illustrated, the insert 780 may be configured to include one or more product containing spaces 786.

According to an embodiment, the insert 780 includes an opening 788, a tab 790, and a guide 792 for each latch 782*a*, 782*b*. The latches 782*a*, 782*b* may include an actuator portion 796*a*, 796*b*, a spring 798*a*, 798*b*, a leg opening 800*a*, 800*b*, a slot 802*a*, 802*b*, and latching abutments 794*a*, 794*b*. The latch 782*a*, 782*b* may have a first leg 808*a*, 808*b* and a second leg 810*a*, 810*b* that generally form an "L" shaped configuration. The first leg 808*a*, 808*b* may include, or be attached to, the actuator portion 796*a*, 796*b* and the spring 798*a*, 798*b*. The spring 798*a*, 798*b* may be integrally molded to the latch 782*a*, 782*b* or non-integral. Additionally, a variety of springs may be incorporated, either separately or in combination, including leaf and helical compression springs. According to the embodiment illustrated in FIGS. 44 to 48, the latch 782*a*, 782*b* includes an integrally molded leaf spring 798*a*, 798*b* that extends from a side of the actuator portion 796*a*, 796*b* and engages a wall surface on the insert 780. Alternatively, the spring 798*a*, 798*b* may engage a wall of a first shell portion. When the latches 782*a*, 782*b* are in a rest or locked position, the latches 782*a*, 782*b* are biased by the spring 798 in a locked, or rest position, as shown in FIGS. 44 and 45.

As shown in FIGS. 44 to 48, the actuator portion 796*a*, 796*b* extends through the opening 788 in the insert 780. As also previously discussed, the first shell portion also includes an opening through which the actuator portion 796*a*, 796*b* protrudes when the latch 782*a*, 782*b* is in a rest or locked position.

The second leg 810*a*, 810*b* may include a leg opening 800*a*, 800*b*, a slot 802*a*, 802*b* and a latching abutment 794*a*, 794*b*. The leg opening 800*a*, 800*b* is configured to receive the insertion of the guide 792, which may at least assist in guiding the generally inwardly lateral movement (as in indicated by "L" in FIG. 47) of the second leg 810*a*, 810*b* when the latch 782*a*, 782*b* is moved from a rest or locked position to an open position, and assist in the generally outwardly lateral movement of the second leg 810*a*, 810*b* when the latch 782*a*, 782*b* is moved from an open position to a locked or rest position. At least a portion of the end region 804 of the second leg 810*a*, 810*b* wraps around at least a portion of the tab 790 in the insert 780, with the tab 790 being received in a slot 802*a*, 802*b* in the latch 782*a*, 782*b*. Both the slot 802*a*, 802*b* and the tab 790 have a generally angled orientation, as shown in FIGS. 44 to 48. According to an embodiment, the slot 802*a*, 802 and tab 790 may be angled at about 45 degrees from a front portion 806 of the insert 780.

Figure 47:
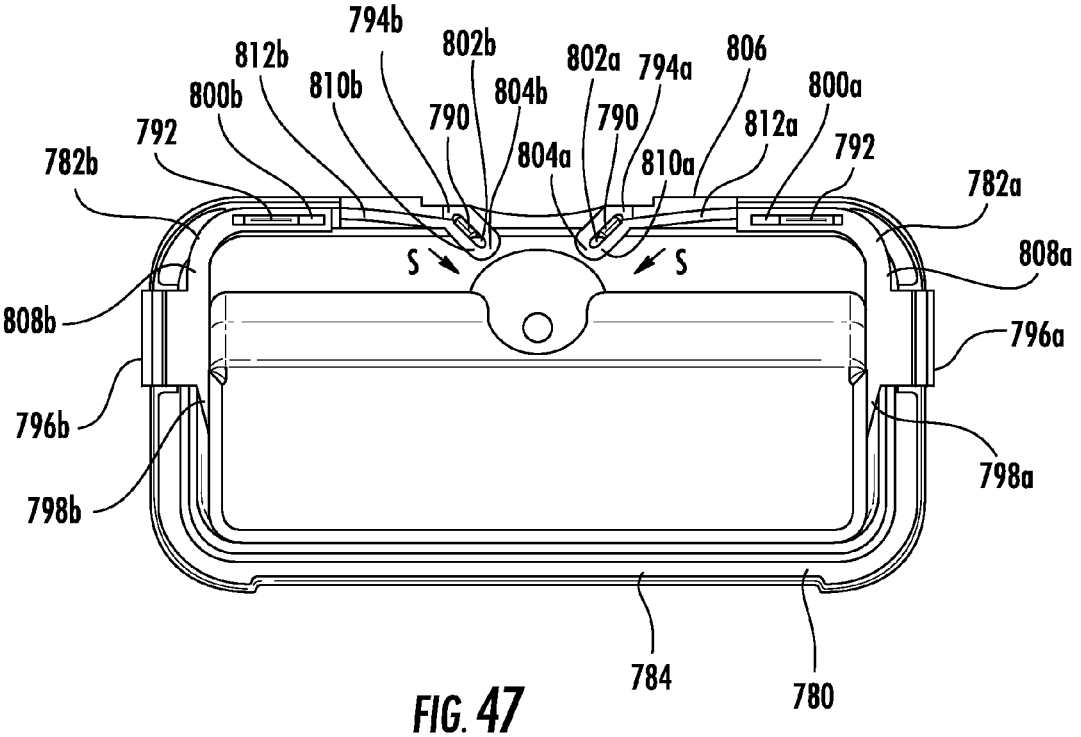
FIG. 47 is a bottom view of the insert shown in FIG. 44 but with the latches in an open position.

The latching abutments 794*a*, 794*b* are configured to engage with the latching abutments that extend from the second shell portion or lid, as previously discussed. As shown in FIG. 47, when at a rest or locked position, the latching abutments 794*a*, 794*b* at least partially protrude from the front portion 806 of the insert 780 so as to lockingly engage the latching abutments of the second shell portion or lid when the package is in a closed position.

The latching abutments 794*a*, 794*b* shown in FIGS. 44 to 48 may have a chamfered or contoured surface, such as a ramp, that assists in moving the latching abutments 794*a*, 794*b* from a locked or closed position to an open position as the package is in the process of being closed. For example, when a package is moved from an opened, unlocked position, to a closed, locked position, the latching abutments 794*a*, 794*b* of the latches 782*a*, 782*b* may be in a position that contacts the lid latching abutments before the lid latching abutments reach the needed position or alignment for a locking engagement with the latching abutments 794*a*, 794*b* of the latches 782*a*, 782*b*. Therefore, the latching abutments 794*a*, 794*b* may include chamfers or contours that assist with the displacement the latching abutments 794*a*, 794*b* towards the package until the lid latching abutments are positioned for a locking engagement with the latching abutments 794*a*, 794*b* of the latches 782*a*, 782*b*.

When the actuator portion 796 is displaced in a generally inwardly lateral direction (as indicated by "L" in FIG. 44), at least a portion of the second leg 810*a*, 810*b* also moves in a generally inwardly lateral direction. As previously mentioned, the guide 792 may assist in directing the lateral movement of at least a portion of the second leg 810*a*, 810*b*. However, as the end region 804*a*, 804*b* of the second leg 810*a*, 810*b*, and particularly the slot 802*a*, 802*b*, is engaged with the angled tab 790 of the insert 780, the inwardly lateral displacement of the actuator portion 796*a*, 796*b* also causes at least the end region 804*a*, 804*b* of the second leg 810*a*, 810*b* to also be moved in an inwardly angled direction (as indicated by "S" in FIG. 47). The inwardly angled displacement of the end region 804 of the second leg 810*a*, 810*b* causes the latching abutments 794*a*, 794*b* of the latch 782*a*, 782*b* to be withdrawn from the front portion 806 of the insert 780, thereby allowing for the latching abutments 794*a*, 794*b* of the latches 782*a*, 782*b* to disengage from the latching abutments of the second shell portion or lid, thereby unlocking the package.

Figure 48:
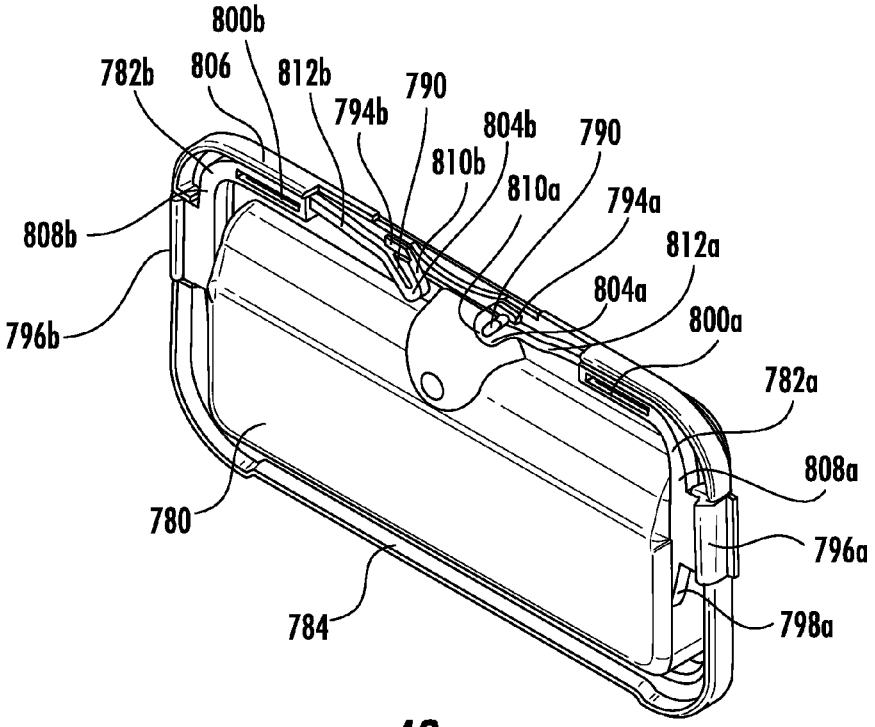
FIG. 48 is a perspective view of the insert shown in FIG. 47 with the latches in an open position.
Figure 49:
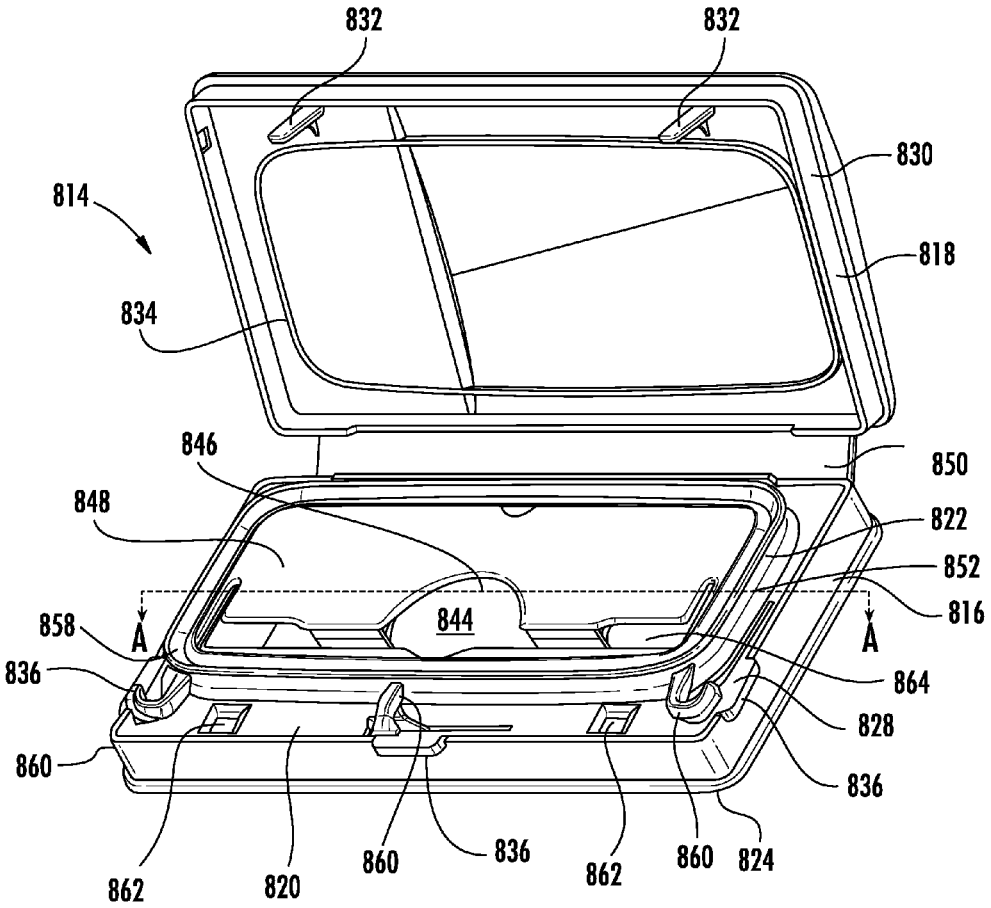
FIG. 49 illustrates a package is a perspective view of a package assembly having a gasket according to an embodiment of the present invention shown in an open position.
Figure 50:
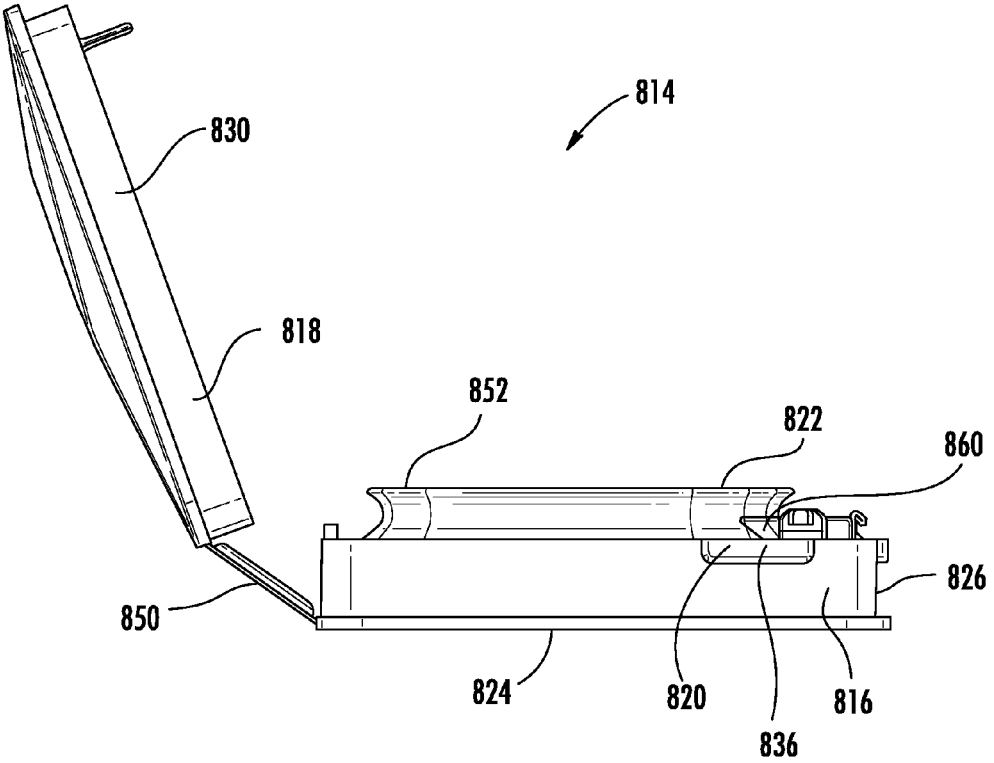
FIG. 50 is a side view of the package assembly shown in FIG. 49.
Figure 51:
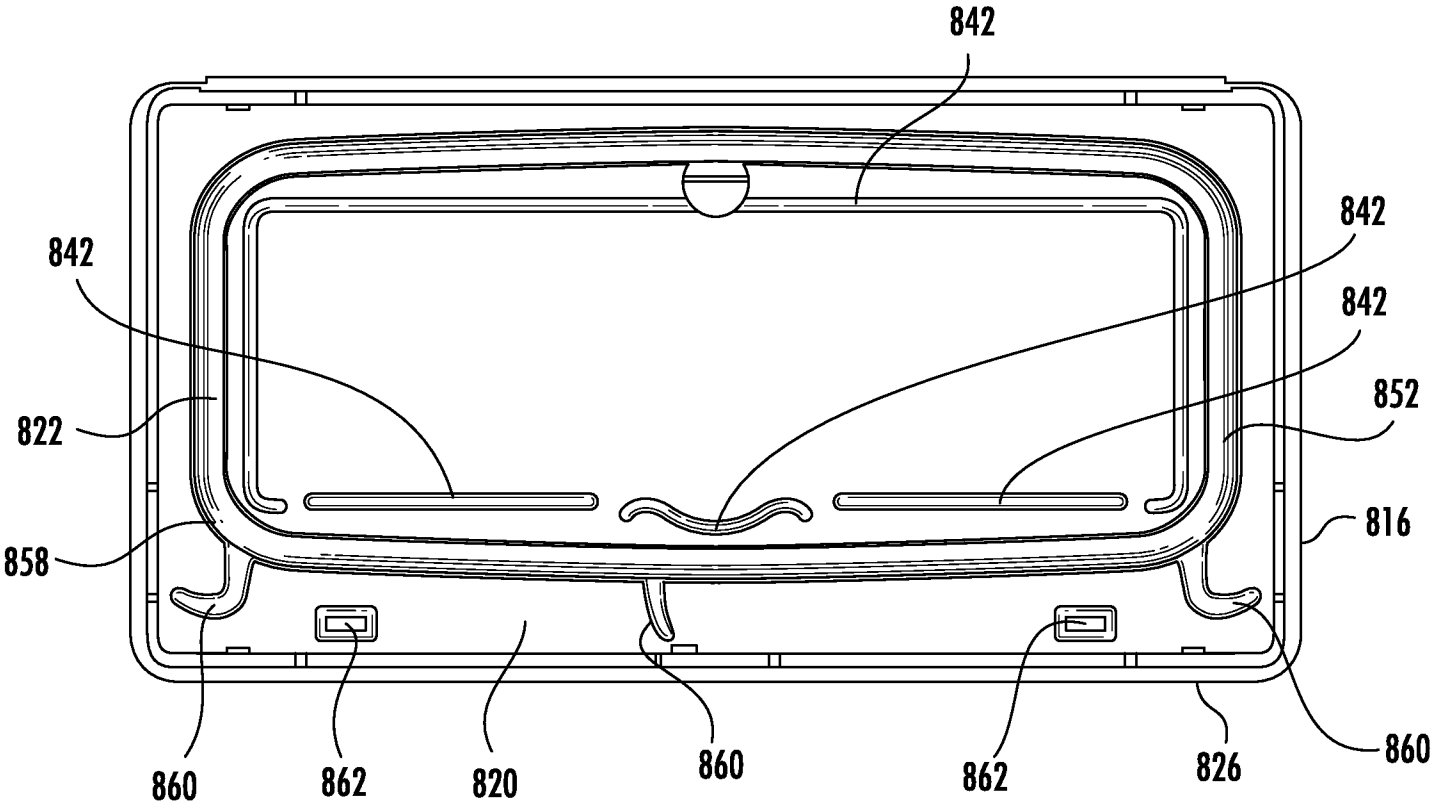
FIG. 51 is a top view of the first shell portion, insert, and gasket of the package assembly show in FIG. 49.
Figure 52:
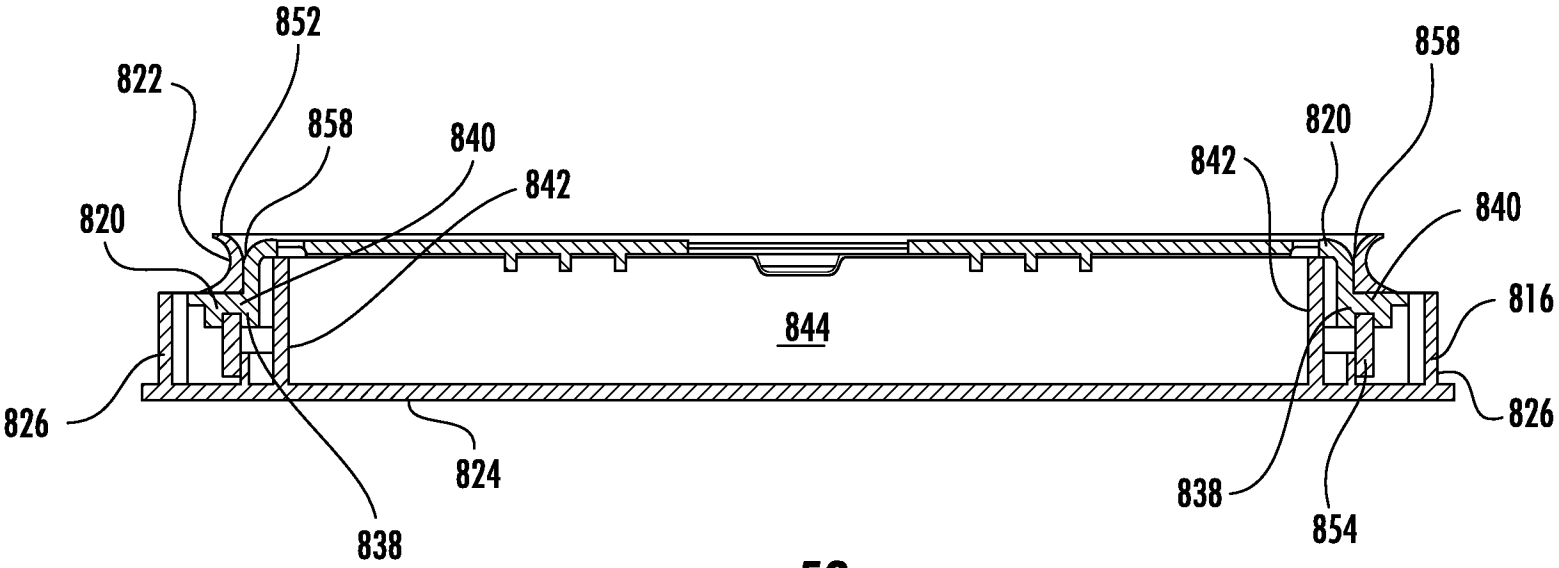
FIG. 52 is a sectional view taken along section line A-A of FIG. 49 of the package assembly.
Figure 53:
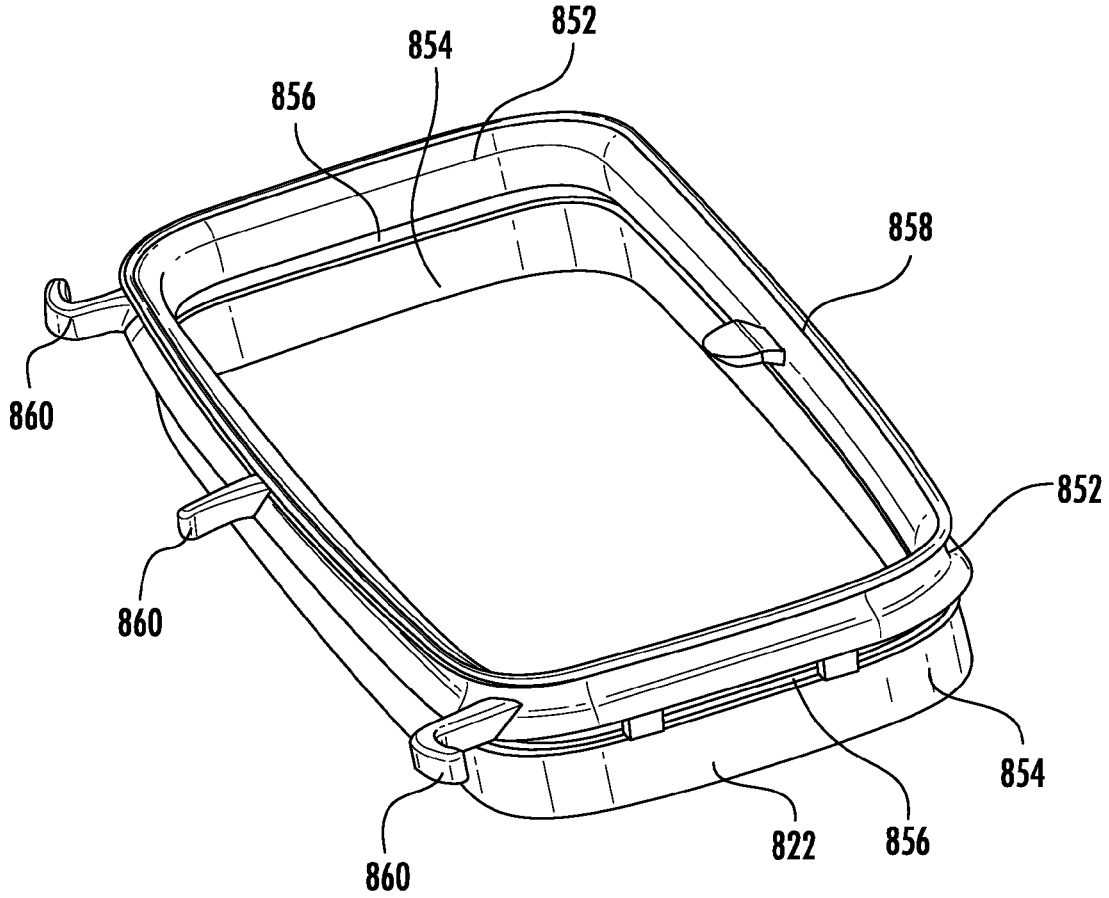
FIG. 53 is a perspective view of the gasket shown in FIG. 51.

As also shown in FIGS. 47 and 48, as the actuator portions 796*a*, 796*b* are generally laterally displaced to unlock the package, the generally inwardly lateral movement of the second legs 810*a*, 810*b* about guide 792 and the angled movement of the end region 804*a*, 804*b* of the second leg 810*a*, 810*b* may cause the distortion, deflecting, or bending of an intermediate portion 812*a*, 812*b* of the second leg 810*a*, 810*b*. According to an embodiment, when the pressure that displaced the actuator portion 796*a*, 796*b* is removed, this intermediate portion 812*a*, 812*b* of the second leg 810*a*, 810*b* may act as a spring that at least assists in returning the latch 782*a*, 782*b* to its rest or locked position as the intermediate portion 812*a*, 812*b* returns from a distorted, deformed, or bent condition to its rest or locked shape or orientation.

Referring to FIGS. 49 to 53, an embodiment of a package 814 is shown having a first shell portion 816, a second shell portion 818, an insert 820, a gasket 822, and a hinge 850. The first shell portion 816 includes a base 824 and a base sidewall 826, the base sidewall 826 having at least one opening 828. The second shell portion 818 includes a lid sidewall 830, at least one guide post 832, and a lid closed lip 834. The insert 820 includes at least one actuator portion 832, a central region 838, and an upper surface 840. In the embodiment illustrated in FIGS. 49 to 53, the insert 820 has three actuator portions 836. Each actuator portion 836 extends through a mating opening 828 in the base sidewall 826. As previously discussed, a variety of hinges may be used for the hinge 850, such as integral and non-integral hinges, including a double hinge, double-fold, flat-top, butterfly, or pinned hinge, among others.

According to certain embodiments, the insert 820 may include an inner wall 842 that at least partially defines a portion of at least one product containing space 844. Additionally, the insert 820 may include a cover 848 over at least a portion of the product containing space 844, the cover 848 providing a dispenser opening 864 for the dispensing of product from the product containing space 844 and a product access opening 846. The cover 848 may be integrally molded to, or separate from, the insert 820 or first shell portion 816.

According to an embodiment, the gasket 822 may include an upper portion 852 that is joined to a lower portion 854. According to certain embodiments, the gasket 822 may include a space 856 between at least a portion of the upper portion 852 and the lower portion 854 that may include an inner area that is configured to receive at least a portion of the insert 820 and/or first shell portion 816 so as to secure the gasket 822 to the insert 820 and/or the first shell portion 816. The upper portion 852 may include a groove 858. A groove 858 is defined between the upper portion 852 of gasket 822 and a raised portion of insert 20 (FIG. 51), which may be the cover and is configured to receive the placement of the lid closed lip 834 when the package 814 is in a closed position. Alternatively, a groove for receiving the lip 834 could be defined in the upper portion 852 of gasket 822. The gasket 822 may also include at least one spring 860. The spring 860 may or may not be configured to be in contact with the actuator portion 832 when the package 814 is in an open position. According to an embodiment, the gasket 822 is constructed from an elastomeric material, such as those discussed above with respect to the ancillary seal 522. When the package 814 is brought from an open position to a dosed position, the lid closed lip 834 extends into the groove 858 to form a seal. According to an embodiment, the engagement of the lid closed lip 834 and groove 858 may cause the gasket 822 to be deformed about at least a portion of the adjacent engaging surfaces of the lid closed tip 834, thereby creating the seal. Additionally, such an engagement may also create an interference fit between the lid closed lip 834 and the gasket 822 that retains, or locks, the package 814 in a closed position.

According to an embodiment, one or more guide posts 832 extending from the second shell package 814 at least assist in properly aligning the second shell portion 818 with the insert 820 and/or the first shell portion 816 when the package 814 is being closed. According to such an embodiment, each guide post 832 may be received in a corresponding aperture 862 in the insert 820 or in the first shell portion 816. According to certain embodiments, at least a portion of the guide post 832 may be received by the aperture 862 before the lid closed lip 834 begins to engage the groove 858 so that the second shell portion 818 and insert 820 and/or the first shell portion 816 are properly aligned before any portion of the seal begins to be formed.

When a closed package 814 is to be opened, a user may inwardly press on the actuator portion(s) 836 so as to push the spring(s) 860 against the gasket 822 to cause the gasket 822 to at least partially deform from its locked configuration or orientation. This at least partial deformation of the gasket 822 permits the unseating of the lid closed lip 834 in the groove 858, and thereby allows the package 814 to be opened. In one embodiment, the package 814 is configured such that all of actuator portions 836 provided must be depressed in order to cause sufficient deformation of the gasket 822 so as to permit unseating of the lip 834. In other embodiments, the lip 834 can be removed from the groove when only some of the actuator portions 836 are pushed.

Referring to FIGS. 54 to 58, a package 866 is shown having a first shell portion 868, a second shell portion 870, a hinge 872, an insert 874, an inner wall member 876, and a gasket 878. The first shell portion 868 includes a base 880, a base sidewall 882, and at least one opening 884. The second shell portion 870 includes a lid sidewall 886, a second closed lip 888, and at least one catch 890, the catch 890 having a catch aperture 892. According to an embodiment, the catch 890 may be integrated into, or part of, the lid sidewall 886. As previously discussed, the hinge 872 may be an integral or non-integral hinge, and joins the first and second shell portions 868, 870. The insert 874 has an insert base 894 and an insert wall 896. The insert wall 896 may generally define a product containing space 898. Additionally, the product containing, space 898 may be covered by a cover 900, as previously discussed, which may be integrally molded, or attached, to the first insert 874.

The gasket 878 has a gasket base 902 and a gasket wall 904, and may be constructed from an elastomeric or non-elastomeric material, including the elastomeric and non-elastomeric materials discussed above. At least a portion of the gasket base 902 extends beneath the insert base 904. The gasket wall 904 generally extends upward from the gasket base 902, as shown by at least FIGS. 56 and 57. According, to certain embodiments, the gasket base 902 may be adhered to the base 880 of the first shell portion 868. Alternatively, the gasket 878 may include at least one protrusion that extends from the base of the gasket 878, such as a post, pin, or wall, that mates with a slot or aperture in the base, or vice versa, that secures the gasket 878 to the first shell portion 868.

Figure 57:
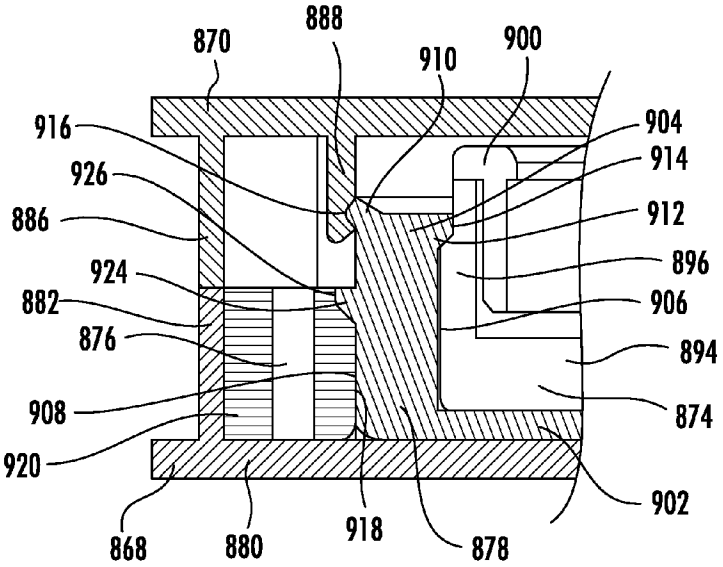
FIG. 57 is a portion of a sectional view of the package assembly identified by circle B-B in FIG. 56.

The gasket wall 904 has an inner surface 906, an outer surface 908, and a gasket lip 910. According to an embodiment, the inner surface 906 of the gasket 878 may be adjacent to, and abut, at least a portion of the insert wall 896. The gasket 878 may be at least partially stretched or deformed about the insert wall 896 to securely engage the gasket 878 with the insert 874. Alternatively, the insert base 894 may be adhered to the gasket base 902. Additionally, as shown in FIG. 57, according to an embodiment, the inner surface 906 or an upper edge of the gasket 878 may include a first protrusion 912 that mates with a recess 914 or chamfered surface in the insert wall 896 to assist with securing the insert 874 to the gasket 878, and/or vice versa.

The gasket lip 910 is configured to mate with a recess 916 in the second closed lip 888 when the package 866 is in a closed position so as to form a seal inside the package 866. Moreover, when the package 866 is in a closed position, at least a portion of the gasket 878 may be deformed so that the gasket lip 910 is pressed into the recess 916 of the second closed lip 888 to form a seal. Additionally, at least a portion of the gasket 878 may be pressed, and at least partially deformed, between at least a portion of the second closed lip 888 and the insert 874, thereby forming a seal.

Figure 58:
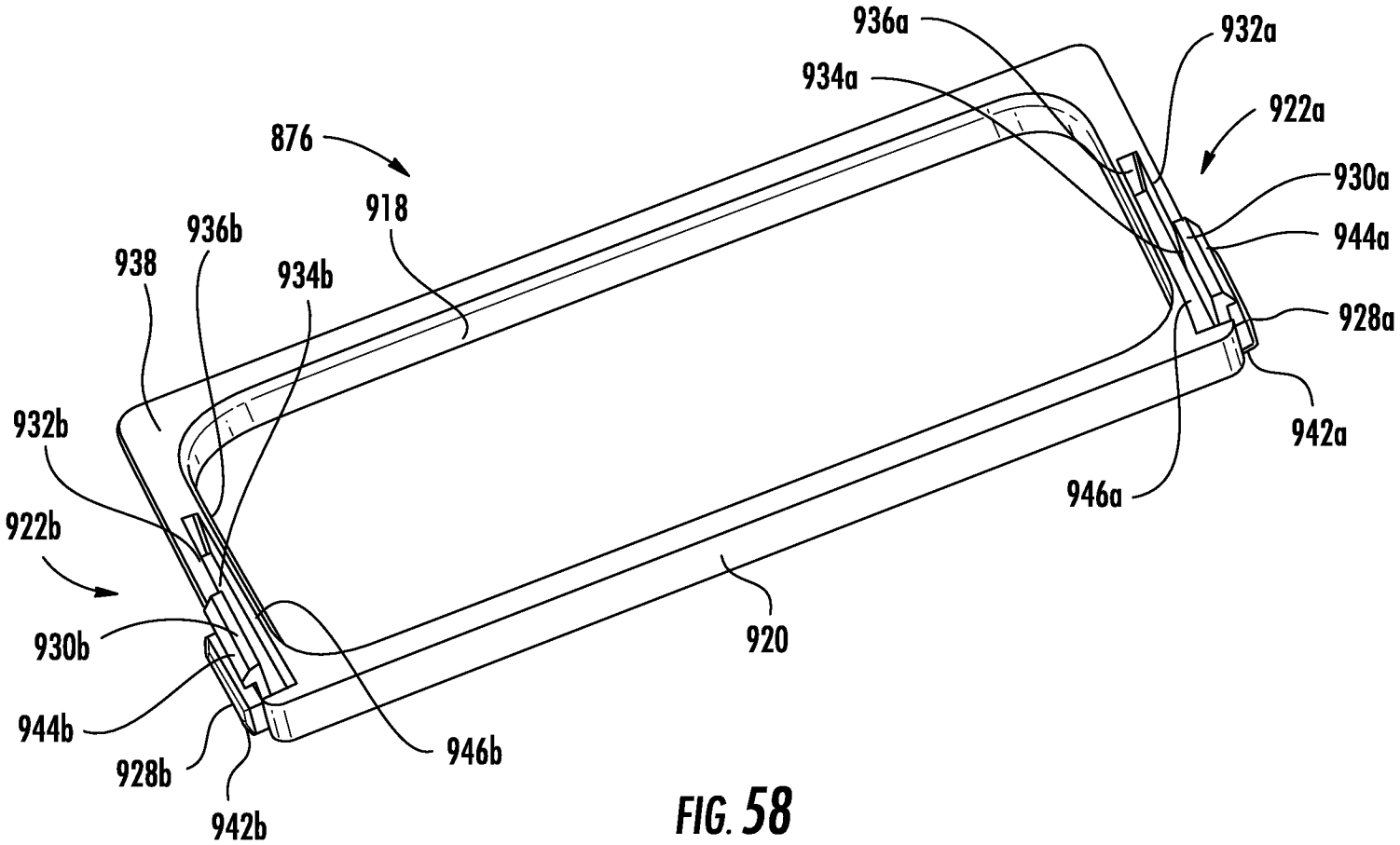
FIG. 58 is a perspective view of an inner wall member of the package assembly shown in FIG. 54.

As shown by at least FIG. 58, the inner wall member 876 includes a first surface 918, a second surface 920, and at least one latch 922. The first surface 918 may be adjacent to and abut the gasket 878, while the second surface 920 may be adjacent to, and abut the base sidewall 882 of the first shell portion 868. The second surface 920 of the gasket 878 may include a second protrusion 924 that mates with a recess 926 or chamfered surface in the first surface 918 of the inner wall member 876. Additionally, according to an embodiment, the inner wall member 876 may be constructed from a relatively rigid material. For example, according to an embodiment, the inner wall member 876 may be constructed from a non-elastomeric material.

According to the embodiment illustrated in FIG. 58, the inner wall member 876 includes two latches 922*a*, 922*b*, while the second shell includes two mating catches 892*a*, 892*b*. The latches 922*a*, 922*b* include an actuator portion 928*a*, 928*b*, a latching abutment 930*a*, 930*b*, and a leg 932*a*, 932*b*, the leg 932*a*, 932*b* having a first end 934*a*, 934*b* and a second end 936*a*, 936*b*. The first end 934*a*, 934*b* of the leg may include, or terminate at, the actuator portion 928*a*, 928*b*, while the second end 936*a*, 936*b* may be connected to the body 938 of the inner wall member 876. At least a portion of the actuator portion 928*a*, 928*b* may extend through the opening 884 in the first shell portion 868. Additionally, at least a portion of the leg 932*a*, 932*b* may be separated from the body 938 of the inner wall member 876 by a space 946*a*, 946*b*, which provides an area in which the leg 932*a*, 932*b* may be displaced, bent, deflected, and/or distorted when the actuator portion 928*a*, 928*b* is displaced toward the interior of the package 866 in a generally lateral direction (as indicated by "L" in FIG. 54). The leg 932*a*, 932*b* may also be configured to bias the actuator portion 928*a*, 928*b* and latching abutment 930*a*, 930*b* in a locked or rest position, as shown in FIG. 58.

The latching abutment 930*a*, 930*b* may upwardly extend from the leg 932*a*, 932*b* or the actuator portion 928*a*, 928*b* and through an aperture 940*a*, 940*b* in the insert 874 or first shell portion 868. The latching abutment 930*a*, 930*b* is configured to lockingly engage the catch aperture 892*a*, 892*b* when the package 866 is closed. Moreover, the latching abutment 930*a*, 930*b* may have a protrusion 942*a*, 942*b* that protrudes into the catch aperture 892*a*, 892*b* to lock the package 866 in a closed position. Additionally, an upper surface 944 of the protrusion 942 may be chamfered so as to facilitate the ability of the latching abutment 930*a*, 930*b* to be deflected, bent, or distorted when the bottom of the catch 890*a*, 890*b* comes into contact with the latching abutment 930*a*, 938*b* as the package 866 is being moved from an open position to a closed position and until the catch aperture 892*a*, 892*b* is moved into position for locking engagement with the latching abutment 930*a*, 930*b*.

Figure 54:
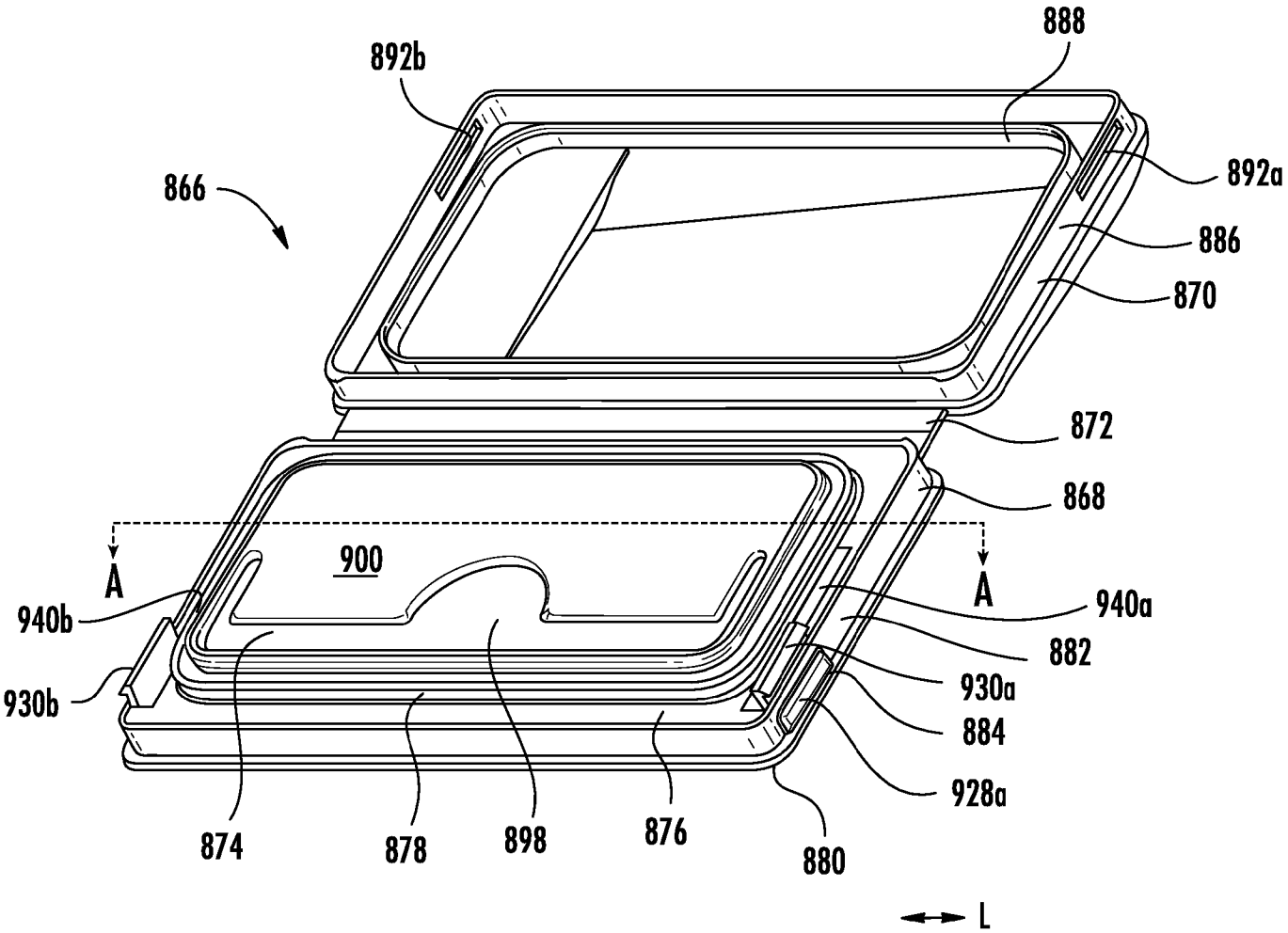
FIG. 54 is a perspective view of an embodiment of a package assembly having an integrated seal and spring release shown in an open position.
Figure 55:
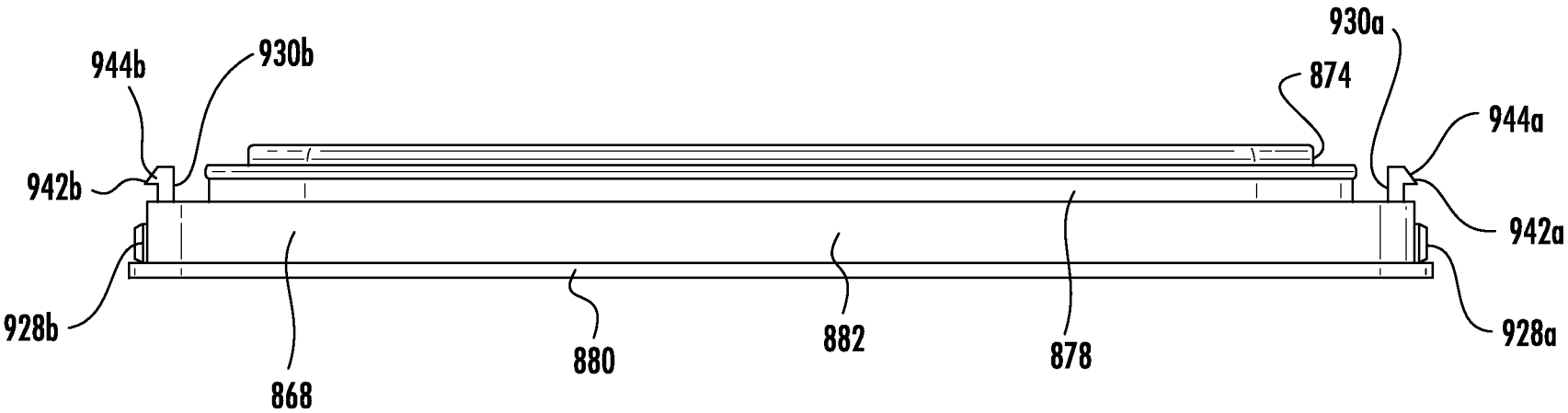
FIG. 55 is a view of the front of the package assembly illustrated in FIG. 54 without the second shell portion.
Figure 56:
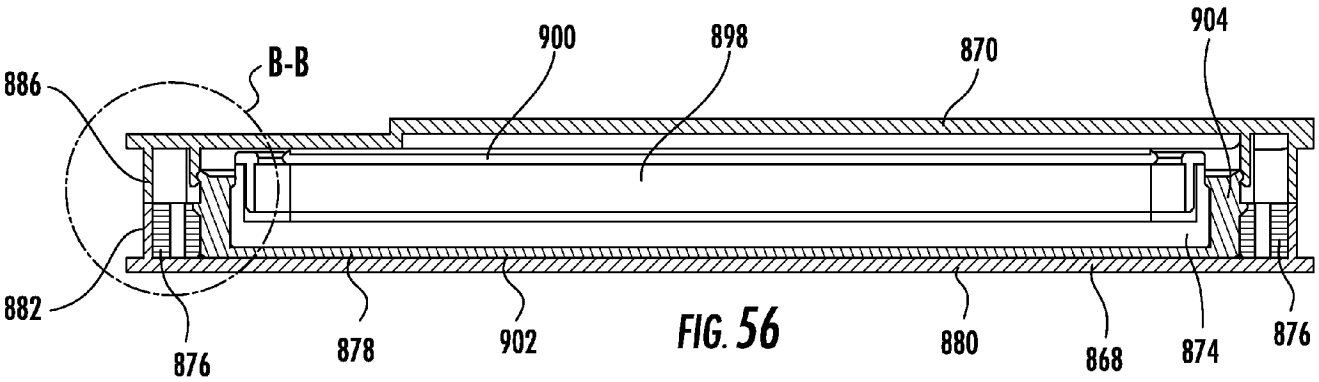
FIG. 56 is a sectional view taken along section line A-A of FIG. 54 if the package assembly were in a closed position with the second shell portion.

When a locked package 866 is to be opened, the actuator portions 928*a*, 928*b* are inwardly displaced in direction L of FIG. 54, causing the deflection, distortion, or bending, of the legs 932*a*, 932*b* and the displacement of the latching abutment 930*a*, 930*b*. The latching abutment 930*a*, 938*b* is inwardly displaced at least until the latching abutment 930*a*, 930*b* disengages the catch 890*a*. 890*b*, thereby allowing the package 866 to be opened. When the inward pressure on the actuator portions 928*a*, 928*b* is released, the legs 932*a*, 932*b* may return to their rest or locked position, and thereby also return the actuator portions 928*a*. 928*b* and latching abutments 930*a*, 930*b* to a rest or locked position.

As previously discussed, the inserts for the packages described herein may be operably secured to the first shell portion, such as through the use of adhesives, mechanical fasteners, welding, or snap or friction fits between at least a portion of the insert and at least a portion of the first shell portion, among others. Such inserts may include downwardly extending tabs that fit or mate into slots, openings, or protrusions, such as ribs, that are formed in the first shell portion. For example, according to an embodiment, a first shell portion may include one or more protrusions or ribs, such as a rib along both sides of the interior region of the first shell portion and two parallel ribs along a front central portion of the interior region of the first shell portion. According to such an embodiment, when the insert is properly positioned within the first shell portion, the downwardly extending tabs from the insert may engage, such as abut and/or press upon, the ribs in the first shell portion.

Figure 59:
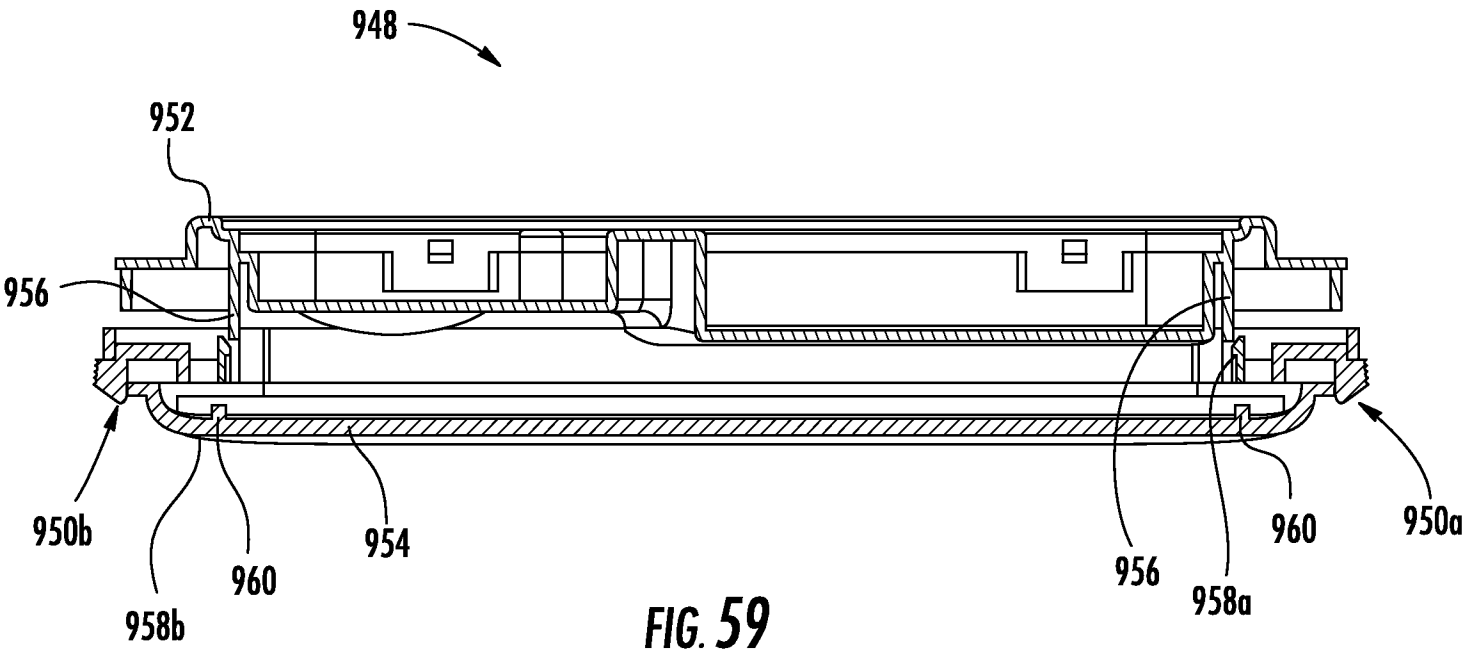
FIG. 59 is a cross sectional view of an insert being inserted into a first shell portion of a package according to an embodiment of the present invention.

As shown in FIG. 59, according to an embodiment of the present invention, at least one spring 958*a*, 958*b* may assist in properly positioning and/or securing an insert 952 to a first shell portion 954. According to an embodiment, the spring's 958*a*, 958*b* are attached to, or extend from, the first shell portion. According to another embodiment, the latches 950*a*, 950*b*, such those previously discussed, include a spring 958*a*, 958*b* that press upon a downwardly extending tab 956 of the insert 952. Moreover, the spring 958*a*, 958*b* may be the same spring or leg of the latch 950*a*, 950*b* used to bias the latch 950*a*, 950*b* in a rest or locked position, or may be a secondary spring. According to such embodiments, the spring 958*a*, 958*b* may be integrally molded to, or non-integrally attached to, the latch 950*a*, 950*b*.

The springs 958*a*, 958*b* may be loaded in the lateral or vertical directions (as indicated by "L" or "V" in FIG. 1) so as to exert a force on the insert 952 as the insert 952 is being inserted into the first shell portion 954, and thereby assist in properly positioning or guiding the insert 952 into the first shell portion 954. For example, according to an embodiment, the latches 950*a*, 950*b* may press upon the tab 956 so that the tab 956 is guided to be placed against or within a corresponding protrusion or rib 960 in the first shell portion 954. According to an embodiment, once the insert 952 has been properly positioned in the first shell portion 954, the spring 958*a*, 958*b* may continue to exert sufficient force on the insert 952 to retain the insert 952 at a desired position within the first shell portion 954. According to another embodiment, after the insert 952 has been positioned within the first shell portion 954, the insert 954 may be further secured to the first shell portion 954 through the application of a mechanical fastener, adhesive, or welding, such as wet welding.

Figure 60:
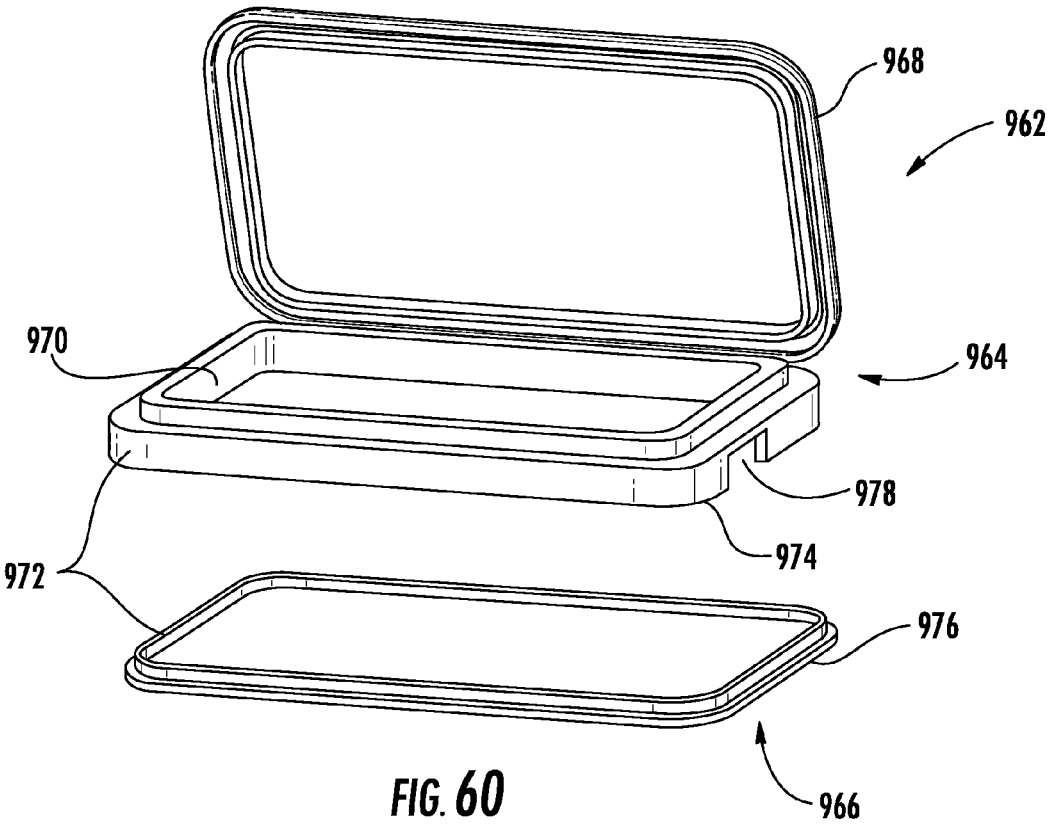
FIG. 60 is a front perspective view of a first and second member according to an embodiment of a package assembly.
Figure 61:
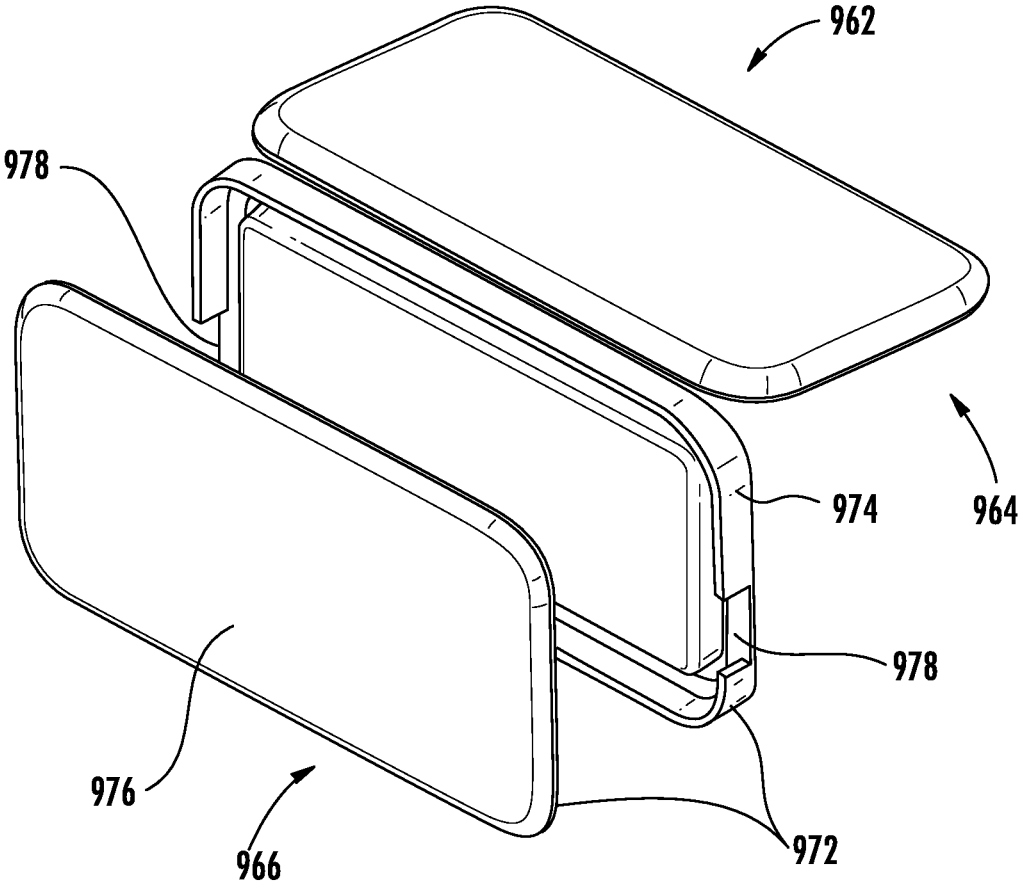
FIG. 61 is a rear perspective view of the package assembly shown in FIG. 60.
Figure 62:
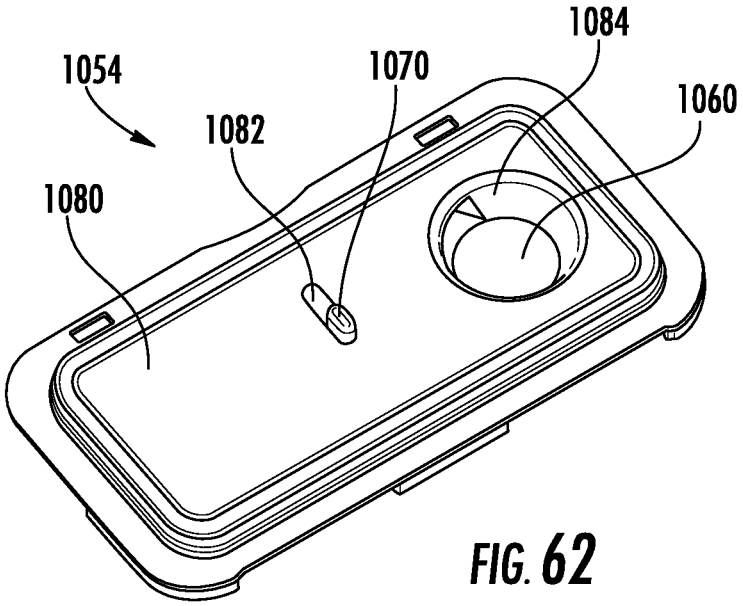
FIG. 62 is a first side perspective view of an embodiment of an insert having a slide assembly.
Figure 63:
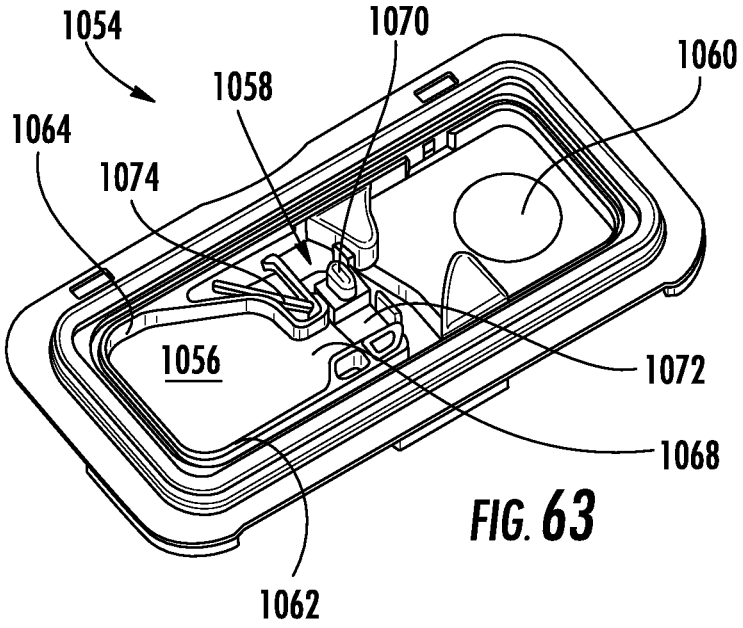
FIG. 63 is a first side perspective view of the insert shown in FIG. 62 but without a cover.
Figure 64:
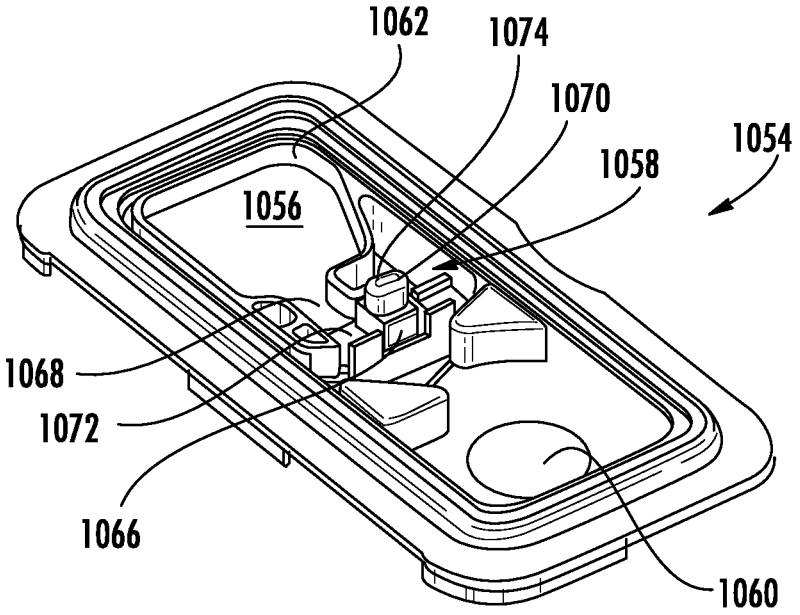
FIG. 64 is a second side perspective view of the insert shown in FIG. 62 but without a cover.
Figure 65:
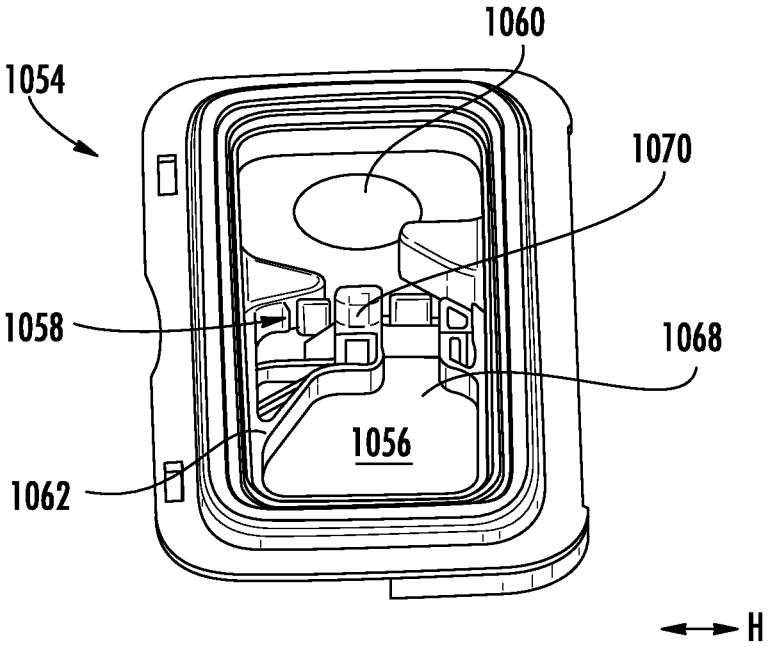
FIG. 65 is a front perspective view of the insert shown in FIG. 62 but without a cover.

Referencing FIGS. 60 and 61, according to an embodiment, the package 962 may include an integrally formed first member 964 and a second member 966. According to an embodiment, the first member 964 may include the second shell portion 968 and the insert 970, while the second member 966 may include the first shell portion 972. According to another embodiment, the first member 964 may include the second shell portion 968, the insert. 970 and/or other portion of the first shell portion 972 that is part of the first member, such as the base sidewall 974. According to such an embodiment, the second member 966 may include the base 976 of the first shell portion 972. Additionally, according to certain embodiments, the first member 964 may include an integral hinge similar to those previously discussed that allows at least a portion of the second shell portion 968 be removed or pivoted away from the insert 970 so as to open the first member 964 and provide a user access to product contained in the insert 970. The package 962 may also include a seal for sealing a product containing space within the insert 970 from ambient air that is outside of the seal, such as those seals previously discussed above.

The first member 964 may include openings 978 configured to receive the placement of the actuator portion of one or more latches, such as the latches previously discussed above. Additionally, the first member 964 or second member 966 may be configured to receive the placement of the latches during assembly. The second member 966 may be configured to be operably secured to the first member 964, such as by a friction fit, a snap fit, mechanical fasteners, welding, or adhesives, among others.

Figure 66:
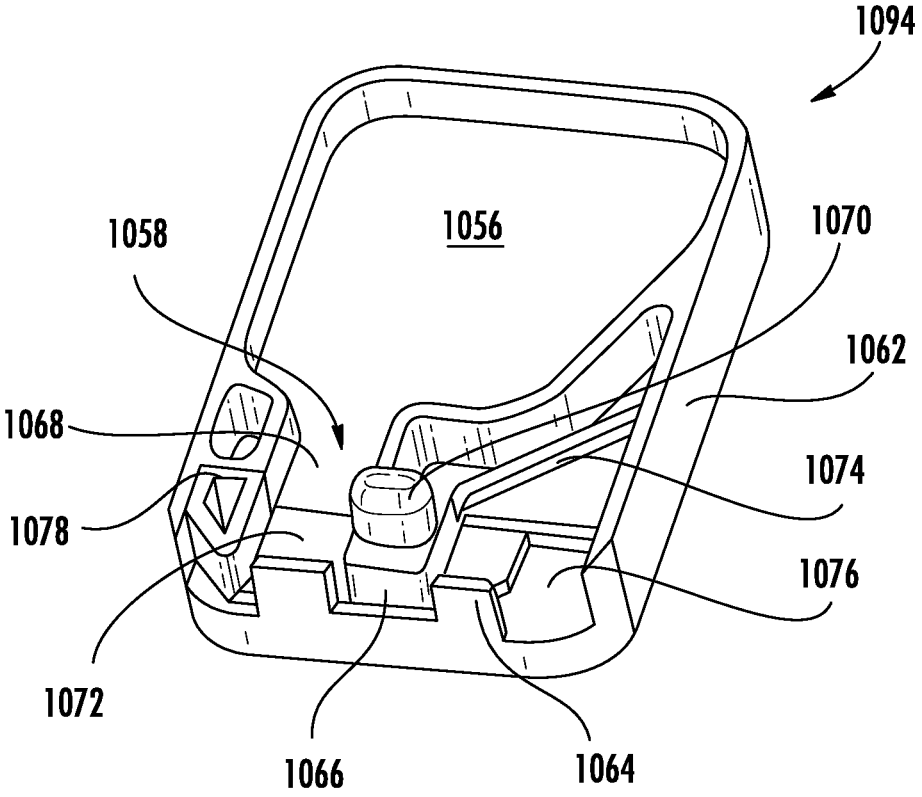
FIG. 66 is a perspective view of an embodiment of a secondary insert having a slide assembly.
Figure 67:
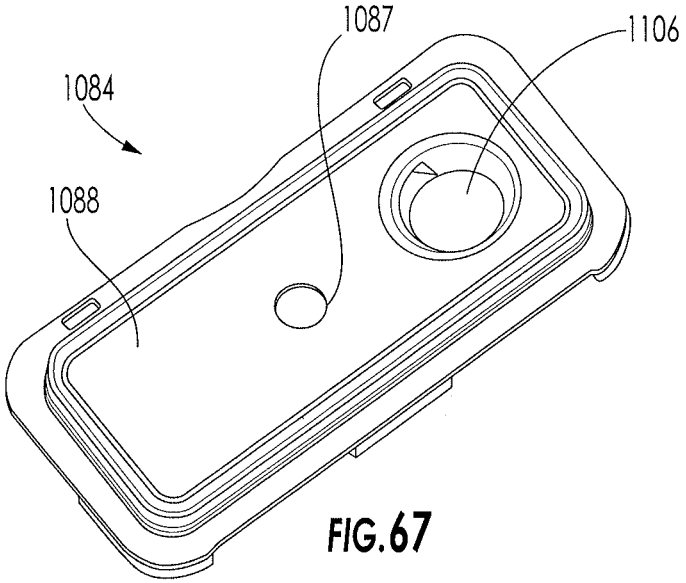
FIG. 67 is a side perspective view of an embodiment of an insert having a push button assembly.
Figure 68:
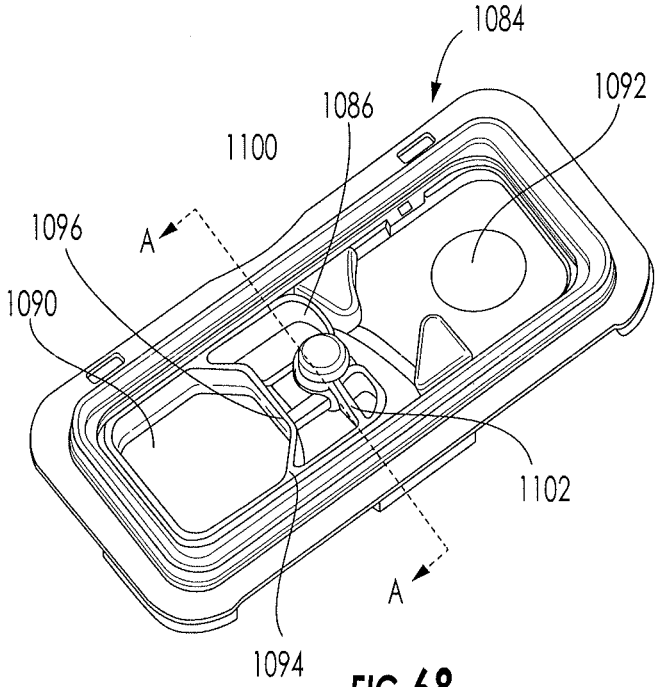
FIG. 68 is a side perspective view of the insert shown in FIG. 67 but without a cover.
Figure 69:
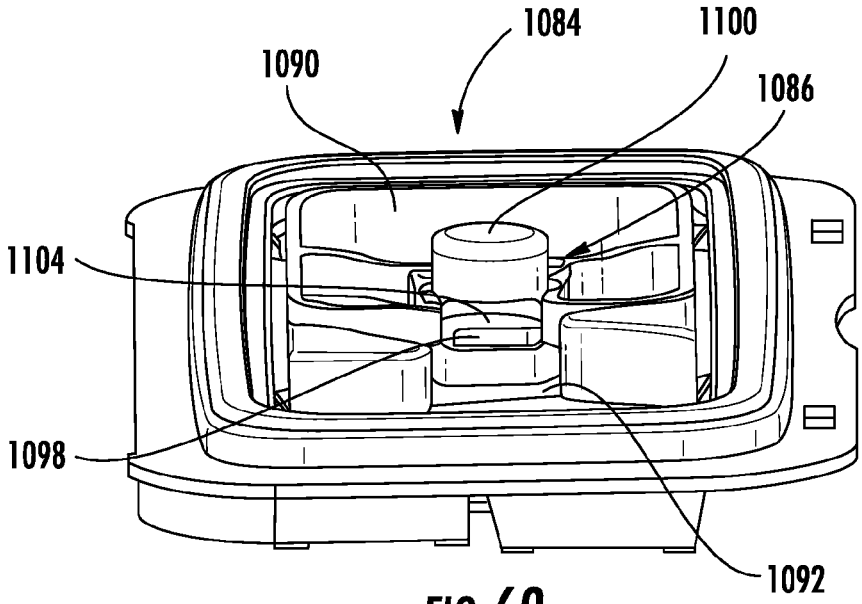
FIG. 69 is a rear perspective view of the insert shown in FIG. 68.
Figure 70:
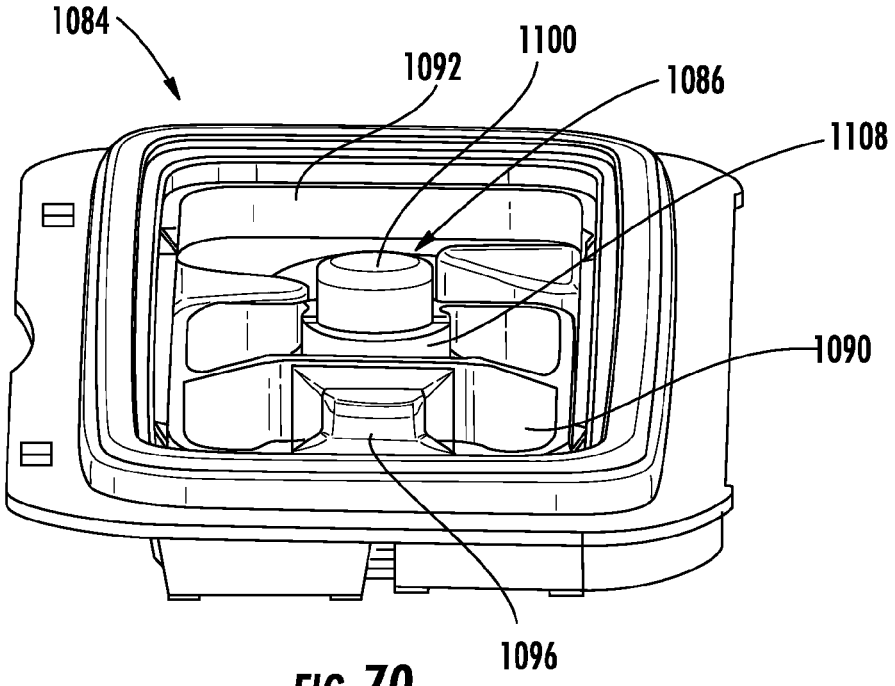
FIG. 70 is a front perspective view of the insert shown in FIG. 68.
Figure 71:
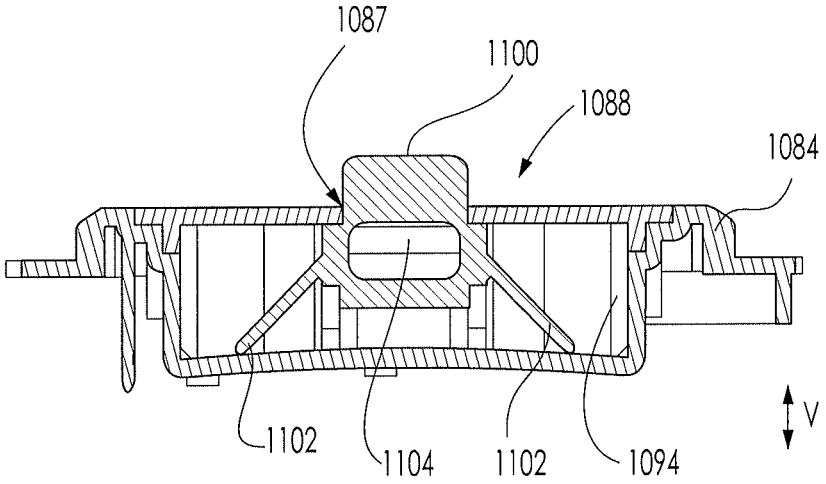
FIG. 71 is a sectional view taken along line A-A in FIG. 68 of an embodiment of an insert having a push button assembly.
Figure 72:
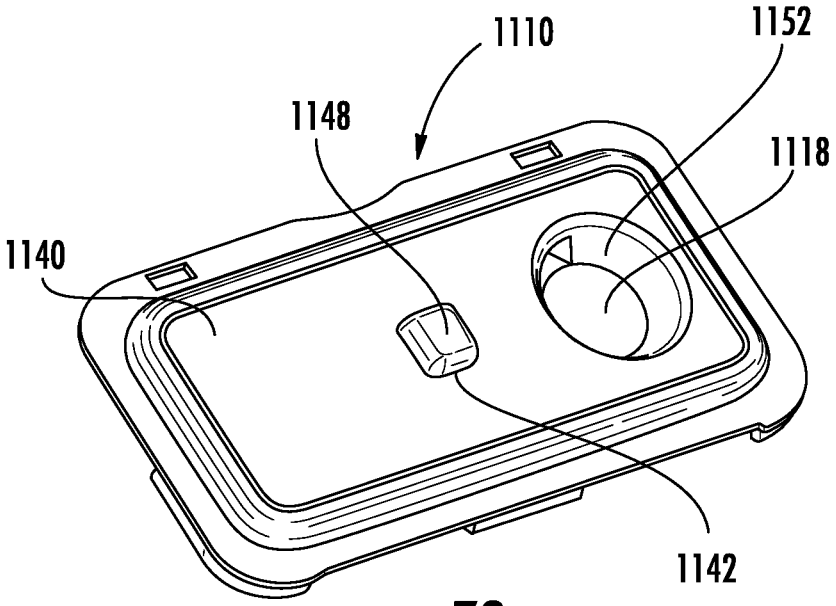
FIG. 72 is a side perspective view of an embodiment of an insert having a push button assembly and ramp.
Figure 73:
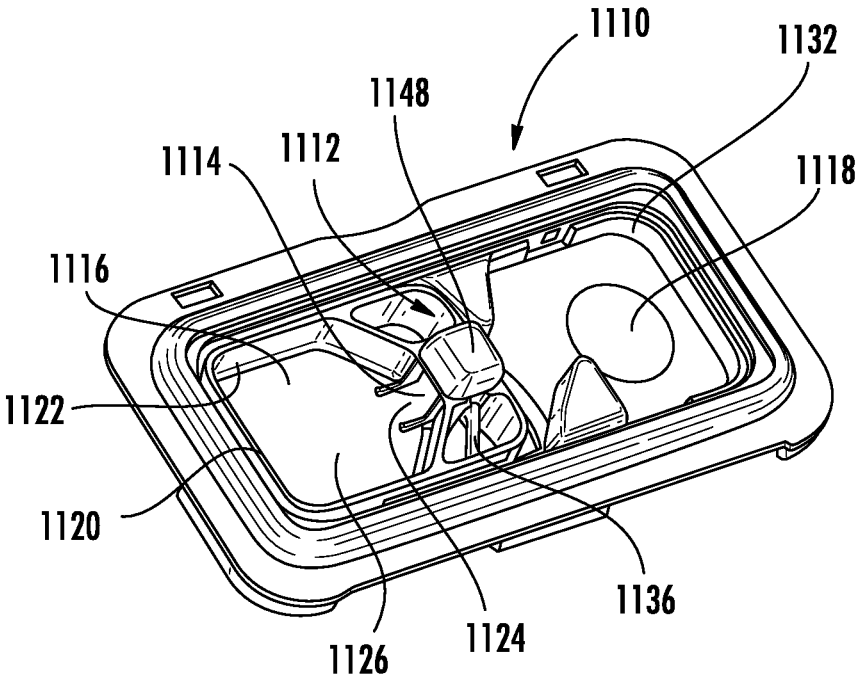
FIG. 73 is a side perspective view of the insert shown FIG. 72 but without a cover.
Figure 74:
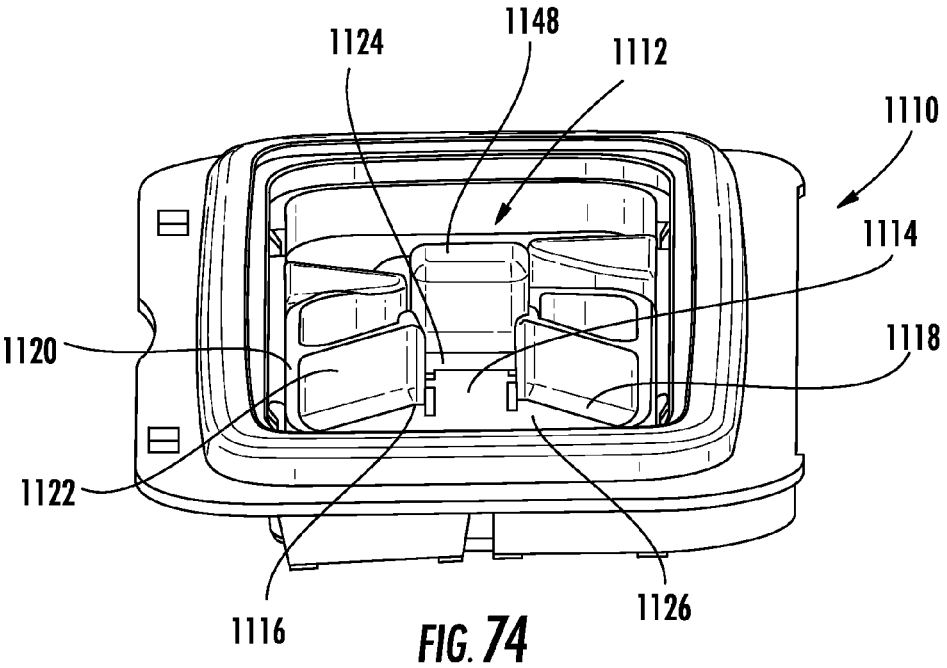
FIG. 74 is a front perspective view of the insert shown in FIG. 73.
Figure 75:
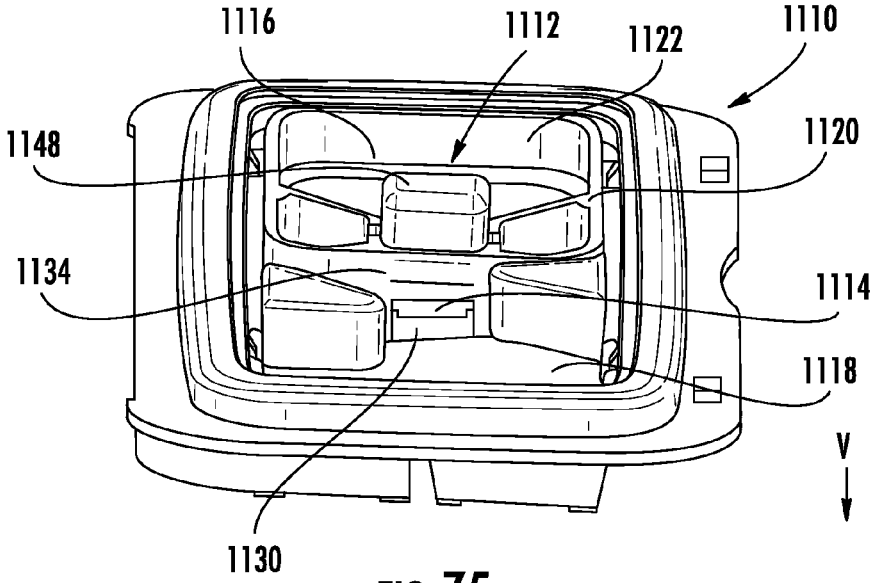
FIG. 75 is a rear perspective view of the insert shown in FIG. 73.
Figure 76:
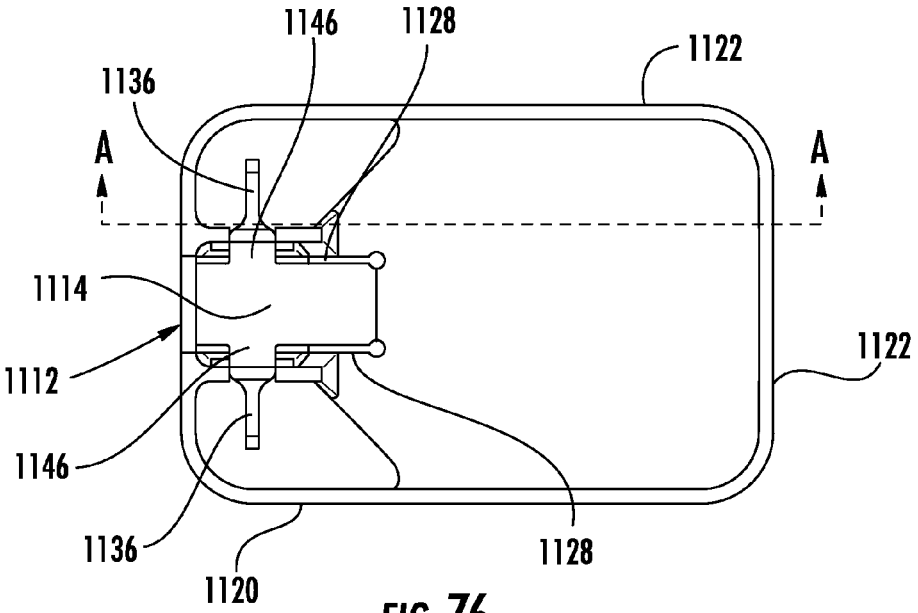
FIG. 76 is a bottom plan view of an embodiment of a secondary insert, ramp, and a portion of the push button assembly.
Figure 77:
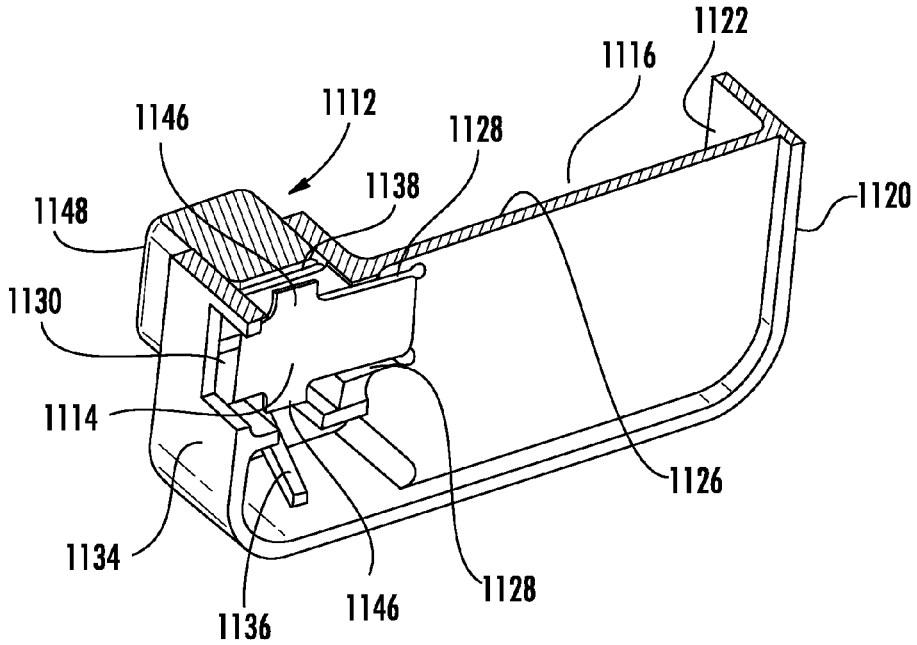
FIG. 77 is a sectional view taken along line A-A in FIG. 76 of a secondary insert and a portion of the push button assembly.
Figure 78:
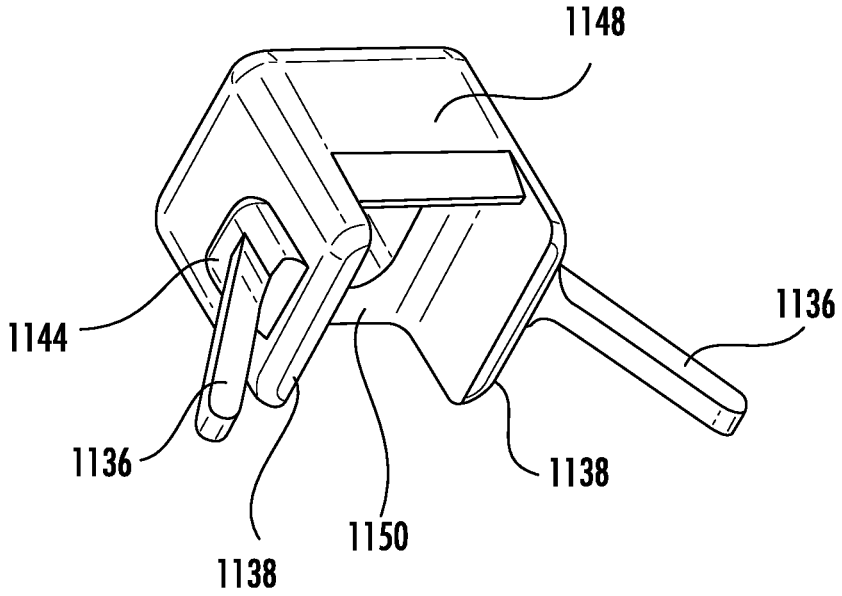
FIG. 78 is a perspective view of an embodiment of a push button assembly.

FIGS. 62 to 66 illustrate an insert. 1054, which may be used with the packages previously discussed, that controls the dispensing of product from a product containing space 1056. The insert 1054 includes a slide assembly 1058, the product containing space 1056, and a dispenser receptacle 1060. According to an embodiment, the product containing space 1056 and the dispenser receptacle 1060 may be integrally molded into the insert 1054, or may be separate components that are assembled in the insert 1054. For example, as shown in FIG. 66, the product containing space 1056 may be housed in a secondary insert 1094 that is assembled in the insert 1054. The insert 1054 or secondary insert 1094 include a first sidewall 1064 and at least one inner opening 1066. According to an embodiment, the first sidewall 1064 defines at least a portion of the perimeter of the product containing space 1056. The product containing space 1056 includes a mouth 1068 through which product may be dispensed out from the product containing space 1056.

According to an embodiment, the slide assembly 1058 includes a lever 1070, a slide opening 1072, and a spring 1074. The slide assembly 1058 has an integral or non-integral construction. The spring 1074 biases the slide assembly 1058 in a closed position so that, when the slide assembly 1058 is in an open position and a user releases the lever 1070, the slide assembly 1058 returns to a closed position. According to an embodiment, product in the product containing space 1056 is not dispensed to the dispenser receptacle 1060 when the slide assembly 1058 is in a closed position.

The slide opening 1072 may be sized to transport a certain amount of product, namely the amount of product that fits in the slide opening 1072, to the inner opening 1066 for dispensing into the dispenser receptacle 1060. For example, the slide opening 1072 may be sized to hold one or more pieces of product.

According to an embodiment, the insert 1054 or secondary insert. 1094 includes a track 1076, groove, and/or protrusion that guides the displacement of the slide assembly 1058 in a horizontal direction (as indicated by "H" FIG. 65) as the slide assembly 1058 is moved to and from the open and closed position. The track may include a recessed region of the secondary insert 1062 and the first sidewall 1064 of the secondary insert 1062.

According to an embodiment, the mouth 1068 of the product containing space 1056 and the inner opening 1066 are offset. According to such an embodiment, when the slide assembly 1058 is in a closed position, the slide opening 1072 generally aligns with the mouth 1068 of the product containing space 1056 so that product may be dispensed from the product containing space 1056 to the slide opening 1072. When the slide assembly 1058 is moved to an open position, at least a portion of the slide opening 1072 is generally aligned with the inner opening 1066. The product contained in the slide opening 1072 may then pass through the inner opening 1066 and into the dispenser receptacle 1060. Additionally, as the slide opening 1072 is moved into general alignment with the inner opening 1066, an outer slide wall 1078 of the slide assembly 1058 may at least partially move in front of the mouth 1068 of the product containing space 1056, thereby preventing the dispensing of additional product from the product containing space 1056. When the user releases the lever 1070 of the opened slide assembly 1058, the spring 1074 biases the slide assembly 1058 back into a closed position.

According to other embodiments, the inner opening 1066 and mouth 1068 of the product containing space 1056 may be generally aligned. According to such embodiments, the slide may include a slide wall that blocks the passage of product from the mouth 1068 of the product containing space 1056 and the inner opening 1066 when the slide assembly 1058 is in a closed position. When the user moves the slide assembly 1058 to an open position, the slide wall also moves and the slide opening 1072 becomes generally aligned with the mouth 1068 and inner opening 1066 so that product may move from the product containing space 1056 and into the dispenser receptacle 1060.

The insert 1054 may also include, or be attached to, a cover 1080, as previously discussed. According to an embodiment, the cover 1080 may cover the product containing space 1056 and at least a portion of the dispenser receptacle 1060. According to an embodiment, the cover 1080 includes a slot 1082, at least a portion of the lever 1070 protruding through the slot 1082 so that a user may engage at least a portion of the lever 1070. The slot 1082 may also be configured to allow the displacement of the latch 1070 in the lever 1070 in the generally "H" direction (as indicated, by "H" in FIG. 65) as the slide assembly 1068 is moved between open and closed positions. Additionally, the slot 1082 may include one or more notches in which the lever 1070 may be slid so as to lock the slide assembly 1058 in an open and/or closed position. The cover 1080 also includes a dispenser opening 1084 through which product in the dispenser receptacle 1060 may be removed from the insert 1054.

FIGS. 67 to 71 illustrate an insert 1084, which may be used with the packages previously discussed, that includes a push button assembly 1086 that controls the dispensing of product. The insert 1084 may include a cover 1088, a product containing space 1090, a dispenser receptacle 1092, and the push button assembly 1086. The product containing space 1090 may be defined by walls of the insert 1084, or may be part of a secondary insert 1094, as previously discussed. According to an embodiment, the product containing space 1090 includes a mouth 1096 that is configured to allow the passage of product out from the product containing space 1090. The dispenser receptacle 1092 includes an opening 1098 through which product enters the dispenser receptacle 1092.

According to an embodiment, the opening 1098 of the dispenser receptacle 1092 is offset from the mouth 1096 of the product containing space 1090 in a vertical direction (as indicated by "V" in FIG. 71) so that the bottom of the opening 1098 is at a lower or higher height than the bottom of the mouth 1096. Moreover, the opening 1098 and the mouth 1096 may be offset at a height sufficient to prevent the passing of product from the product containing space 1090 to the dispenser receptacle 1092 without the displacement of the push button assembly 1086. Additionally, the push button assembly 1086 may be configured to interfere with the ability of product to pass from the mouth 1096 and into opening 1098 without manipulation of the push button assembly 1086. According to the embodiment illustrated in FIGS. 67 to 71, the bottom of the opening 1098 is positioned higher than the bottom of the mouth 1096.

The push button assembly 1086 includes a button 1100, at least one spring 1102, and an orifice 1104, the orifice 1104 being operably connected to the button 1100. According to the embodiment illustrated in FIGS. 68 and 71, the push button assembly 1086 includes two springs 1102. The orifice 1104 may be positioned within the body of the button 1100, the orifice 1104 being sized to receive the insertion of one or more pieces of product that is stored in the product containing space 1090. The button 1100 may be at least partially housed in a sleeve 1108 in the insert 1084 or secondary insert 1094 that assists in guiding the movement of the button 1100.

According to an embodiment, the springs 1102 bias the button 1100 so that the orifice 1104 is generally aligned with either the mouth 1096 of the product containing space 1090 or the opening 1098 of the dispenser receptacle 1092, and so that the button 1100 protrudes through an aperture 1087 in the cover 1086. For example, according to certain embodiments, the springs 1102 bias the button 1100 so that the orifice 1104 is generally aligned with the opening 1098 of the dispenser receptacle 1092. According to such an embodiment, a user may depress the button 1100 in the "V" direction, thereby bringing the orifice 1104 of the button 1100 into general alignment with the mouth 1096 of the product containing space 1090. The user may then tilt the package so that at least one piece of product contained in the product containing space 1090 enters the orifice 1104. The user may then release the button 1100, thereby allowing the springs 1102 to force the button 1100 upward in the "V" direction so that the orifice 1104 is generally aligned with the opening 1098 of the dispenser receptacle 1092. The user may then tilt, or the product may then move, out of the orifice 1104 and into the dispenser receptacle 1092. The product may then be removed through a dispenser opening 1106 in the cover 1088.

According to another embodiment, rather than being a push button, the button 1100 may rotate in a generally circular direction. According to such an embodiment, the mouth 1096 and opening 1098 may or may not be offset in the vertical direction. The orifice 1104 in the button 1100 may be biased by, among others, a spring or coil, so as to be biased in communication with the mouth 1096 or the opening 1098. According to an embodiment in which the orifice 1104 is biased in communication with the opening 1098 of the dispenser receptacle 1092, the button 1100 is rotated until the orifice 1104 is in communication with the mouth 1096 so that product contained in the product containing space 1090 may be moved into the orifice 1104. Once product has been placed in the orifice 1104, the button 1100 may be released, after which the button 1100 rotates so that the orifice 1104 returns to being into communication with the dispenser receptacle 1092, and the product contained in the orifice 1104 may be moved into the dispenser receptacle 1092.

FIGS. 72 to 78 illustrate an insert 1110, which may be used with the packages previously discussed, that includes a push button assembly 1112 having a ramp 1114 that controls the dispensing of product. The insert 1110 includes a product containing space 1116, a dispenser receptacle 1118, the push button assembly 1112, and the ramp 1114. According to an embodiment, the ramp 1114 and product containing space 1116 may be integrally molded in the insert 1110 or in a secondary insert 1120. The product containing space 1116 may include a sidewall 1122, a mouth 1124, and a base 1126. The ramp 1114 may be positioned about, or adjacent to, the mouth 1124. According to an embodiment, at least a portion of the ramp 1114 extends into the product containing space 1116. Additionally, according to an embodiment, the ramp 1114 extends from the base 1126 of the product containing space 1116, and may be detached or separated from adjacent material along a portion of at least two of its sides by spaces 1128. The spaces 1126 are configured to allow at least a portion of the ramp 1114 to be bent, deflected, distorted, or pivoted in a generally downward vertical direction (as indicated by "V" in FIG. 75).

The dispenser receptacle 1118 includes an opening 1130 and a receptacle sidewall 1132. According to an embodiment, at least a portion of the perimeter of the dispenser receptacle 1118 may be defined by an inner wall 1134 of the insert 1110 or secondary insert 1120. The inner wall 1134 may also include the opening 1130 of the dispenser receptacle 1118. The opening 1130 of the dispenser receptacle 1118 is offset from the mouth 1124 of the product containing space 1116 in a vertical direction so that at least a portion of the opening 1130 is at a lower or higher vertical height than the mouth 1124. The opening 1130 and the mouth 1124 may be offset at a height sufficient to prevent product from passing from the product containing space 1116 to the dispenser receptacle 1118 without the displacement of the push button assembly 1112. Additionally, the push button assembly 1112 may be configured to interfere with the ability of product to pass from the mouth 1124 and into opening 1130 without manipulation of the push button assembly 1112. According to certain embodiments, at least a portion of the bottom of the dispenser receptacle 1118 is at a different vertical position than the base 1126 of the product containing space 1116. For example, at least a portion of the bottom of the dispenser receptacle 1118 in proximity to the opening 1130 of the dispenser receptacle 1118 may be at a higher or lower vertical position than the base 1126 of the product containing space 1116 at the mouth 1124 of the product containing space 1116.

The push button assembly 1112 includes a button 1148, at least one spring 1136, and at least one tab 1138, the tab 1138 extending from the bottom 1150 or the side of the button 1148. In the embodiment illustrated in FIGS. 72 to 78 two tabs 1138 are shown extending downwardly from the button 1148. According to an embodiment, the spring 1136 is integrally molded with the button 1148 and biases the button 1148 upwardly so that, when the button 1148 is biased by the spring 1136 into a rest position, there is space for at least a portion of the product from the product containing space 1116 to be positioned between the bottom 1150 of the button 1148 and the ramp 1114.

The spring 1136 may also generally bias the button 1148 in an upward vertical direction so that the button 1148 protrudes through an aperture 1144 in a cover 1140. The cover 1140 covers at least a portion of the product containing space 1116, and includes a dispenser opening 1152 for the removal of product from the dispenser receptacle 1118.

Additionally, according to an embodiment, the insert 1110 or secondary insert 1120 includes at least one recess that mates with a protrusion 1144 that extends from the side of the button 1148 and assists in guiding the vertical movement of the button 1148 when the button 1148 is downwardly displaced and as the displaced button 1148 returns to a rest position.

According to an embodiment, product from the product containing space 1116 may be positioned beneath the button 1148 when the button 1148 is at a rest position by titling the package, which may cause the movement of product from the product containing space to the ramp 1114. Before the displacement of the button 1148, the inner wall 1134 and ramp 1114 may prevent the product that is beneath the button 1148 from being dispensed into the dispenser receptacle 1118. When product is to be dispensed into the dispenser receptacle 1118, the button 1148 is displaced in a generally downwardly vertical direction. According to an embodiment, as the button 1148 is downwardly displaced, the tab 1138 from the button 1148 pushes downwardly on the ramp 1114 or on an extension member 1146 that extends from the ramp 1114. The downward force of the tab 1138 on the extension member 1146 and the spaces on the side of the ramp 1114 allow the ramp 1114 to be bent, deflected, deformed or pivoted so that the ramp 1114 downwardly extends from the base 1126 of the product containing space 1116 to a position about the opening 1130 of the inner wall 1134 that allows the product that is beneath the button 1148 to pass into the dispenser receptacle 1118. According to an embodiment, as the product that was beneath the button 1148 is delivered to the dispenser receptacle 1118, the body of the button 1148 provides a barrier that prevents additional product from passing out of the product containing space 1116 and into the dispenser receptacle 1118, thereby controlling the amount of dispensed product. After the product from beneath the button 1148 has been dispensed into the dispenser receptacle 1118, the downward force on the button 1148 is released. The spring 1136 then biases the button 1148 back to a rest position, where the alignment of the ramp 1114 and the inner wall 1134 again prevent the dispensing of product from the product containing space 1116 into the dispenser receptacle 1118.

It should be noted that the term "comprising" does not exclude other elements or steps and that "a" or "an" do not exclude a plurality.

The invention claimed is:

1. A package for the dispensing of a product to a user comprising:

a first shell portion and a second shell portion hingedly coupled together;

an insert secured within said first shell portion, the insert including a product containing space, a dispenser receptacle, and a push button assembly, the insert having a mouth through which product may exit the product containing space, the dispenser receptacle having an opening through which product may enter the dispenser receptacle, the position of the mouth being at least partially offset from the position of the opening;

the push button assembly having a button that is depressable by the user from a closed position to an open position, said button including a body having an orifice therein, said orifice configured to receive at least one product from said product containing space, said orifice being in communication with only one of said mouth and said opening when said button is in said closed position and said orifice being in communication with both said mouth and said opening when said button is in said open position for enabling said at least one product to move from said product containing space to said dispenser receptacle.

2. The package of claim 1, wherein the push button assembly is biased toward the closed position.

3. The package of claim 2, wherein the insert is covered by a cover, the cover having a dispenser opening and an aperture, the dispenser opening configured for the removal of product from the dispenser receptacle, the aperture being configured for at least a portion of the button to protrude from the cover.

4. The package of claim 3, wherein said product containing space comprises a separate component from said insert, said product containing space being positioned within said insert to form a secondary insert.

5. The package of claim 4, wherein the push button assembly is positioned in the secondary insert.

* * * * *